US007847481B2

(12) United States Patent
Sano et al.

(10) Patent No.: US 7,847,481 B2
(45) Date of Patent: Dec. 7, 2010

(54) PLASMA DISPLAY PANEL AND METHOD FOR FABRICATING THE SAME

(75) Inventors: Yoshio Sano, Tokyo (JP); Nobumitsu Aibara, Tokyo (JP); Yoshiaki Yanai, Tokyo (JP); Toshiyuki Akiyama, Tokyo (JP); Tetsumasa Okamoto, Tokyo (JP); Kazuaki Yanagida, Tokyo (JP); Hirokazu Tateno, Tokyo (JP); Naoto Hirano, Tokyo (JP); Yoshito Tanaka, Tokyo (JP); Tadashi Nakamura, Tokyo (JP); Keiji Nunomura, Tokyo (JP)

(73) Assignee: Panasonic Corporation, Osaka (JP)

( * ) Notice: Subject to any disclaimer, the term of this patent is extended or adjusted under 35 U.S.C. 154(b) by 310 days.

(21) Appl. No.: 11/930,399

(22) Filed: Oct. 31, 2007

(65) Prior Publication Data

US 2008/0084161 A1 Apr. 10, 2008

Related U.S. Application Data

(62) Division of application No. 11/249,399, filed on Oct. 14, 2005, now Pat. No. 7,336,033, which is a division of application No. 09/909,910, filed on Jul. 23, 2001, now Pat. No. 7,002,296.

(30) Foreign Application Priority Data

Jul. 24, 2004 (JP) ..... 2000-223185

(51) Int. Cl.
*H01J 17/49* (2006.01)

(52) U.S. Cl. ..... 313/582; 313/584

(58) Field of Classification Search ..... None
See application file for complete search history.

(56) References Cited

U.S. PATENT DOCUMENTS 4,629,942 A 12/1986 Horio et al.

(Continued)

FOREIGN PATENT DOCUMENTS

EP 0 920 048 6/1999

(Continued)

*Primary Examiner*—Ashok Patel
(74) *Attorney, Agent, or Firm*—Sughrue Mion, PLLC

(57) ABSTRACT

Ribs for defining pixel cells are formed in the shape of a lattice, and sustain electrodes and scan electrodes are disposed near the ribs. The electrodes are spaced apart in each pixel cell, and the sustain electrode and the scan electrode are each cut away between pixel cells arranged in the row direction to provide each pixel cell with individually separated electrodes. In addition, between pixel cells adjacent to each other in the row direction, the sustain electrodes and the scan electrodes are connected to each other by means of a sustain-side bus electrode and a scan-side bus electrode, respectively. This makes it possible to provide a high luminous efficiency. Furthermore, each pixel cell is provided with a wide distance between the electrodes and thereby with a large effective opening portion. Thus, this provides only a small amount of reduction in intensity when the electrodes are spaced apart between the pixel cells arranged in the row direction in order to increase the luminous efficiency. The sustain electrodes or the scan electrodes can be connected to each other or shared between pixel cells adjacent to each other in the column direction and thus the effective opening portion can be made larger, thereby making it possible to provide a further increased intensity and luminous efficiency.

19 Claims, 57 Drawing Sheets

U.S. PATENT DOCUMENTS

| | | | | |
|---|---|---|---|---|
| 5,182,489 | A | 1/1993 | Sano | |
| 5,557,168 | A | 9/1996 | Nakajima et al. | |
| 5,640,068 | A | 6/1997 | Amemiya | |
| 5,701,056 | A | 12/1997 | Shinohara | |
| 5,744,909 | A | 4/1998 | Amano | |
| 5,889,365 | A | 3/1999 | Tanabe | |
| 5,900,694 | A | 5/1999 | Matsuzaki et al. | |
| 5,939,828 | A | 8/1999 | Matsuzaki et al. | |
| 5,952,782 | A | 9/1999 | Nanto et al. | |
| 5,969,472 | A | 10/1999 | Kisner | |
| 5,982,095 | A | 11/1999 | Jin et al. | |
| 6,008,582 | A | 12/1999 | Asano et al. | |
| 6,037,713 | A | 3/2000 | Fukuta et al. | |
| 6,051,928 | A | 4/2000 | Choi et al. | |
| 6,088,011 | A | 7/2000 | Lee et al. | |
| 6,249,264 | B1 * | 6/2001 | Sano et al. | 345/60 |
| 6,342,874 | B1 | 1/2002 | Tokunaga et al. | |
| 6,465,956 | B1 * | 10/2002 | Koshio et al. | 313/586 |
| 6,469,451 | B2 | 10/2002 | Mori | |
| 6,479,935 | B1 | 11/2002 | Park et al. | |
| 6,492,770 | B2 * | 12/2002 | Amemiya et al. | 313/586 |
| 6,545,405 | B1 | 4/2003 | Shino et al. | |
| 6,639,363 | B2 * | 10/2003 | Amatsuchi et al. | 313/582 |
| 6,995,512 | B2 * | 2/2006 | Otani | 313/587 |
| 7,002,296 | B2 * | 2/2006 | Sano et al. | 313/583 |
| 7,183,720 | B2 * | 2/2007 | Kobayashi | 315/169.4 |
| 7,336,033 | B2 * | 2/2008 | Sano et al. | 313/582 |
| 2001/0017520 | A1 * | 8/2001 | Masuda et al. | 313/586 |
| 2001/0030510 | A1 * | 10/2001 | Amemiya et al. | 313/582 |

FOREIGN PATENT DOCUMENTS

| | | |
|---|---|---|
| FR | 2 700 049 | 7/1994 |
| JP | 03-269933 | 12/1991 |
| JP | 05-250992 | 9/1993 |
| JP | 05-266801 | 10/1993 |
| JP | 06-12026 | 1/1994 |
| JP | 08-022772 | 1/1996 |
| JP | 08-050029 | 2/1996 |
| JP | 8-96714 | 4/1996 |
| JP | 08-250030 | 9/1996 |
| JP | 09-120777 | 5/1997 |
| JP | 09-167565 | 6/1997 |
| JP | 10-228858 | 8/1998 |
| JP | 10-233171 | 9/1998 |
| JP | 10-247072 | 9/1998 |
| JP | 10-255667 | 9/1998 |
| JP | H11-065486 | 3/1999 |
| JP | 11-212515 | 8/1999 |
| JP | 11-213896 | 8/1999 |
| JP | 11-297214 | 10/1999 |
| JP | 11-312470 | 11/1999 |
| JP | 2000-090836 | 3/2000 |
| JP | 2000-182524 | 6/2000 |
| JP | 2000-188063 | 7/2000 |
| JP | 2000-195431 | 7/2000 |
| JP | 2001-015034 | 1/2001 |
| KR | 1999-023676 | 3/1999 |
| WO | WO 94/15244 | 7/1994 |

* cited by examiner

FIG.6

(PRIOR ART)

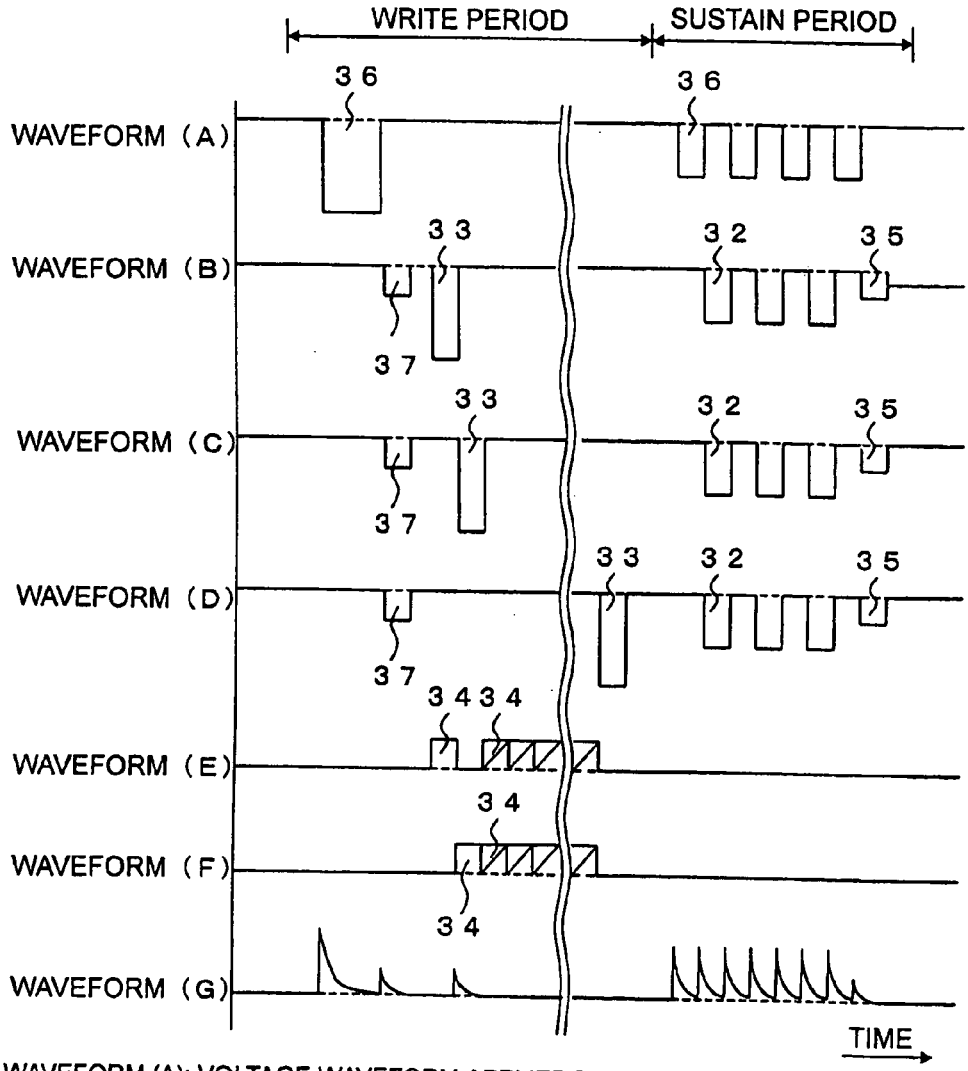

WAVEFORM (A); VOLTAGE WAVEFORM APPLIED TO SUSTAIN ELECTRODES $C_1$, $C_2$, $C_3$, ..., $C_m$

WAVEFORM (B); VOLTAGE WAVEFORM APPLIED TO SCAN ELECTRODE $S_1$

WAVEFORM (C); VOLTAGE WAVEFORM APPLIED TO SCAN ELECTRODE $S_2$

WAVEFORM (D); VOLTAGE WAVEFORM APPLIED TO SCAN ELECTRODE $S_m$

WAVEFORM (E); VOLTAGE WAVEFORM APPLIED TO COLUMN ELECTRODE $D_1$

WAVEFORM (F); VOLTAGE WAVEFORM APPLIED TO COLUMN ELECTRODE $D_2$

WAVEFORM (G); LIGHT EMISSION WAVEFORM OF PIXEL $a_{11}$

PLASMA DISPLAY PANEL AND METHOD FOR FABRICATING THE SAME

This is a divisional of application Ser. No. 11/249,399 filed Oct. 14, 2005, which is a divisional of application Ser. No. 09/909,910 filed Jul. 23, 2001; the entire disclosures of which are considered part of the disclosure of the accompanying divisional application and are incorporated by reference.

BACKGROUND OF THE INVENTION

1. Field of the Invention

The present invention relates to plasma display panels which are employed as an image display device for use with information terminal devices, personal computers, televisions or the like. More particularly, the present invention relates to a plasma display panel and its fabrication method which make it possible to provide a higher peak intensity and less maximum power consumption for a plasma display panel, having a large capacity and a high resolution, than prior-art panels and methods.

2. Description of the Related Art

Plasma display panels have such advantages that they have a simple construction, facilitates the provision of a large screen, and can employ inexpensive glass materials, which are widely used for glass windows or the like, as substrates for constituting the display panel.

A plasma display panel employs two transparent insulating substrates formed of such a glass material, each transparent insulating substrate having electrodes and ribs formed thereon to define pixel cells or display units. To complete the panel, these two transparent insulating substrates, having these structures formed thereon, are disposed in parallel spaced relation to define a gap therebetween in which a discharge gas is sealed. Typically, the rib is about 0.1 mm in height and the transparent insulating substrate is about 3 mm in thickness, thereby making it possible to provide extremely thin and lightweight display devices.

Accordingly, by making use of such features, the plasma display panel has been being used in a display device for personal computers or office work stations, which have found widespread use in recent years, or for large-screen wall-hung televisions which have strong potential for further development.

The plasma display panel is largely classified into DC and AC types depending on the difference in panel structures. The plasma display panel with the electrodes being directly exposed to a discharge gas is referred to as the DC type because a DC current continues to flow once a discharge has occurred. On the other hand, the AC type with an insulating layer being interposed in between the electrodes and the discharge gas allows a pulse current to flow for a short period of time about 1 μs after the application of a voltage and then converge. The flow of current is restricted by the electrostatic capacitance of the insulating layer. The insulating layer acts as a capacitor so that applied AC pulses cause repetitive pulses of light emission to occur for display purposes. This is why the AC type is called by that name.

Although the DC type has a simple structure, the electrodes are directly exposed to discharge environments and therefore wear out in a shorter period of time, thereby making it difficult to provide the DC type with long life. In contrast, the AC type requires additional time, effort, and cost to form the insulating layer, however, the electrodes are covered with the insulating layer, thereby providing the AC type with long life. In addition, the AC type can readily implement the function referred to as a memory function, which enables highly bright light emission, and accordingly has been developed in recent years.

The present invention relates to this AC memory-type plasma display panel. Now, the configuration and then the method of the AC memory-type plasma display panel will be explained below.

First, the configuration of the AC memory-type plasma display panel is described. FIGS. 1 to 3 are views illustrating an AC memory-type plasma display panel disclosed in Japanese Patent Laid-Open Publication No. Hei 6-12026 and having an electrode structure which is generally called a plane discharge type. FIG. 1 is a plan view, FIG. 2 is a cross-sectional view taken along line T-T of FIG. 1, and FIG. 3 is a cross-sectional view taken along line U-U of FIG. 1.

As shown in FIG. 2, this plasma display panel has first and second insulating substrates 11 and 12 which are transparent, 3 mm in thickness, formed of soda glass, and disposed in parallel spaced relation to each other to allow light emission to pass therethrough for display purposes. In between the first insulating substrate 11 and the second insulating substrate 12, provided as basic constituents are the structures for the plasma display panel and sealed is a discharge gas.

On the surface of the first insulating substrate 11 opposite to the second insulating substrate 12, a plurality of sustain electrodes 13*a* formed of transparent NESA film and a plurality of scan electrodes 13*b* also formed of transparent NESA film are disposed alternately in parallel to each other. In addition, a bus electrode 13*c* formed of silver thick film is disposed on top of each sustain electrode 13*a* and each scan electrode 13*b* to be in contact therewith, thereby making it possible to supply sufficient current to the sustain electrode 13*a* and the scan electrode 13*b*. These sustain electrode 13*a*, the scan electrode 13*b*, and the bus electrode 13*c* are formed to extend in the direction of horizontal rows in FIG. 1. Furthermore, these sustain electrode 13*a*, the scan electrode 13*b*, and the bus electrode 13*c*, are covered with an insulating layer 18*a* formed of thick transparent glaze film, and on top of the insulating layer 18*a*, a protective layer 19 of MgO having a thickness of 1 μm for protecting the insulating layer 18*a* from discharges is formed.

Incidentally, the sustain electrode 13*a* and the scan electrode 13*b* are generally referred to as a display electrode portion which plays a major role in emitting light for display purposes. In addition, the bus electrode 13*c* is to supply current to the display electrode portion. Likewise, the wiring portion for supplying current is often referred to as the bus electrode. In this context, the bus electrode 13*c* is sometimes referred to as the bus electrode portion.

The electrode portion composed of the display electrode portion and the bus electrode portion is formed on the same surface of the glass substrate to provide an electrode constituting portion for causing plane discharges, and thus the display electrode portion and the bus electrode portion are generally referred to as the plane discharge electrode. For example, the plane discharge electrode on the side of the sustain electrode has the sustain electrode 13*a* as the display electrode portion and the bus electrode 13*c* on the sustain electrode 13*a* as the bus electrode.

Now, on the second insulating substrate 12, there are formed a plurality of column electrodes 14 of thick silver film to extend in the direction of horizontal rows in FIG. 1. The column electrode 14 and the second insulating substrate 12 are covered with a thick insulating layer 18*b*. In between the insulating layer 18*b* and the insulating layer 18*a*, ribs 16 of thick film are formed to provide spaces for the discharge gas and define pixel cells 20. Furthermore, a discharge gas is sealed in the discharge gas spaces 15 defined by the rib 16, and on the insulating layer 18*b* in each discharge gas space 15, there is provided a phosphor 17 made of $Zn_2SiO_4$:Mn for converting UV light produced by discharges in the discharge gas into visible light.

As described above, the two insulating substrates 11 and 12, each having respective structures formed thereon, are disposed in parallel spaced relation to each other to define a gap therebetween which acts as the discharge gas space 15. The discharge gas space 15 is filled, at a total pressure of 66.5 kPa, with a discharge gas of a gas mixture such as He and Ne mixed at a ratio of seven to three and added by 3% of Xe.

Referring to FIG. 1, the ribs 16 extending horizontally and vertically (in the directions of rows and columns) define discharge cells, which in turn act as pixel cells 20. In FIG. 4, a pixel cell is denoted by aij at the point of an intersection of a scan electrode Si (i=1, 2, . . . , m) and a column electrode Dj (j=1, 2, . . . , n). The phosphor 17 of FIG. 2 can be provided with three colors of red, green, and blue at each pixel cell, thereby providing a plasma display panel which enables full-color display. The display of this plasma display panel can be viewed from either side, that is, in the direction going upwards from the first insulating substrate 11 of FIG. 2 (in the direction of the upper surface) or in the direction going downwards from the second insulating substrate 12 (in the direction of the lower surface). For the plasma display panel shown in FIGS. 1 to 3, it is preferable to view the display panel in the direction of the upper surface, which allows the light emitting portion at the phosphor 17 to be directly viewed and thereby provide higher intensity.

Incidentally, the insulating substrate on the side for viewing the display (the first insulating substrate 11 in this case) may be called the front substrate, while the other insulating substrate (the second insulating substrate 12 in this case) may be called the rear substrate. In addition, in FIG. 1, the longitudinal direction of the bus electrode 13*c* is simply referred to as the row direction, while the longitudinal direction of the column electrode 14 is referred to as the column direction. Furthermore, since the plasma display panel often employs the column direction as the vertical direction, the column direction is assumed to be the vertical direction and the row direction as the horizontal direction for explanatory purposes. However, this is assumed merely for convenience and thus the column direction may be employed as the horizontal direction in practical uses.

FIG. 4 is a plan view illustrating only the arrangement of electrodes of the plasma display panel. Referring to FIG. 4, reference numeral 10 designates a plasma display panel; 21 designates a seal portion where the first insulating substrate 11 and the second insulating substrate 12 are disposed in parallel spaced relation to each other to define a gap therebetween in which a discharge gas is hermetically sealed; C1, C2, . . . , Cm designate the sustain electrodes 13*a*; S1, S2, . . . , Sm designate the scan electrodes 13*b*; and D1, D2, . . . , Dn−1, Dn designate the column electrodes 14. For example, a VGA-type actual plasma display panel has 480 pixel display units in the vertical direction and 640 pixel display units in the horizontal direction, where one pixel display unit consists of three pixel cells of R, G, and B. The VGA-type panel has 480 scan electrodes 13*b* (S1, S2, . . . , Sm) corresponding to the 480 pixel display units in the vertical direction, 480 sustain electrodes 13*a* (C1, C2, . . . , Cm), and 1920 (=640×3) column electrodes 14 (D1, D2, . . . , Dn−1, Dn), which result from the 640 pixel display units, each being divided into three colors in the horizontal direction. Each pixel cell pitch is 0.35 mm between the column electrodes 14 and 1.05 mm between the scan electrodes 13*b*. The distance between the scan electrode 13*b* and the sustain electrode 13*a*, disposed parallel to each other, is 0.14 mm.

Now, described below is a method for performing gray-scale display operation using the plasma display panel configured as described above. For the plasma display panel, unlike other types of display devices, it is difficult to change the level of applied voltages to thereby perform gray-scale display operation at a high intensity, and accordingly the number of times of light emission is controlled in general to perform gray-scale display operation. Particularly, to perform gray-scale display operation at a high intensity, employed is the sub-field method to be described below.

FIG. 5 is an explanatory view illustrating the drive sequence in accordance with the sub-field method. In FIG. 5, the horizontal axis represents the time and the vertical axis represents the scan electrode. A screenful of image is sent during the duration of one field. The duration of one field is often set to within the range of about 1/50 to 1/75 seconds depending on the computer or the broadcasting system.

As shown in FIG. 5, for gray-scale image display operation in the plasma display panel, one field is divided into k sub-fields (k=6 sub-fields, or SF1 to SF6, in the case of FIG. 5). As will be described referring to FIG. 6, each sub-field is made up of a write cycle for writing display data with a preliminary discharge pulse 36, a preliminary discharge erase pulse 37, a scan pulse 33, a data pulse 34 or the like, and a sustain cycle for sustaining light emission for display purposes. Incidentally, in the write cycle, the preliminary discharge pulse and the preliminary discharge erase pulse may be omitted.

The luminous intensity of each pixel cell is controlled in accordance with the following equation 1 by assigning a weight of 2n to the number of times of light emission for sustain discharge at each pixel cell in each sub-field.

$$\text{Intensity} = L1 \times \sum_{n=1}^{k} 2^{(n-1)} \times a_n \qquad \text{(Equation 1)}$$

where n is the sub-field number, being one (1) for the sub-field of the lowest intensity and k for the sub-field of the highest intensity; L1 is the intensity of the sub-field providing the lowest intensity; and $a_n$ is a variable taking on a value of one or zero, being a value of one when the pixel cell emits light in the nth sub-field while zero when no light is emitted therefrom. Since different levels of luminous intensity are provided at each of the sub-fields, brightness can be controlled by selecting the "on" or "off" state of each sub-field.

Since FIG. 5 shows the case of k=6, by color display operation with the red, green, and blue color pixel cells being grouped in one set, 64 ($2^k=2^6$) levels of gray scale can be expressed with the colors. It is possible to display $64^3=262$, 144 colors (including black). For k=1 or one field=one sub-field, the colors allow two levels ("on" or "off") of gray scale to be displayed. This allows $2^3=8$ colors (including black) to be displayed.

FIG. 6 is a view illustrating an example of drive voltage waveforms and a light emission waveform in the plasma display panel shown in FIGS. 1 to 4. A waveform (A) represents a voltage waveform to be applied to the sustain electrodes 13*a* (C1, C2, . . . , Cm); a waveform (B) represents a voltage waveform to be applied to the scan electrode 13*b* (S1); a waveform (C) represents a voltage waveform to be applied to the scan electrode 13*b* (S2); a waveform (D) represents a voltage waveform to be applied to the scan electrode

13*b* (Sm); a waveform (E) represents a voltage waveform to be applied to the column electrode 14 (D1); a waveform (F) represents a voltage waveform to be applied to the column electrode 14 (D2); and a waveform (G) represents a light emission waveform of the pixel cell 20 (all). The pulses having a diagonal line in the waveforms (E) and (F) indicate that the presence or absence of the pulses is determined in accordance with the presence or absence of data to be written. FIG. 6 shows the data voltage waveforms employed when data is written to the pixel cell 20 (a11, a22). The figure also shows that display operation is performed at the pixel cells in the third and subsequent rows depending on the presence or absence of data.

A sustain pulse 31 and a preliminary discharge pulse 36 are applied to the sustain electrodes 13*a* (C1, C2, . . . , Cm). On the other hand, a sustain pulse 32, an erase pulse 35, and the preliminary discharge erase pulse 37 are applied successively in common to the scan electrodes 13*b* (S1, S2, . . . , Sm) in addition to the scan pulse 33 which is applied to each of the scan electrodes 13*b* (S1, S2, . . . , Sm) with independent timing. When light emission data is available, the data pulse 34 is applied to each of the column electrodes Dj (j=1, 2, . . . , n) in phase with the scan pulse 33. In the plasma display panel configured as shown in FIGS. 1 to 4, the erase pulse 35 first erases the discharge in the pixel cell that has emitted light in the immediately previous sub-field. Then, the preliminary discharge pulse 36 causes a preliminary discharge to forcedly occur once in all pixel cells and then the preliminary discharge erase pulse 37 is allowed to erase the preliminary discharge. This allows the scan pulse 33 being subsequently applied to readily cause a write discharge.

After the preliminary discharge has been erased, application of the scan pulse 33 and the data pulse 34 to the scan electrode 13*b* and the column electrode 14 with the same timing to cause a write discharge will cause a discharge between the scan electrode and the column electrode at the same time for the write discharge. This is referred to as the write sustain discharge. Subsequently, the sustain discharge is maintained between the sustain electrode 13*a* and scan electrode 13*b*, adjacent to each other, by the sustain pulses 31 and 32. On the other hand, application of only the scan pulse 33 or only the data pulse 34 would cause neither a write discharge nor a subsequent sustain discharge to occur. Such a function is called the memory function. The luminous intensity is controlled at each of the sub-fields depending on the number of times of sustain discharge.

However, as can be seen from the cross-sectional view of FIG. 3, there is a drawback, in outputting the light emitted from the phosphor 17 upwards in FIG. 55, that the bus electrode 13*c* present above the phosphor 17 provides an insufficient optical output efficiency. Accordingly, there is a problem that this provides a low ratio of luminous intensity to the power input for light emission (hereinafter referred to as the luminous efficiency), resulting in an increased power consumption of a display device employing the plasma display panel.

SUMMARY OF THE INVENTION

It is therefore an object of the present invention to provide a plasma display panel which can provide a high optical output efficiency and high peak intensity and which can be driven with less maximum power consumption, and a method for fabricating the panel.

As a first aspect, the present invention provides an AC plane discharge plasma display panel having a fundamental structure including a front substrate, a rear substrate, and a sealing portion for encapsulating the front substrate and the rear substrate at a peripheral edge portion thereof to seal a discharge gas therebetween. The plasma display panel also includes column ribs and row ribs for defining pixel cells in a column direction and in a row direction, respectively, to thereby define the pixel cells in a matrix, and plane discharge electrodes constituted by a display electrode portion and a bus electrode portion. The plasma display panel is characterized in that at least part of the display electrode portion of the plane discharge electrodes has a notched portion or a cut-away portion between pixel cells adjacent to each other in the row direction; a sustain electrode and a scan electrode, paired as plane discharge electrodes, are placed in one pixel cell; and for neighboring pixel cells arranged in the column direction, sustain electrodes and scan electrodes are disposed to allow respective sustain electrodes and scan electrodes to be adjacent to each other between neighboring pixel cells. Furthermore, as a second aspect, there is provided the plasma display panel having the aforementioned fundamental structure according to the first aspect, characterized in that neighboring sustain electrodes or sustain-side bus electrodes for neighboring pixel cells arranged in the column direction are electrically connected to each other in the panel.

Furthermore, as a third aspect, there is provided the plasma display panel having the aforementioned fundamental structure according to the first aspect, characterized in that neighboring scan electrodes or scan-side bus electrodes for neighboring pixel cells arranged in the column direction are electrically connected to each other in the panel.

Furthermore, as a fourth aspect, there is provided a method for fabricating the plasma display panel set forth in the aforementioned first to third aspect, characterized by including the steps of encapsulating the rear substrate and the front substrate in a vacuum, and sealing a discharge gas in the panel continually thereafter without exposing the interior of the panel to the atmosphere.

Furthermore, as a fifth aspect, there is provided the plasma display panel set forth in the aforementioned first to third aspect, characterized in that lattice-shaped ribs are formed on the rear substrate.

Furthermore, as a sixth aspect, there is provided the plasma display panel set forth in the aforementioned fifth aspect, characterized in that a gap for allowing a discharge gas to pass therethrough is provided between the top of the lattice-shaped rib and the front substrate.

Furthermore, as a seventh aspect, there is provided the plasma display panel set forth in the aforementioned sixth aspect, characterized in that projected portions are provided on intersections of lattice-shaped ribs of the front substrate or the rear substrate, the intersections corresponding to those of lattice-shaped ribs of the rear substrate.

Furthermore, as an eighth aspect, there is provided the plasma display panel set forth in the aforementioned seventh aspect, characterized in that the projected portions define scan-side bus electrodes and sustain-side bus electrodes or scan electrodes and sustain electrodes between pixel cells adjacent to each other in the row direction.

Furthermore, as a ninth aspect, there is provided the plasma display panel set forth in the aforementioned sixth aspect, characterized in that recessed portions are provided on intersections of lattice-shaped ribs of the front substrate or the rear substrate, the intersections corresponding to those of lattice-shaped ribs of the rear substrate.

Furthermore, as a tenth aspect, there is provided the plasma display panel set forth in the aforementioned ninth aspect, characterized in that rib portions other than the recessed portions define at least scan electrodes and sustain electrodes between pixel cells adjacent to each other in the column direction.

Furthermore, as an eleventh aspect, there is provided the plasma display panel set forth in the aforementioned sixth aspect, characterized in that horizontal barrier walls having a thickness of 2 to 50 μm between pixel cells are formed in parallel to bus electrodes.

Furthermore, as a twelfth aspect, there is provided the plasma display panel set forth in the aforementioned eleventh aspect, characterized in that the horizontal barrier wall is formed of a material having a dielectric constant lower than that of the insulating layer.

Furthermore, as a thirteenth aspect, there is provided the plasma display panel set forth in the aforementioned eleventh aspect, characterized in that the horizontal barrier wall is placed only on one of the sustain electrodes or the scan electrodes between pixel cells extending in the longitudinal column direction.

Furthermore, as a fourteenth aspect, there is provided the plasma display panel set forth in the aforementioned eleventh aspect, characterized in that the horizontal barrier walls on the sustain electrode and the scan electrode have different widths.

Furthermore, as a fifteenth aspect, there is provided the plasma display panel set forth in the aforementioned eleventh to fourteenth aspect, characterized in that an extended portion is formed orthogonal to the longitudinal direction of the horizontal barrier wall, and the extended portion is disposed between pixel cells adjacent to each other in the longitudinal row direction.

Furthermore, as a sixteenth aspect, there is provided the plasma display panel set forth in the aforementioned sixth aspect, characterized in that lattice-shaped ribs are formed on the rear substrate, and a rib portion extending in the longitudinal row direction for defining pixel cells is higher than a rib portion extending in the longitudinal column direction for defining pixel cells.

Furthermore, as a seventeenth aspect, there is provided the plasma display panel set forth in the aforementioned eleventh aspect, characterized in that a bus electrode constituting the plane discharge electrode does not overlap the horizontal barrier wall but overlaps the rib.

Furthermore, as an eighteenth aspect, there is provided the plasma display panel set forth in the aforementioned eleventh aspect, characterized in that a bus electrode constituting the plane discharge electrode does not overlap the rib but overlaps the horizontal barrier.

Furthermore, as a nineteenth aspect, there is provided the plasma display panel set forth in the aforementioned eleventh aspect, characterized in that a bus electrode constituting the plane discharge electrode is located so as to overlap the horizontal barrier wall and the rib.

Furthermore, as a twentieth aspect, there is provided the plasma display panel set forth in the aforementioned sixth aspect, characterized in that the bus electrode has a thickness of 10 to 50 μm, and the thickness of the bus electrode causes a raised portion of thickness 2 to 50 μm to be formed on the surface of the insulating layer.

Furthermore, as a twenty-first aspect, there is provided the plasma display panel set forth in the aforementioned first, second, and fifth to twentieth aspect, characterized in that a metal electrode connects between the sustain electrodes.

Furthermore, as a twenty-second aspect, there is provided the plasma display panel set forth in the aforementioned first, second, and fifth to twentieth aspect, characterized in that a transparent electrode connects between the sustain electrodes.

Furthermore, as a twenty-third aspect, there is provided the plasma display panel set forth in the aforementioned first, second, and fifth to twentieth aspect, characterized in that the sustain electrodes are connected to each other to act as an integrated common bus electrode.

Furthermore, as a twenty-fourth aspect, there is provided the plasma display panel set forth in the aforementioned twenty-third aspect, characterized in that resistance of the common bus electrode is ⅓ to 1/12 of that of the scan-side bus electrode.

Furthermore, as a twenty-fifth aspect, there is provided the plasma display panel set forth in the aforementioned twenty-third aspect, characterized in that the bus electrode has a thickness of 10 to 50 μm, and the thickness of the bus electrode causes a raised portion of thickness 2 to 50 μm to be formed on the surface of the insulating layer.

Furthermore, as a twenty-sixth aspect, there is provided the plasma display panel set forth in the aforementioned first, third, and fifth to twentieth aspect, characterized in that a metal electrode connects between the scan electrodes.

Furthermore, as a twenty-seventh aspect, there is provided the plasma display panel set forth in the aforementioned first, third, and fifth to twentieth aspect, characterized in that a transparent electrode connects between the scan electrodes.

Furthermore, as a twenty-eighth aspect, there is provided the plasma display panel set forth in the aforementioned first, third, and fifth to twentieth aspect, characterized in that the scan electrodes are connected to each other to act as an integrated common bus electrode.

Furthermore, as a twenty-ninth aspect, there is provided the plasma display panel set forth in the aforementioned twenty-eighth aspect, characterized in that resistance of the common bus electrode is ⅓ to 1/12 of that of the sustain-side bus electrode.

Furthermore, as a thirtieth aspect, there is provided the plasma display panel set forth in the aforementioned twenty-eighth aspect, characterized in that the bus electrode has a thickness of 10 to 50 μm, and the thickness of the bus electrode causes a raised portion of thickness 2 to 50 μm to be formed on the surface of the insulating layer.

Furthermore, as a thirty-first aspect, there is provided the plasma display panel set forth in the aforementioned first, second, and fifth to twenty-fifth aspect, characterized in that the distance between the neighboring scan electrodes or the neighboring scan-side bus electrodes on vertically neighboring pixel cells is 20 to 200 μm.

Furthermore, as a thirty-second aspect, there is provided the plasma display panel set forth in the aforementioned first, third, fifth to twentieth, and twenty-sixth to thirtieth aspect, characterized in that the distance between the neighboring sustain electrodes or the neighboring sustain-side bus electrodes on vertically neighboring pixel cells is 20 to 200 μm.

Furthermore, as a thirty-third aspect, there is provided the plasma display panel set forth in the aforementioned first and second aspect, characterized in that the scan electrodes of neighboring pixel cells overlap each other being electrically insulated.

Furthermore, as a thirty-fourth aspect, there is provided the plasma display panel set forth in the aforementioned first and third aspect, characterized in that the sustain electrodes of neighboring pixel cells overlap each other being electrically insulated.

Furthermore, as a thirty-fifth aspect, there is provided the plasma display panel set forth in the aforementioned first to third and fifth to thirty-fourth aspect, characterized in that a notched or cut-away end portion of a display electrode portion disposed in the row direction is spaced apart by 20 to 70 μm from a head portion of a rib disposed in the column direction.

Furthermore, as a thirty-sixth aspect, there is provided the plasma display panel set forth in the aforementioned first and second aspect, characterized in that the sustain electrode has a portion, reduced in width, for connecting to the sustain-side bus electrode.

Furthermore, as a thirty-seventh aspect, there is provided the plasma display panel set forth in the aforementioned first to third and fifth to thirty-sixth aspect, characterized in that the plane discharge electrode is constructed so as to allow pixel cells disposed in the longitudinal column direction to have centers of light emission at equal intervals.

Furthermore, as a thirty-eighth aspect, there is provided the plasma display panel set forth in the aforementioned first to third and fifth to thirty-seventh aspect, characterized in that a horizontal black stripe is disposed between plane discharge electrodes or in the row direction including the plane discharge electrode.

Furthermore, as a thirty-ninth aspect, there is provided the plasma display panel set forth in the aforementioned thirty-eighth aspect, characterized in that horizontal black stripes, all having the same width, are disposed at equal intervals in the column direction to be vertically symmetric with each other in each pixel cell.

Furthermore, as a fortieth aspect, there is provided the plasma display panel set forth in the aforementioned thirty-eighth aspect, characterized in that a horizontal black stripe, a horizontal stripe made up of a scan electrode having a black or gray display side, and a horizontal stripe made up of a black or gray common bus electrode have the same width and are disposed at equal intervals in the column direction.

Furthermore, as a forty-first aspect, there is provided the plasma display panel set forth in the aforementioned thirty-eighth aspect, characterized in that scan electrodes and sustain electrodes are formed on the substrate, and horizontal black stripes are formed on the scan electrode and the sustain electrode.

Furthermore, as a forty-second aspect, there is provided the plasma display panel set forth in the aforementioned forty-first aspect, characterized in that a hole or notch is formed on the horizontal black stripe to ensure electrical connection of the scan electrode or the sustain electrode to the bus electrode.

As described above, the plasma display panel according to the present invention can employ the prior-art driving method to improve the intensity, the luminous efficiency, and the voltage margin. In addition, the plasma display panel can reduce unnecessary power consumption on the bus electrode provided on the sustain electrode and the overall percentage of breaks in the sustain electrode to thereby provide improved fabrication yields. Accordingly, the plasma display panel provides great effects of reducing the power consumption of and improving the reliability of the display device employing the plasma display panel and greatly contributing to saving energy.

In addition, the present invention provides electrodes having a shape equivalent to comb-teeth, thereby making it possible to increase the luminous efficiency. Lattice-shaped ribs allow the electrodes between pixel cells to be closely spaced and thereby the effective opening portion of a pixel cell can be increased. This prevents the intensity from being reduced even when the comb-tooth-shaped electrodes are employed to increase the luminous efficiency. Furthermore, the sustain electrodes or the scan electrodes are connected to each other or shared between the pixel cells, thereby making it possible to provide further increased effective opening portion. This in turn makes it possible to provide further improved intensity and luminous efficiency. Furthermore, it is possible to reduce the resistance of electrodes, increase the voltage margin, improve the fabrication yields of the electrodes in the panel, and reduce the power consumption.

BRIEF DESCRIPTION OF THE DRAWINGS

FIG. 6 is a view illustrating an example of drive voltage waveforms and a light emission waveform in a sub-field;

DETAILED DESCRIPTION OF THE PREFERRED EMBODIMENT

Now, a plasma display panel and its fabrication method according to the present invention will be explained below in more detail with reference to the accompanying drawings in accordance with the embodiments.

First Embodiment

Figure 7:
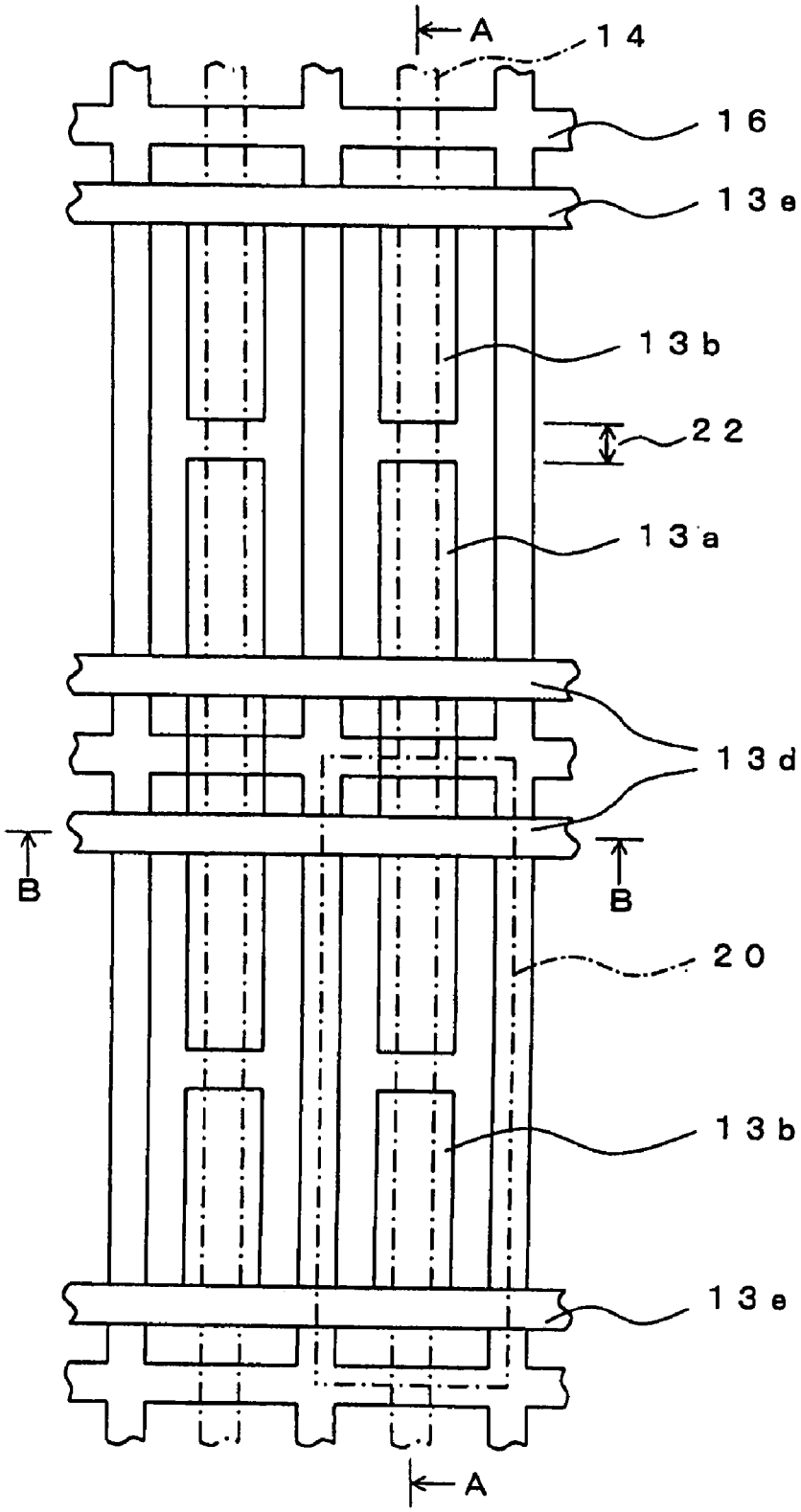
FIG. 7 is a plan view illustrating a plasma display panel according to a first embodiment of the present invention.
Figure 8:
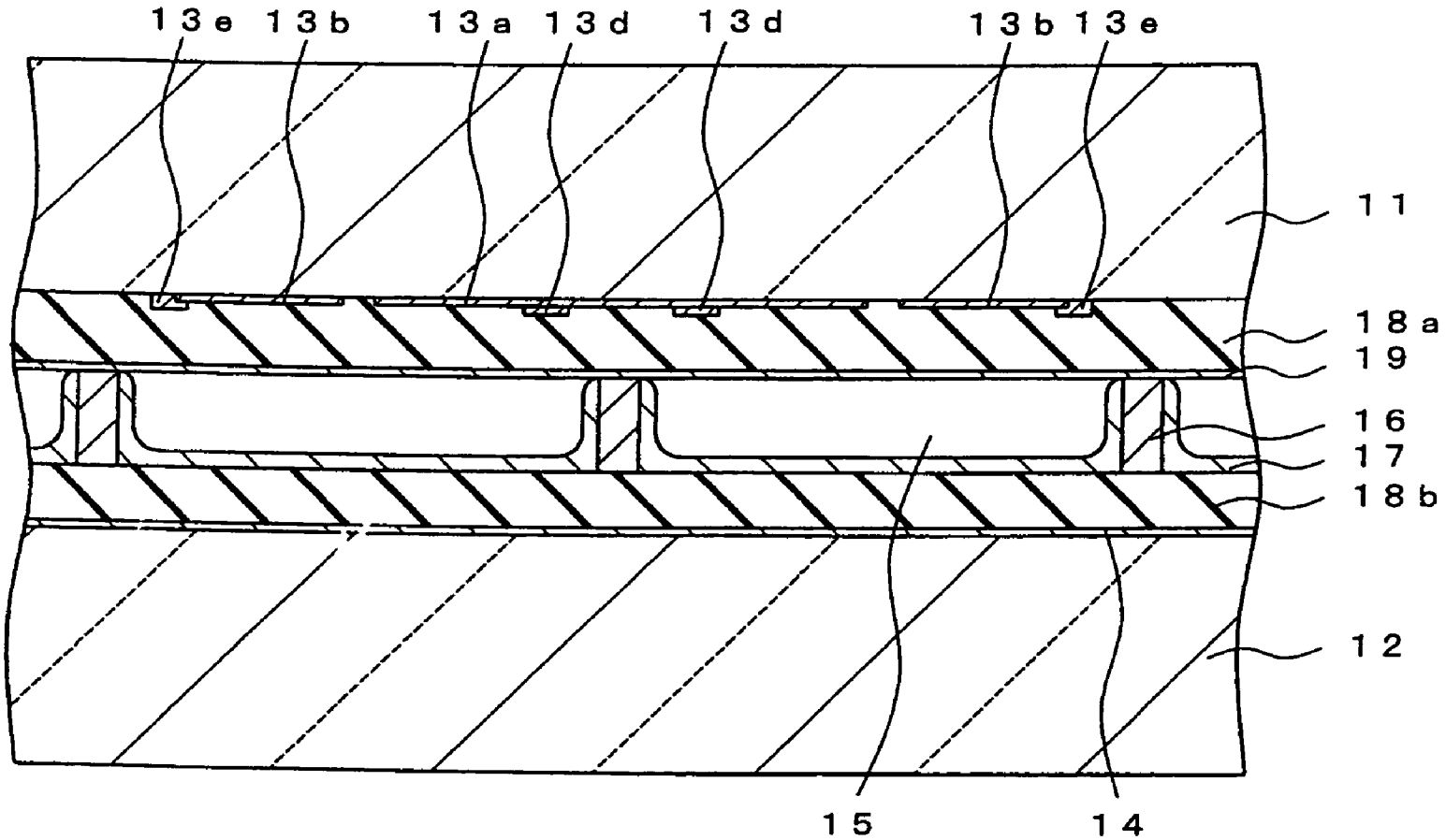
FIG. 8 is a cross-sectional view taken along line A-A of FIG. 7.
Figure 9:
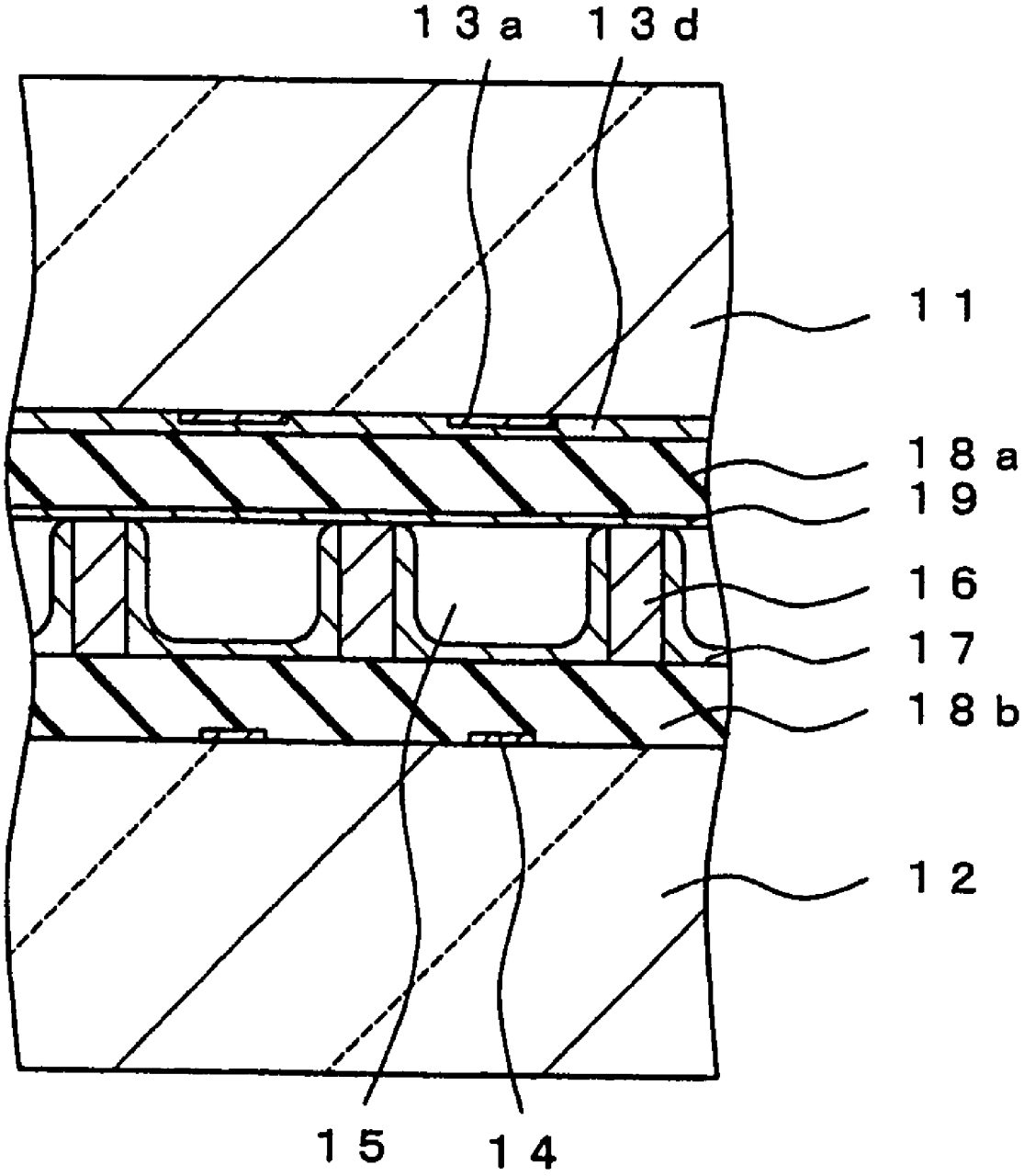
FIG. 9 is a cross-sectional view taken along line B-B of FIG. 7.

FIG. 7 is a plan view illustrating a plasma display panel according to a first embodiment of the present invention, FIG. 8 is a cross-sectional view taken along line A-A of FIG. 7, and FIG. 9 is a cross-sectional view taken along line B-B of FIG. 7. As shown in FIG. 8, the plasma display panel according to this embodiment has first and second insulating substrates 11 and 12 which are to serve as substrates, 3 mm in thickness, and formed of soda glass. On the surface of the first insulating substrate 11 opposite to the second insulating substrate 12 (the surface behind the display surface), there reside sustain electrodes 13*a* and scan electrodes 13*b*, which are rectangular in shape and formed of transparent NESA film or ITO. The sustain-side bus electrodes 13*d* and the scan-side bus electrodes 13*e* are disposed in parallel to each other and formed to extend in the row direction of FIG. 7. The sustain-side bus electrode 13*d* and the scan-side bus electrode 13*e* are in contact with the sustain electrode 13*a* and the scan electrode 13*b*, respectively, and are formed of silver thick film having a thickness of 1 to 9 μm to supply sufficient current to the sustain electrode 13*a* and the scan electrode 13*b*, which have high resistance. The sustain electrode 13*a*, the scan electrode 13*b*, the sustain-side bus electrode 13*d*, and the scan-side bus electrode 13*e* are covered with an insulating layer 18*a* which is formed of thick transparent glaze and has a thickness of 15 to 60 μm, and on top of the insulating layer 18*a*, a protective layer 19 of MgO having a thickness of 1 μm is formed for protecting the insulating layer 18*a* from discharges.

On the surface of the second insulating substrate 12 opposite to the first insulating substrate 11, a plurality of column electrodes 14 of thick silver film, having a thickness of 0.5 to 10 μm, are disposed in parallel to each other so as to extend in the row direction. In addition, an insulating layer 18*b* of thick film having a thickness of 5 to 40 μm is formed so as to cover the column electrode 14 and the inner surface of the second insulating substrate 12. Furthermore, formed on the insulating layer 18*b* are lattice-shaped ribs 16 of thick film having a thickness of 80 to 150 μm to provide discharge gas spaces 15 and define pixel cells 20, and a phosphor 17 is formed to cover the insulating layer 18*b* and the sides of the rib 16 inside the pixel cell 20. The phosphor 17 is formed of $Zn_2SiO_4$:Mn, for converting UV light produced by discharges in the discharge gas into visible light. The first and second insulating substrates 11 and 12, each having the aforementioned respective constituents formed thereon, are disposed in parallel spaced relation to each other to define the discharge gas space 15, which is filled, at a total pressure of 66.5 kPa, with a gas mixture of He and Ne containing 4% of Xe. The lattice-shaped ribs 16 define the pixel cells 20.

In this embodiment, still referring to FIGS. 7 and 8, the scan electrode 13*b* to be powered by the scan-side bus electrode 13*e* extending in the row direction is separated corresponding to each pixel cell 20 and formed in a rectangular shape elongated in the row direction. On the other hand, the sustain electrode 13*a* to be powered by the sustain-side bus electrode 13*d* extending in the row direction is separated from the pixel cells 20 adjacent thereto in the row direction and formed in a rectangular shape elongated in the column direction. The sustain electrode 13*a* and the scan electrode 13*b* do not reside on the column rib 16 between pixel cells 20 adjacent to each other in the row direction but reside at the center of each pixel cell 20 in the row direction. The sustain electrode 13*a*, one in number, is provided in common for pixel cells 20 adjacent to each other in the column direction, and formed across a horizontal rib 16 for defining the pair of pixel cells 20 adjacent to each other in the column direction. Thus, this embodiment is adapted to have the scan-side bus electrodes 13*e* and the sustain electrodes 13*d* in a manner such that the scan, sustain, sustain, scan, scan, sustain, and sustain-side bus electrodes are repeatedly disposed in that order in the column direction. In addition, at the center of each pixel cell 20 in the column direction, the scan electrode 13*b* and the sustain electrode 13*a* are spaced apart from each other by a discharge gap 22. A pair of neighboring sustain-side bus electrodes 13*d*, which are in contact with a common sustain electrode 13*a*, are electrically coupled to each other.

The sustain electrodes 13*a* and the scan electrodes 13*b* form a display electrode portion, while the sustain-side bus electrodes 13*d* and the scan-side bus electrodes 13*e* form a bus electrode portion. In addition, the sustain electrode 13*a* and the sustain-side bus electrode 13*d* are the sustain-side plane discharge electrodes, while the scan electrode 13*b* and the scan-side bus electrode 13*e* are scan-side plane discharge electrodes.

For explanatory purposes, this embodiment employs an exemplary panel which can display a so-called XGA-type window for use in personal computers or the like. A monitor of the XGA type has 768 display units in the vertical direction and 1,024 display units in the horizontal direction. Accordingly, the plasma display panel has 768/2=384 sustain electrodes 13*a* in each column, 768 scan electrodes 13*b* in each column, and 1024×3=3,072 column electrodes 14. The plasma display panel has color pixels arranged in vertical stripes, and color pixels acting as one display unit consist of three primary color pixel cells arranged in three columns. For example, the color pixel cells are arranged at the same 0.6 mm intervals in the vertical and horizontal directions. The ratio of the vertical to the horizontal dimension of the color pixel cell can take on 9:16, thereby making it possible to support a wide window that is frequently used by televisions or the like to display moving pictures. Alternatively, with the vertical and horizontal pitches remaining unchanged, the number of color pixel cells can be changed to support a wide window. For example, vertical color pixel cells may be 768 in number and horizontal color pixel cells may be 1365 in number.

Still referring to FIG. 7, the discharge gap 22 between the scan electrode 13*b* and the sustain electrode 13*a* is 70 μm. And now referring to FIG. 8, scan electrodes 13*b* are spaced 30 μm apart from horizontal ribs. This serves to reduce discharges of low luminous efficiency from plane discharge electrodes near the rib, thereby making it possible to increase the luminous efficiency. A distance of separation, 20 to 70 μm, can provide an effect of increasing the luminous efficiency. A distance of separation less than 20 μm would not provide a distinct effect. Furthermore, a distance of separation 70 μm or more would cause the effect to be saturated and the intensity to be reduced as well. The distance of separation is preferably 30 to 50 μm. The distance between the sustain-side bus electrodes 13*d* for neighboring pixel cells or between the scan-side bus electrodes 13*e* for neighboring pixel cells is 100 μm. Distances 20 μm or less would cause the neighboring electrodes to be easily short-circuited and the electrostatic capacitance between the electrodes to increase. Distances between the electrodes 200 μm or more would cause the electrostatic capacitance to decrease but the area of an effective opening portion to also decrease as describe later, thereby unpreferably resulting in reduction in intensity. Accordingly, the distance between the sustain-side bus electrodes 13*d* for neighboring pixel cells or between the scan-side bus electrodes 13*e* for neighboring pixel cells is preferably 20 to 200 μm, and more preferably 50 to 150 μm in practice for mass production purposes.

For example, the bus electrodes 13*d*, 13*e* have a width of 70 μm. For example, the distance between the bus electrodes of vertically adjacent pixel cells 20 is 70 μm. The end portion of the transparent scan electrode 13*b* and the scan-side bus electrode 13*e* overlap each other, for example, by 40 μm. For example, the pitch of the column electrodes 14 is 0.2 mm.

In the plasma display panel configured as described above, the either side of the rectangular sustain electrode 13*a* and the rectangular scan electrode 13*b* is spaced apart from the rib 16 in the row direction, thereby making it possible to reduce discharges of low luminous efficiency from the plane discharge electrodes near the rib 16 and thus increase the luminous efficiency. That is, since the scan electrode 13*b* and the sustain electrode 13*a* are spaced apart from the ribs 16 adjacent thereto in the row direction, the discharge at portions of low luminous efficiency near the rib 16 is prevented to increase the ratio of light emission from portions of high luminous efficiency, thereby making it possible to increase luminous intensity with respect to the amount of input power.

Furthermore, this embodiment allows the lattice-shaped ribs 16 to block and thereby suppress spurious discharges which occur between the sustain electrodes or the scan electrodes of pixel cells adjacent to each other in the column direction. This makes it possible to place the sustain-side bus electrode 13*d* and the scan-side bus electrode 13*e* in close proximity to the ribs 16 to which the either electrode resides in parallel. A portion within one pixel cell which emits light with high intensity is an opening portion (hereinafter referred to as an effective opening portion) residing between the sustain-side bus electrode 13*d* and the scan-side bus electrode 13*e*. As described above, placing both the sustain-side bus electrode 13*d* formed of Ag and the scan-side bus electrode 13*e* in close proximity to the rib 16 would make it possible to provide an enlarged opening portion for emitting light with high intensity in the pixel cell, thereby allowing the intensity and the luminous efficiency to increase. Accordingly, this can sufficiently compensate for a decrease in intensity caused by the sustain electrode 13*a* and the scan electrode 13*b* formed in a rectangular shape.

In this embodiment, the sustain electrode 13*a* is disposed across pixel cells 20 adjacent to each other in the column direction in orthogonal relation to the rib 16 that is parallel to the sustain-side bus electrode 13*d*. The transparent electrodes cannot be visually recognized and apparently remain unchanged when compared with conventional ones, and make it possible to connect between the sustain electrodes 13*a* of neighboring pixel cells. Thus, two neighboring sustain-side bus electrodes 13*d* are electrically coupled to each other, thereby making it possible to reduce the overall electrode resistance of the two neighboring sustain-side bus electrodes 13*d*, for example, substantially by one-half. This provides a reduction in voltage drop across the sustain-side bus electrode 13*d* and a reduced rate of reduction in the voltage applied to the sustain electrode 13*a* of each pixel cell. This provides a reduction in minimum voltage to be applied from outside during a light emission discharge and reduced spurious erases for discharging pixel cells, thereby providing more stabilized display operation. Incidentally, the maximum voltage remains unchanged which can be applied from outside without causing spurious discharges during a light emission discharge. This makes it possible to provide an increased operational voltage margin or the difference between the aforementioned maximum and minimum voltages. This is hereinafter referred to as an "increase in operational voltage margin".

Thus, it is made possible to set voltages with sufficient allowance with respect to a decrease in the aforementioned maximum voltage and an increase in the aforementioned minimum voltage caused by long-term operation. This allows the longevity of the plasma display panel to increase which is affected by spurious discharges or spurious erases, thereby making it possible to significantly improve the long-term reliability of the display device employing the plasma display panel.

Furthermore, two neighboring sustain-side bus electrodes 13*d* are electrically coupled to each other. Thus, even when one of the sustain-side bus electrodes 13*d* is on the verge of a break, the other neighboring sustain-side bus electrode 13*d* supplies current, thereby making it possible to provide increased yield of fabrication for a break in the electrodes.

Incidentally, the drive waveform according to the first embodiment of the method for driving the plasma display panel of the present invention is the same as that of FIG. 6. This is because the scan electrode 13*b* remains independent at each of the pixel cells disposed orthogonal to the scan electrode, like in the prior-art panel. This makes it possible to employ the prior-art drive method as it is with the effective opening portion of the pixel cell being increased.

Fabrication Method

Figure 1:
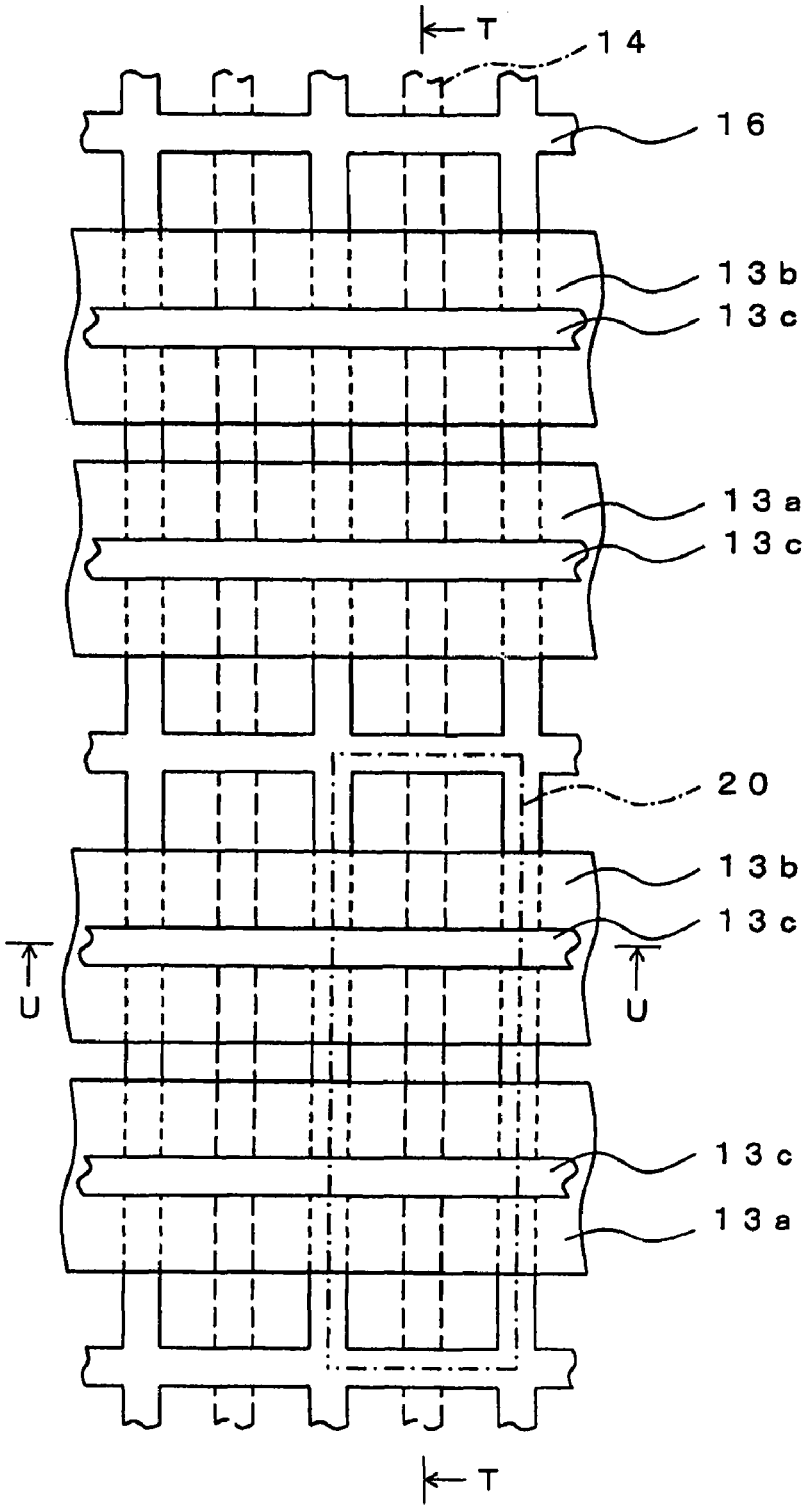
FIG.1 (PRIOR ART)
FIG. 1 is a plan view illustrating the configuration of an AC memory-type plasma display panel.
Figure 2:
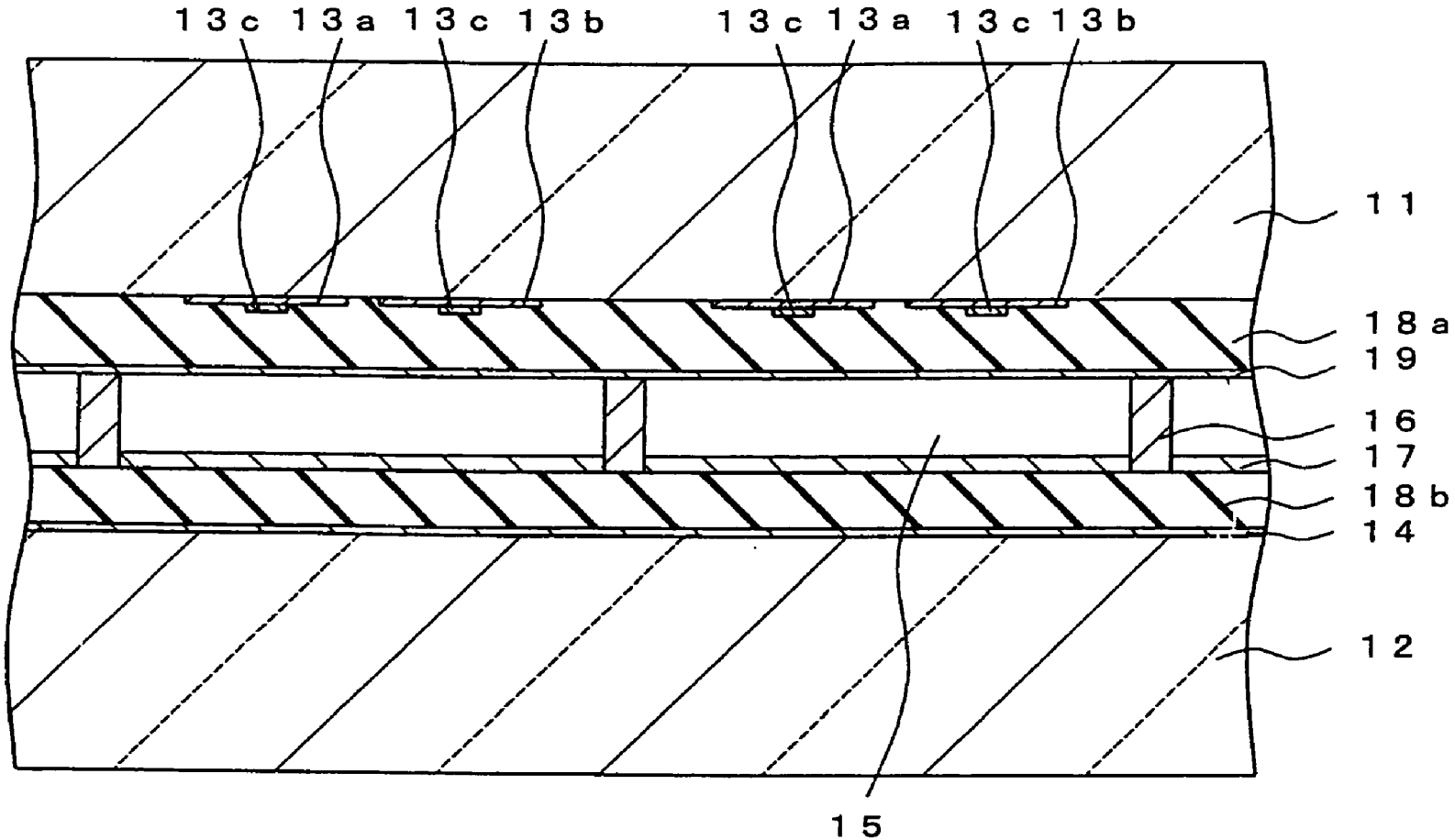
FIG.2 (PRIOR ART)
FIG. 2 is a cross-sectional view taken along line T-T of FIG. 1.
Figure 3:
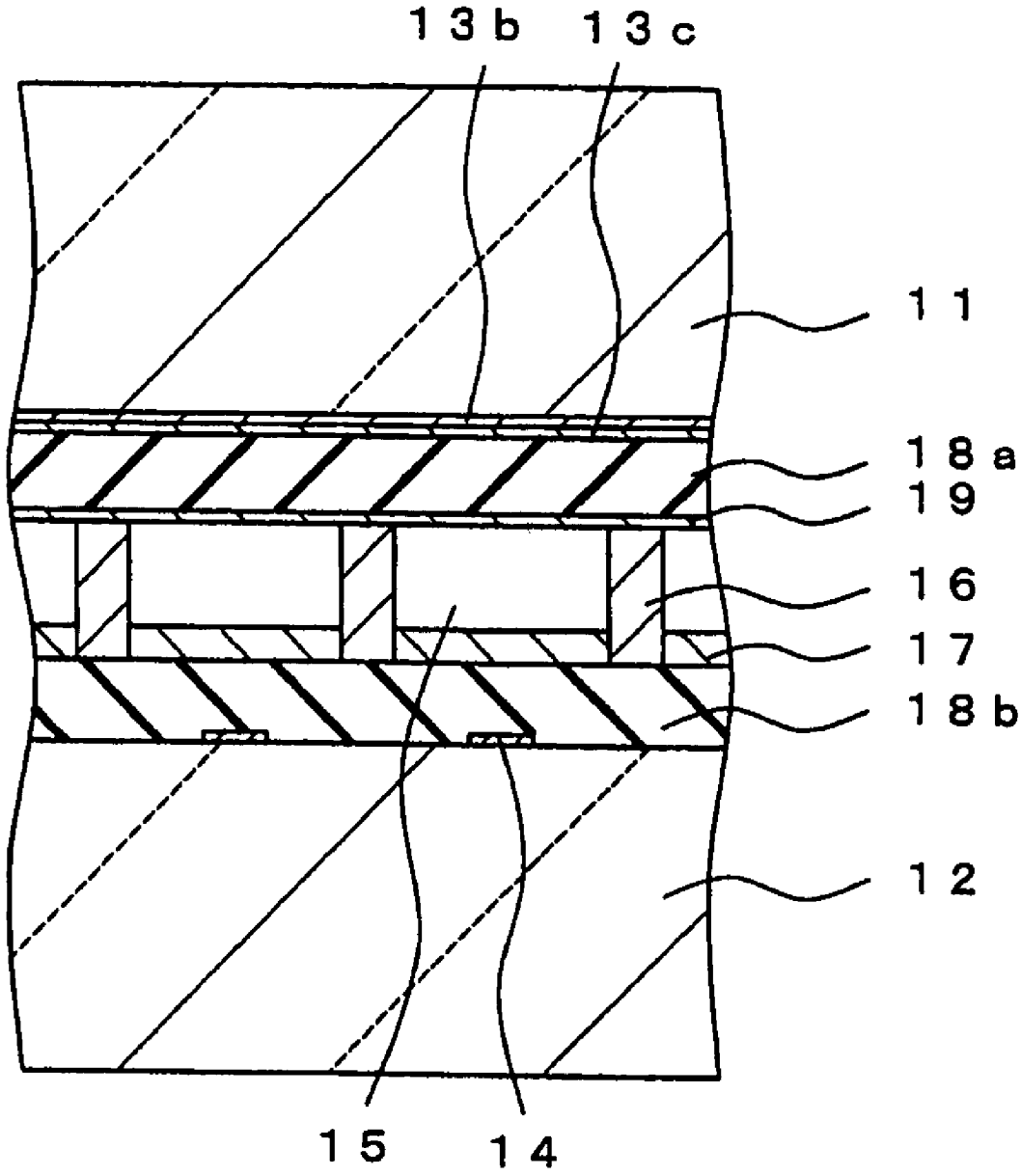
FIG.3 (PRIOR ART)
FIG. 3 is a cross-sectional view taken along line U-U of FIG. 1.
Figure 4:
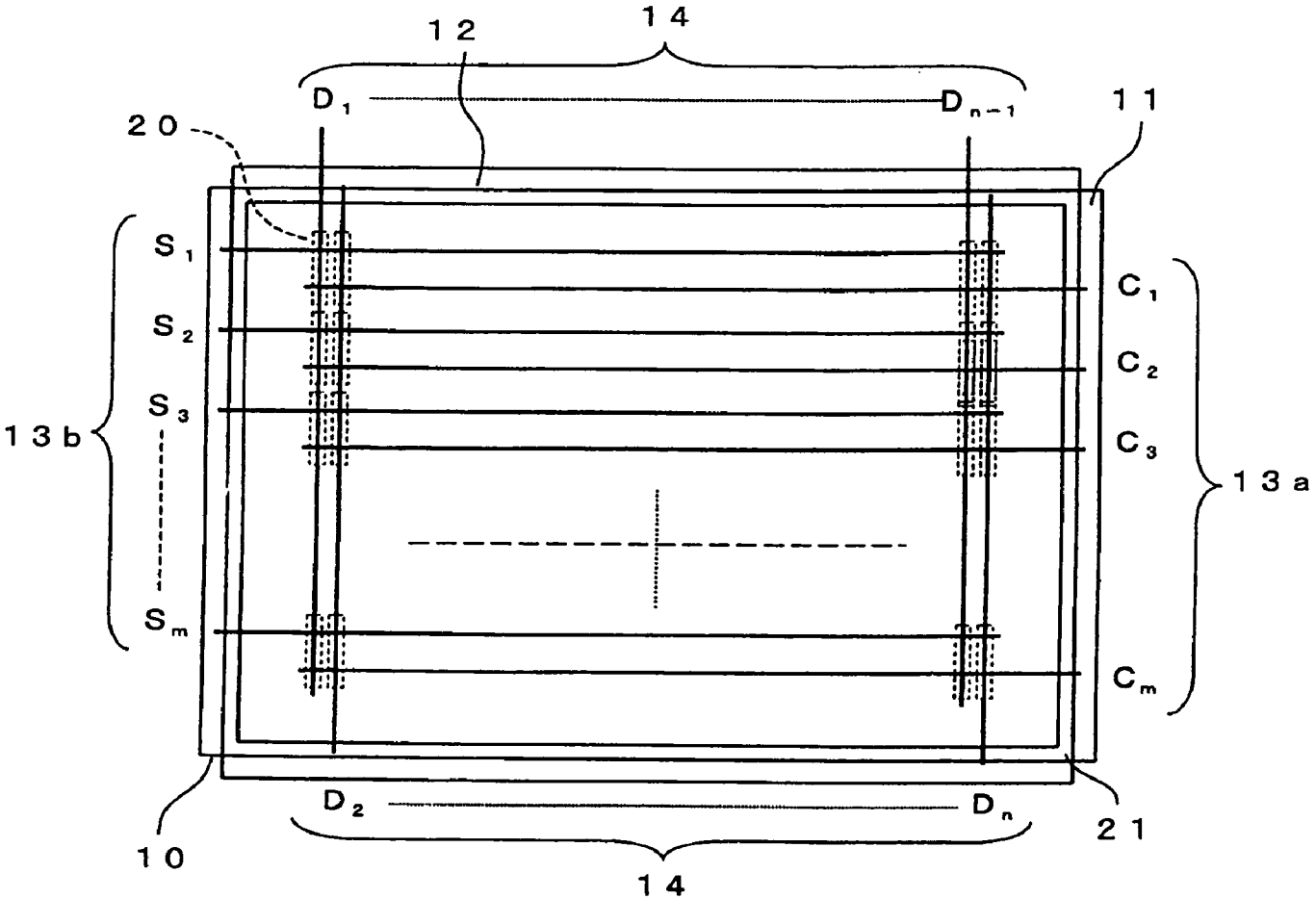
FIG.4 (PRIOR ART)
FIG. 4 is a schematic view illustrating the arrangement of electrodes of a prior-art plasma display panel.
Figure 5:
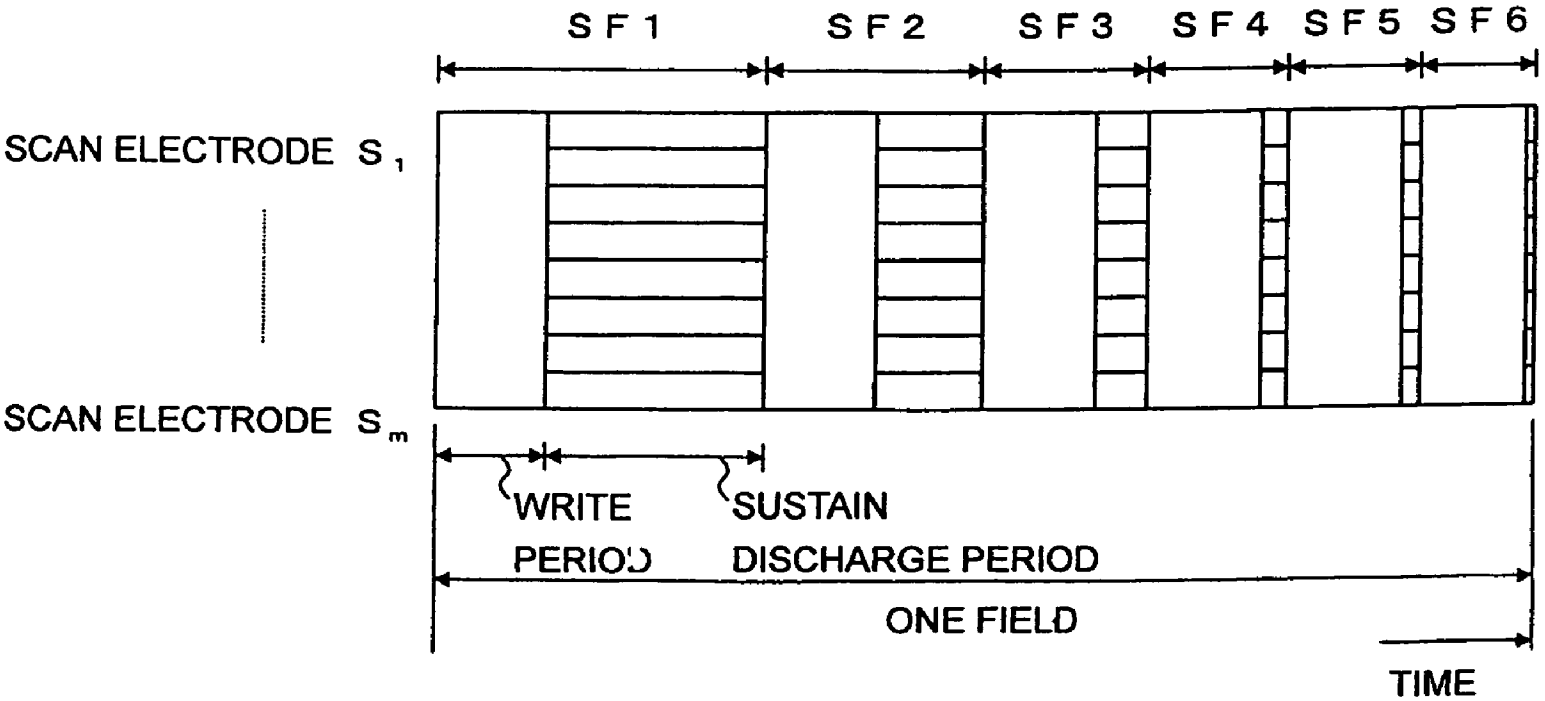
FIG. 5 (PRIOR ART)
FIG. 5 is an explanatory view illustrating the drive sequence in accordance with a sub-field method.

Now, described below is a method for fabricating the aforementioned plasma display panel according to the first embodiment of the present invention. Explained first is a method for encapsulating and evacuating the plasma display panel having the configuration according to the first embodiment shown in FIGS. 7 to 9. In the plasma display panel shown in FIGS. 7 to 9, there exist slight gaps due to projected and recessed portions on the upper surfaces of the ribs 16 and the protective layer 19; however, each of the pixel cells is generally sealed by means of the ribs 16. According to the prior-art method, the first insulating substrate 11 and the second insulating substrate 12 are affixed to each other at the seal portion 21 (see FIG. 4) (which is called the encapsulating step). Then, the plasma display panel is once evacuated to a vacuum through an exhaust hole provided inside the seal portion 21 on the second insulating substrate 12, and then filled with a discharge gas. Thus, by the prior-art method, it would take a considerably long time to evacuate the plasma display panel to a vacuum since each of the pixel cells is almost sealed.

In this regard, to overcome this drawback, this embodiment is adapted to carry out part of the encapsulating step in a vacuum and subsequently a gas is introduced into the plasma display panel. This makes it possible to reduce the considerably long time required by the prior-art method for evacuating the panel to a vacuum. This fabrication method is hereinafter referred to as the vacuum encapsulation.

Figure 14:
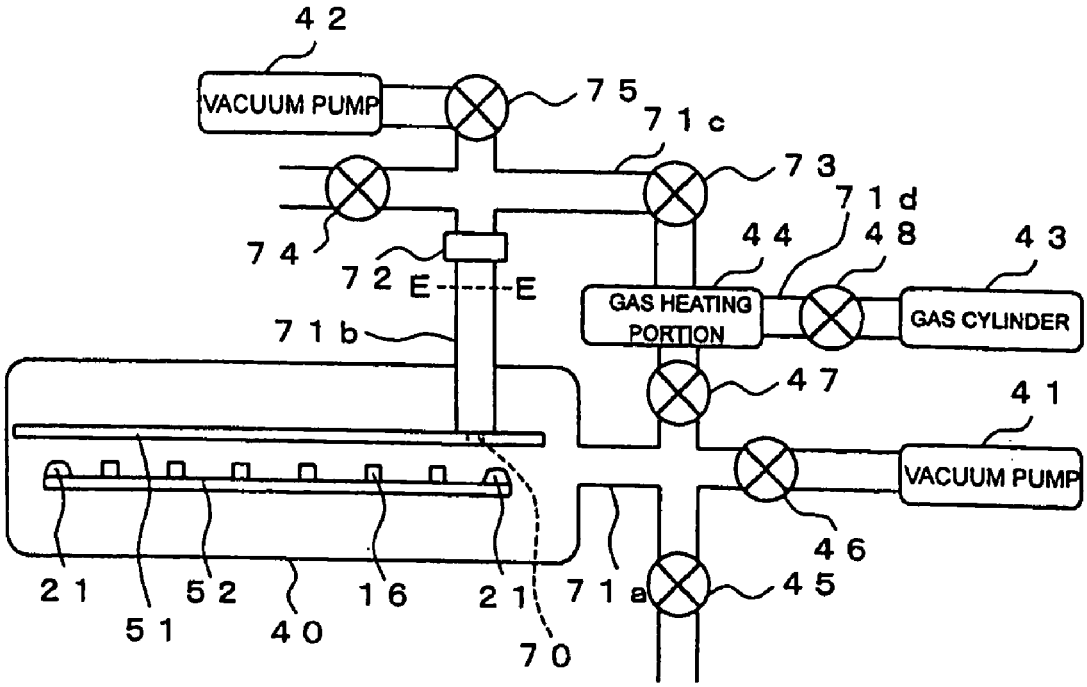
FIG. 14 is a schematic view illustrating a device to be used for the fabrication method according to the present invention.

FIG. 14 is a schematic view illustrating a device to be used for the vacuum encapsulation. Referring to FIG. 14, an encapsulation chamber 40 is adapted to accommodate, evacuate to a vacuum, and introduce a discharge gas into a plasma display panel, being coupled to a vacuum pump 41 via a pipe 71*a*. In addition, a first insulating substrate 51 accommodated in the encapsulation chamber 40 is provided with a hole 70 for exhausting air and introducing a gas, and the hole 70 is coupled to a vacuum pump 42 via a pipe 71*b* that is inserted into the encapsulation chamber 40. The pipe 71*a* is provided with a valve 46, while the pipe 71*b* is provided with a valve 75. In addition, the pipe 71*a* and the pipe 71*b* are coupled to each other via a pipe 71*c*, and the pipe 71*c* is provided with a gas heating portion 44 for heating a gas. There are provided valves 73 and 47 on both sides of the gas heating portion 44, a pipe for connecting between the pipe 71*a* and the outside is provided with a valve 45, and a pipe for connecting between the pipe 71*b* and the outside is provided with the valve 74. A gas cylinder 43 for accommodating a discharge gas is coupled to the gas heating portion 44 via a pipe 71*d*, and the pipe 71*d* is provided with a valve 48. The first insulating substrate 51 is provided with constituent elements such as electrodes and then accommodated in the chamber 40, while a second insulating substrate 52 is provided with electrodes, the ribs 16 and the like, and then accommodated in the chamber 40. The seal portion 21 is placed along the peripheral edge portion of the second insulating substrate 52. Incidentally, the pipe 71*b* can be separated by means of a connecting portion 72.

Now, the vacuum encapsulation process in the fabrication method according to this embodiment is explained step by step.

Step 1: First, the processed first insulating substrate 51 and the processed second insulating substrate 52 are inserted into the encapsulation chamber 40. With this arrangement, the seal portion 21 formed of low-melting glass and having a height 1.5 times as high as that of the rib 16 provides a sufficient gap between the first insulating substrate 51 and the second insulating substrate 52. In addition, at this stage, the insulating substrates 51 and 52 are aligned with each other in advance for the subsequent encapsulation. All the valves 45 to 48 and 73 to 75 are closed. The vacuum pumps 41 and 42 are activated.

Step 2: Then, the valve 46 is once opened to evacuate the chamber 40 and then closed. In addition, the valve 75 is once opened to evacuate the chamber 40 and then closed. This provides a degree of vacuum less than the atmospheric pressure or 10 Pa or greater in the encapsulation chamber 40, preferably a degree of vacuum 1 kPa to 50 kPa. These degrees of vacuum are provided to allow the insulating substrates 51 and 52 to be readily heated in a short period of time by the heat conduction of the gas in the encapsulation chamber.

Step 3: The encapsulation chamber 40 is heated by a heater or the like installed outside or inside the encapsulation chamber 40 to remove moisture or oil present on the insulating substrate 51 or the inner wall of the encapsulation chamber. In this case, the inside of the encapsulation chamber 40 is heated up to about 250 to 360° C. or preferably up to about 300 to 360° C. The heating is to be carried out up to the maximum temperature at which the low-melting glass used for the seal portion 21 is not softened.

Step 4: After the insulating substrates 51 and 52 have been heated up to a desired temperature in step 3, the valve 46 is opened slowly to allow the inside of the encapsulation chamber 40 to be evacuated to a vacuum. The moisture and oil, which have evaporated inside the encapsulation chamber 40, are thereby eliminated. Under this condition, the low-melting glass of the seal portion 21 has not yet been softened, and the first insulating substrate 51 and the second insulating substrate 52 provide a sufficient gap therebetween, thereby making it possible to effectively remove the evaporated moisture and oil.

Step 5: The encapsulation chamber 40 is further heated up to a higher temperature from about 430 to 470° C. This causes the material of the seal portion 21 or the low-melting glass to be softened, thereby allowing the substrates 51 and 52 having been thoroughly evacuated to be bonded together.

Step 6: Now, the temperature of the encapsulation chamber 40 is lowered close to the room temperature. Alternatively, the temperature of the substrates 51 and 52, encapsulated by the heat conduction of a gas, may be lowered. In this case, the valve 46 is closed, the valve 48 is slightly opened once, and the discharge gas is introduced into a gas heating portion 49. Then, after the valve 48 has been closed, the valve 47 is slightly opened, the discharge gas is introduced into the encapsulation chamber 40, and then the valve 47 is closed again. At this time, the pressure of the gas in the encapsulation chamber is about 1 Pa to 1 kPa. Thus, the temperature of the encapsulated substrates 51 and 52 is lowered as the temperature of the encapsulation chamber 40 becomes lowered. Incidentally, just before starting to lower the temperature of the encapsulation chamber 40, the valve 75 is opened to further evacuate the inside of the encapsulated substrates 51 and 52 to a vacuum.

Step 7: The valve 75 is closed when the temperature of the encapsulated substrates 51 and 52 has been lowered close to the room temperature. Then, the valve 48 and the valve 73 are opened to introduce the discharge gas from the gas cylinder 43 into the encapsulated substrates 51 and 52. After the discharge gas has been introduced into the encapsulated substrates 51 and 52, the valve 48 and the valve 73 are closed.

Step 8: The exhaust pipe 71*b* is heated at the portion of line E-E shown in FIG. 14, and the exhaust pipe 71*b* is closed to complete the encapsulated substrates 51 and 52 as a plasma display panel.

Through the steps described above, the plasma display panel, having almost sealed pixel cells, shown in the first embodiment can be easily encapsulated and provided with a discharge gas therein in a short period of time. That is, the present invention allows the first insulating substrate 51 and the second insulating substrate 52 to be evacuated to a vacuum as a whole in the encapsulation chamber 40 and then heated, thereby bonding and affixing the substrates 51 and 52 to each other at the seal portion 21. Then, after the temperature of the substrates 51 and 52 has been lowered in the chamber 40, a discharge gas is introduced therein. Increasing the temperature upon encapsulation causes gases to come out of the surface of the glass substrates 51 and 52 and the material of the seal portion 21. However, since the inside of the encapsulation chamber 40 and the gap between the substrates 51 and 52 have been evacuated to a vacuum upon encapsulation, these emitted gases can be exhausted quickly out of the panel. As described above, gases are thoroughly emitted from the surface of the glass substrates 51 and 52 and the sealing material, and a discharge gas is introduced into between the substrates 51 and 52 via the hole 70 after the temperature of the substrates 51 and 52 has been lowered. For this reason, this prevents the discharge gas from being contaminated and allows the discharge gas to be introduced into between the substrates with high service efficiency.

Second Embodiment

Figure 10:
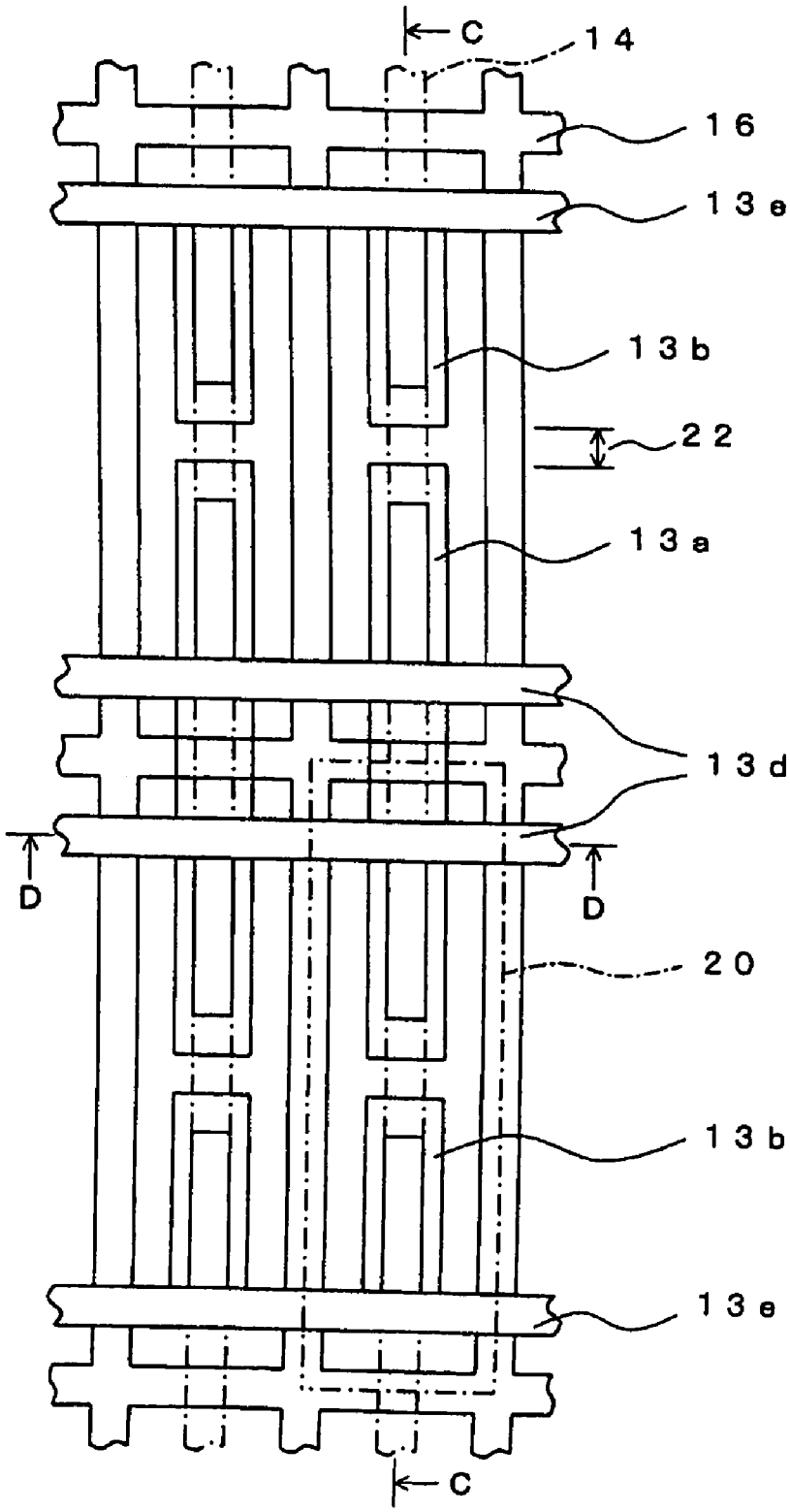
FIG. 10 is a plan view illustrating a plasma display panel according to a second embodiment of the present invention, being different from the first embodiment in employing thin metal wirings for scan and sustain electrodes.
Figure 11:
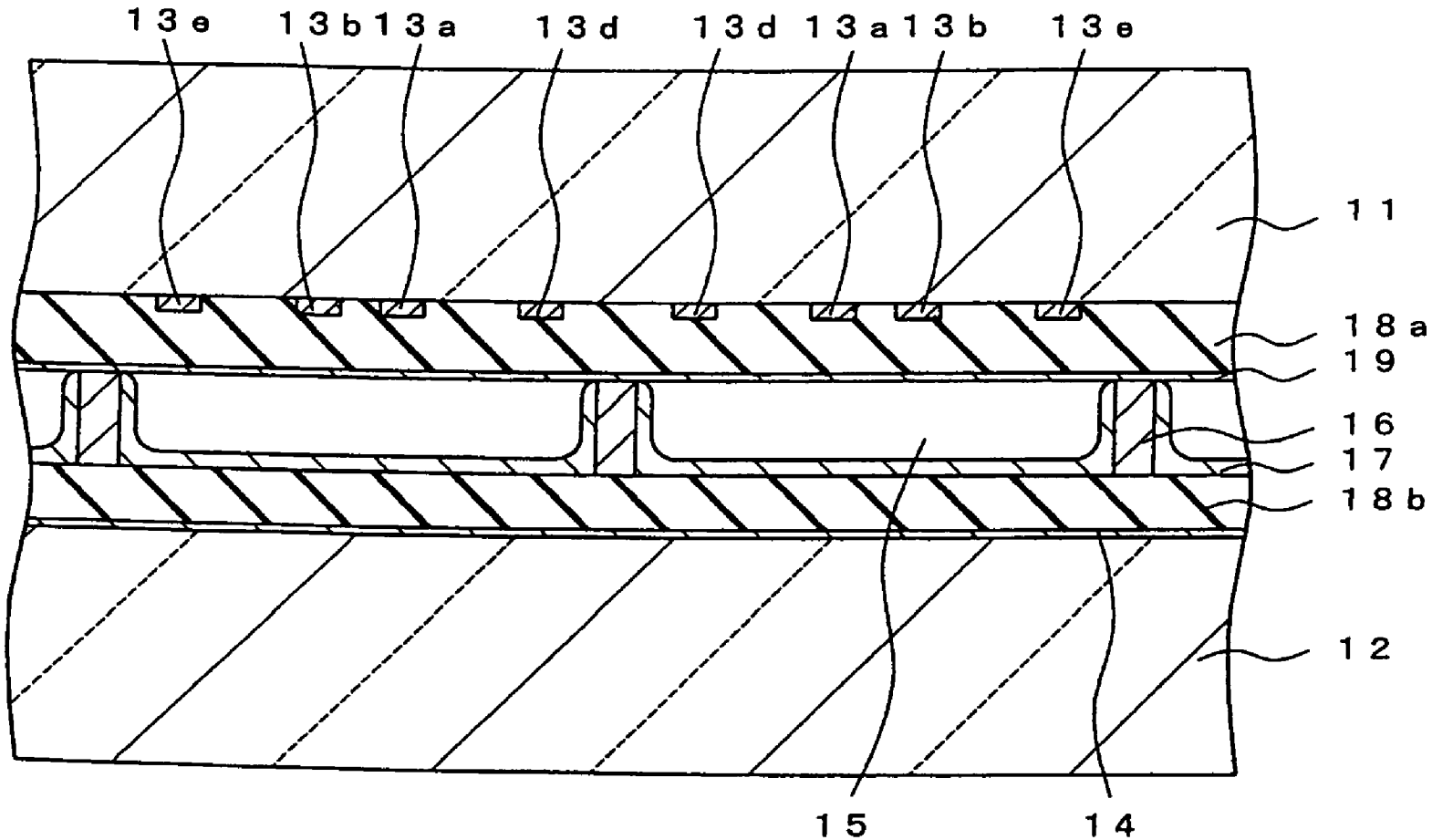
FIG. 11 is a cross-sectional view taken along line C-C of FIG. 10.
Figure 12:
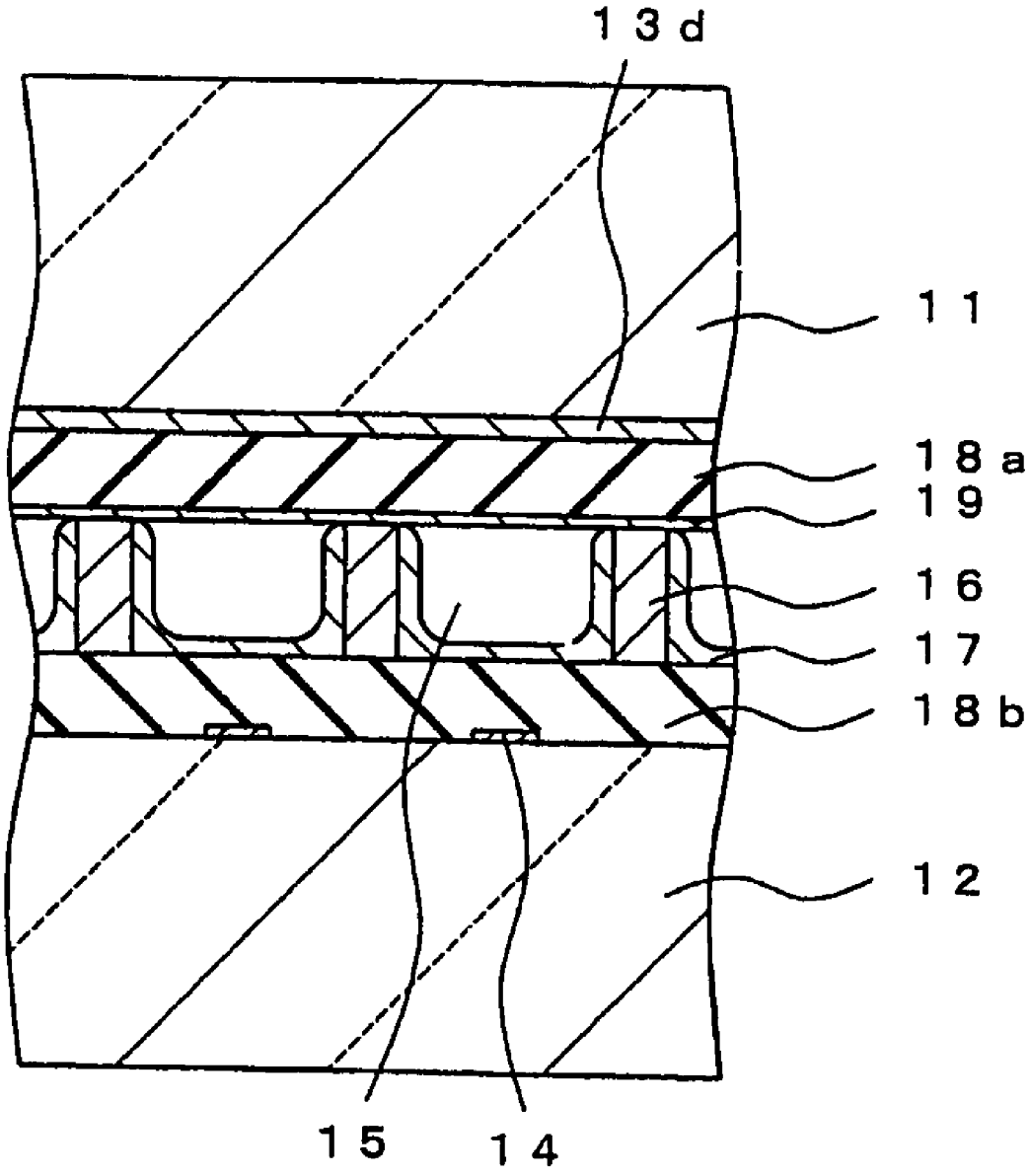
FIG. 12 is a cross-sectional view taken along line D-D of FIG. 10.

Now, a plasma display panel according to a second embodiment of the present invention will be described with reference to FIGS. 10 to 12. In FIGS. 10 to 12, the same components as those of FIGS. 7 to 9 are provided with the same reference symbols and will not be explained in detail again. The first embodiment shown in FIGS. 7 to 9 employs transparent electrodes as the sustain electrode 13*a* and the scan electrode 13*b*. However, the present invention is not limited thereto and can employ not only transparent electrodes but also thin metal electrodes.

FIG. 10 is a plan view illustrating a plasma display panel which employs thin metal wirings as the scan and sustain electrodes instead of the transparent electrodes of the first embodiment according to the first embodiment. FIG. 11 is a cross-sectional view taken along line C-C of FIG. 10 and FIG. 12 is a cross-sectional view taken along line D-D of FIG. 10. In FIGS. 10 to 12, the same components as those of FIGS. 7 to 9 are provided with the same reference symbols and will not be explained in detail again.

As shown in FIGS. 10 to 12, this embodiment employs gate-shaped sustain electrodes 13*a* and scan electrodes 13*b* formed of metal. These electrodes can be formed through the same process as that for the sustain-side bus electrode 13*d* and the scan-side bus electrode 13*e*. These electrodes have a narrow width and therefore do not considerably block light emission. This lessens the need to employ transparent materials and the step of forming transparent electrodes can be omitted by employing metal electrodes as in this embodiment. This in turn makes it possible to reduce costs.

Incidentally, the metal electrode is not limited to the gate-shaped type and can employ various shapes such as a lattice-shaped or T-shaped type. Furthermore, the metal electrode can be formed in a fine mesh shape.

Third Embodiment

Figure 13:
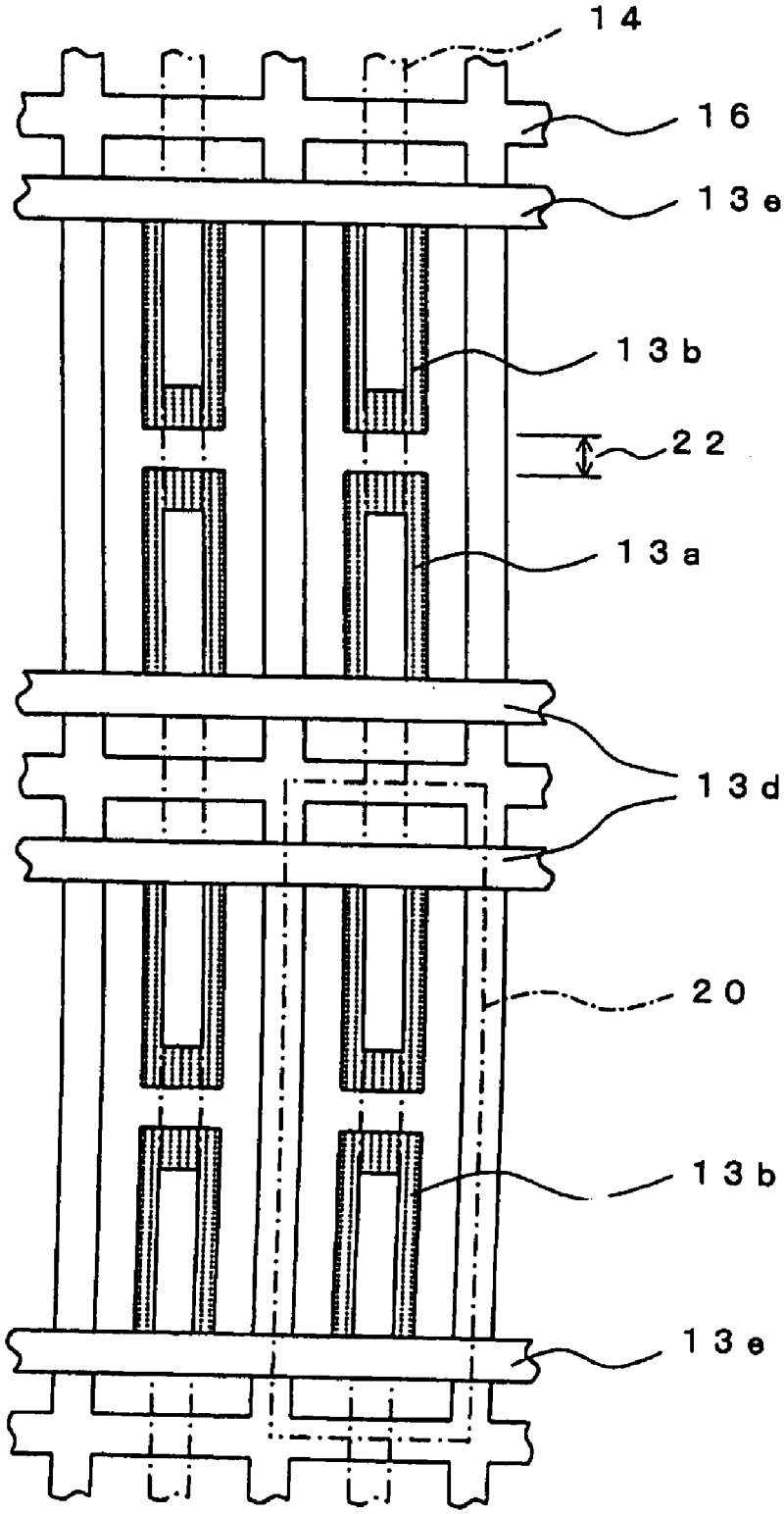
FIG. 13 is a plan view illustrating a plasma display panel according to a third embodiment of the present invention, being different from the first embodiment in employing meshed thin metal wirings for scan and sustain electrodes.

FIG. 13 is a plan view illustrating a third embodiment of the present invention. This embodiment employs meshed metal wirings as the scan and sustain electrodes of the first embodiment. The sustain electrode 13*a* and the scan electrode 13*b* are formed in the shape of mesh.

Fourth Embodiment

Now, a fourth embodiment of the present invention is described below.

Figure 15:
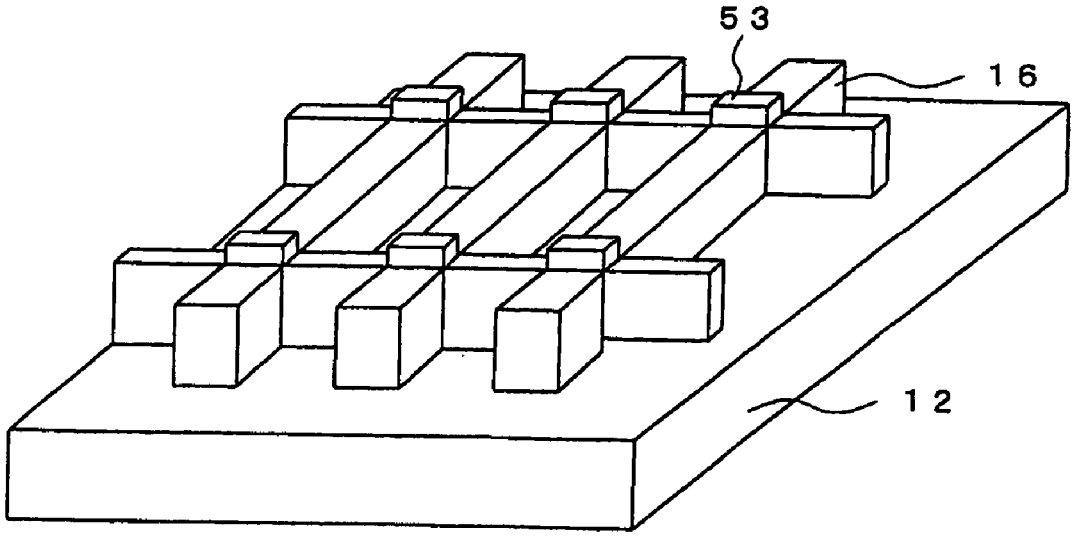
FIG. 15 is a perspective view illustrating a plasma display panel, having a projected at each intersection of the ribs, according to a fourth embodiment of the present invention.

FIG. 15 is a perspective view illustrating a second insulating substrate 12 of a plasma display panel according to a fourth embodiment of the present invention. In this embodiment, lattice-shaped ribs 16 are formed on top of the second insulating substrate 12, and rib projections 53 are formed at the intersection of the ribs 16. After the rib 16 has been formed by the sandblasting method, the screen printing method can be employed to directly print, dry, and bake the rib projection 53. To form the rib projection 53, a photosensitive paste can be printed on top of the ribs by employing the contact printing method other than the screen printing method. Then, the rib projection 53 is patterned, exposed, and developed using photo-masks in order to allow only the rib projection 53 to remain and to be baked. Furthermore, ribs having projected portions can be directly formed using a three-dimensional mold.

The plasma display panel according to the fourth embodiment of the present invention provides a flow path for a gas to be exhausted therethrough to a vacuum, thereby making it possible to perform exhaustion easily by the same encapsulating and exhausting method as the prior-art method. Incidentally, in FIG. 15, for ease of understanding, components other than the ribs 16, the rib projections 53, and the second insulating substrate 12 are not illustrated. It is to be understood that the components other than the ribs 16, the rib projections 53, and the second insulating substrate 12 are the same as those of the first embodiment.

Fifth Embodiment

Figure 16:
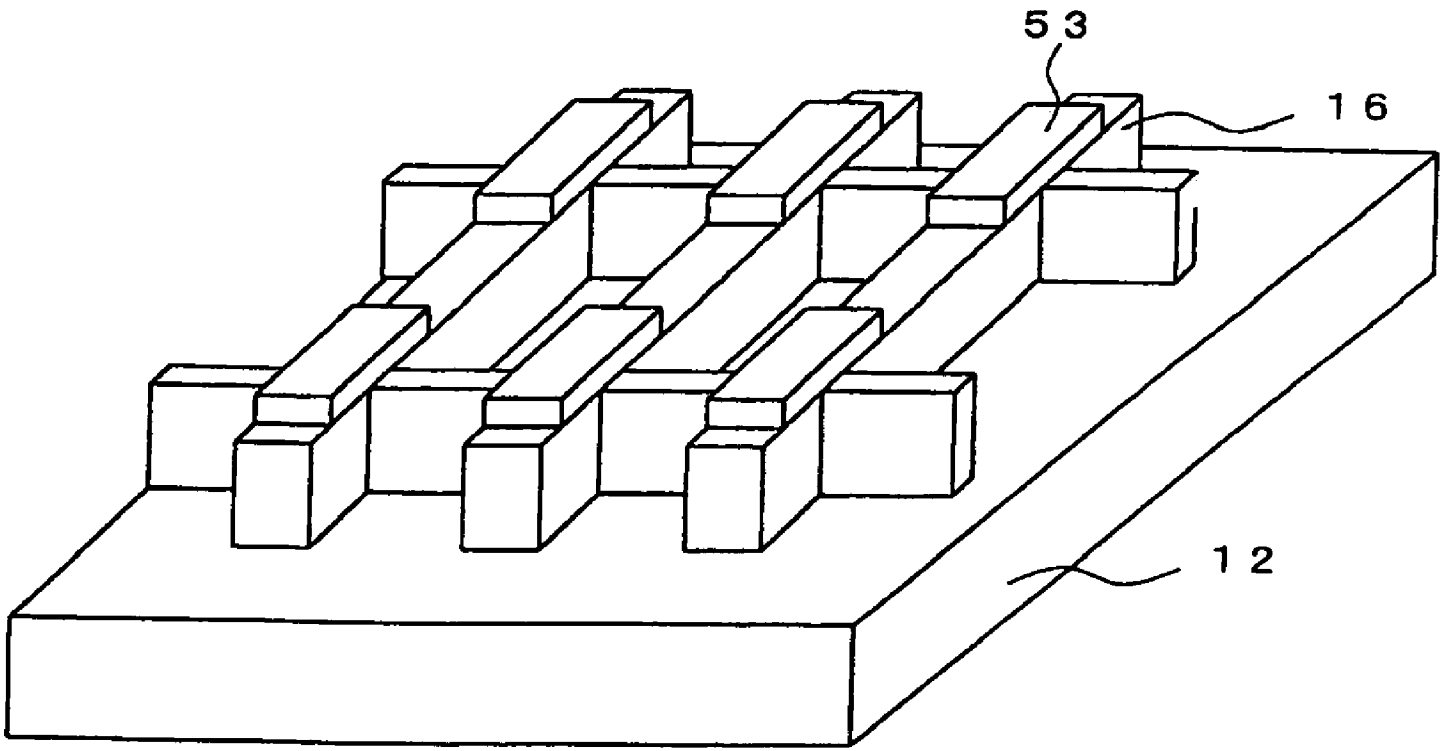
FIG. 16 is a perspective view illustrating a plasma display panel according to a fifth embodiment of the present invention, in which a projection resides at each intersection of the ribs and the electrode portion for connecting between the right and left pixel cells is isolated by the rib projections.
Figure 17:
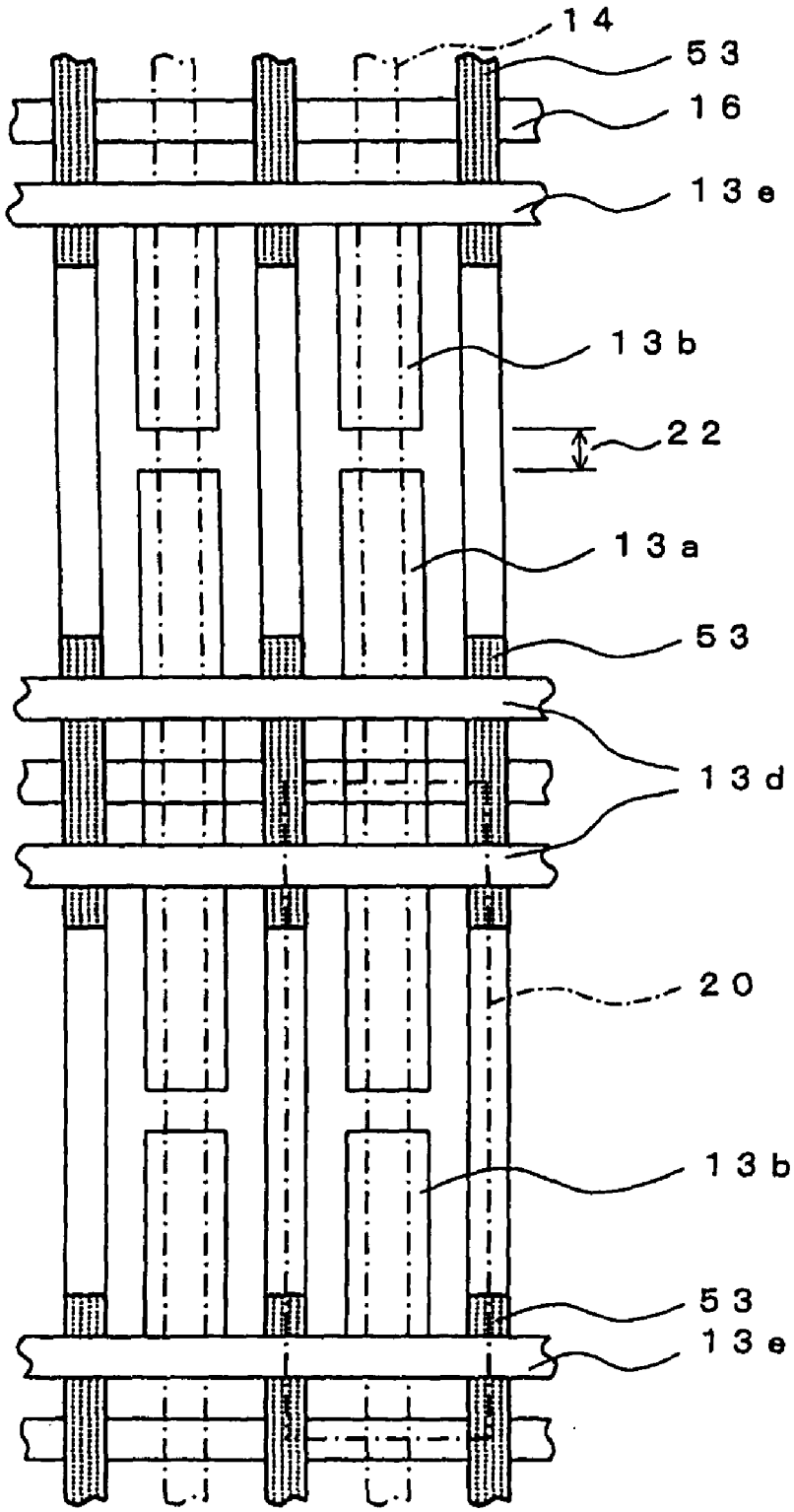
FIG. 17 is a plan view also illustrating the fifth embodiment.

Now, a fifth embodiment of the present invention is described below. FIG. 16 is a perspective view illustrating a second insulating substrate 12 of a plasma display panel according to the fifth embodiment of the present invention. FIG. 17 is a plan view illustrating the plasma display panel according to the fifth embodiment of the present invention. In this embodiment, rib projections 53 are formed to extend in either direction from the intersections of the lattice-shaped ribs 16 in parallel to the direction of the column electrodes. As shown in FIG. 17, this allows the scan-side bus electrode 13*e* and the sustain-side bus electrode 13*d* to be separated from each other between neighboring pixel cells. The method for fabricating the plasma display panel according to this embodiment is the same as that of the fourth embodiment.

Even with projections residing at the intersections of the lattice-shaped ribs, the rib projections 53 allow the scan-side bus electrode 13*e* and the sustain-side bus electrode 13*d* to be separated from each other between neighboring pixel cells, thereby making it possible to prevent spurious light emission caused by currents flowing through the scan-side bus electrode 13*e* and the sustain-side bus electrode 13*d* between the neighboring pixel cells.

Incidentally, the rib projections 53 can be formed not on top of the ribs 16 as shown in FIG. 16 but on top of the insulating layer 18*a* of the first insulating substrate 11. Even in this case, the screen printing method, described in the third embodiment, can be employed to directly form the rib projections 53. Alternatively, such a method can also be employed in which the photosensitive paste, mentioned in the fourth embodiment, is printed by the contact printing method, and then patterned using photo-masks and baked.

Sixth Embodiment

Figure 18:
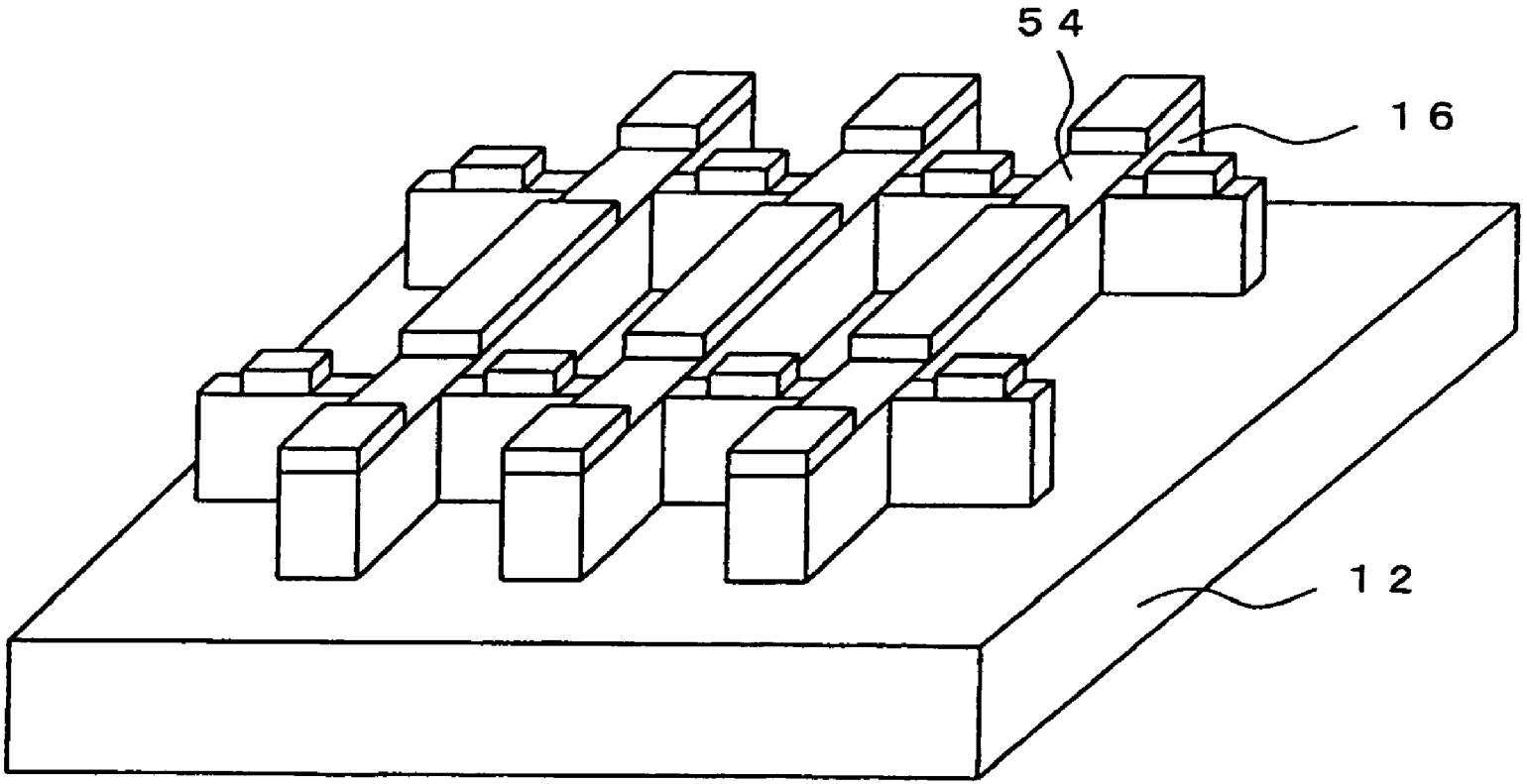
FIG. 18 is a perspective view illustrating a plasma display panel, having a recess at each intersection of the ribs, according to a sixth embodiment of the present invention.

Now, a sixth embodiment of the present invention is described below. FIG. 18 is a perspective view illustrating the configuration of a plasma display panel according to the sixth embodiment of the present invention. In this embodiment, the lattice-shaped rib 16 is formed on top of the second insulating substrate 12, and rib recesses 54 are formed on the intersection of the ribs 16. This provides flow paths for a gas to be exhausted to a vacuum, thereby making it possible to easily perform exhaustion by the same encapsulating and exhausting method as the prior-art method. Incidentally, in FIG. 18, for the sake of simplification of illustration, components other than the ribs 16, the rib recesses 54, and the second insulating substrate 12 are not shown. The components other than the ribs 16, the rib recesses 54, and the second insulating substrate 12 are the same as those of the first embodiment. In addition, it is possible to employ the fabrication methods described in the third and fourth embodiments for this embodiment.

The sixth embodiment provides an effect of facilitating vacuuming upon encapsulation. Furthermore, the central portion of each side of the ribs for defining pixel cells is separated by the ribs 16, thereby making it possible to reduce vertical and horizontal spurious light emission through the gaps communicating between pixel cells.

Seventh Embodiment

Figure 19:
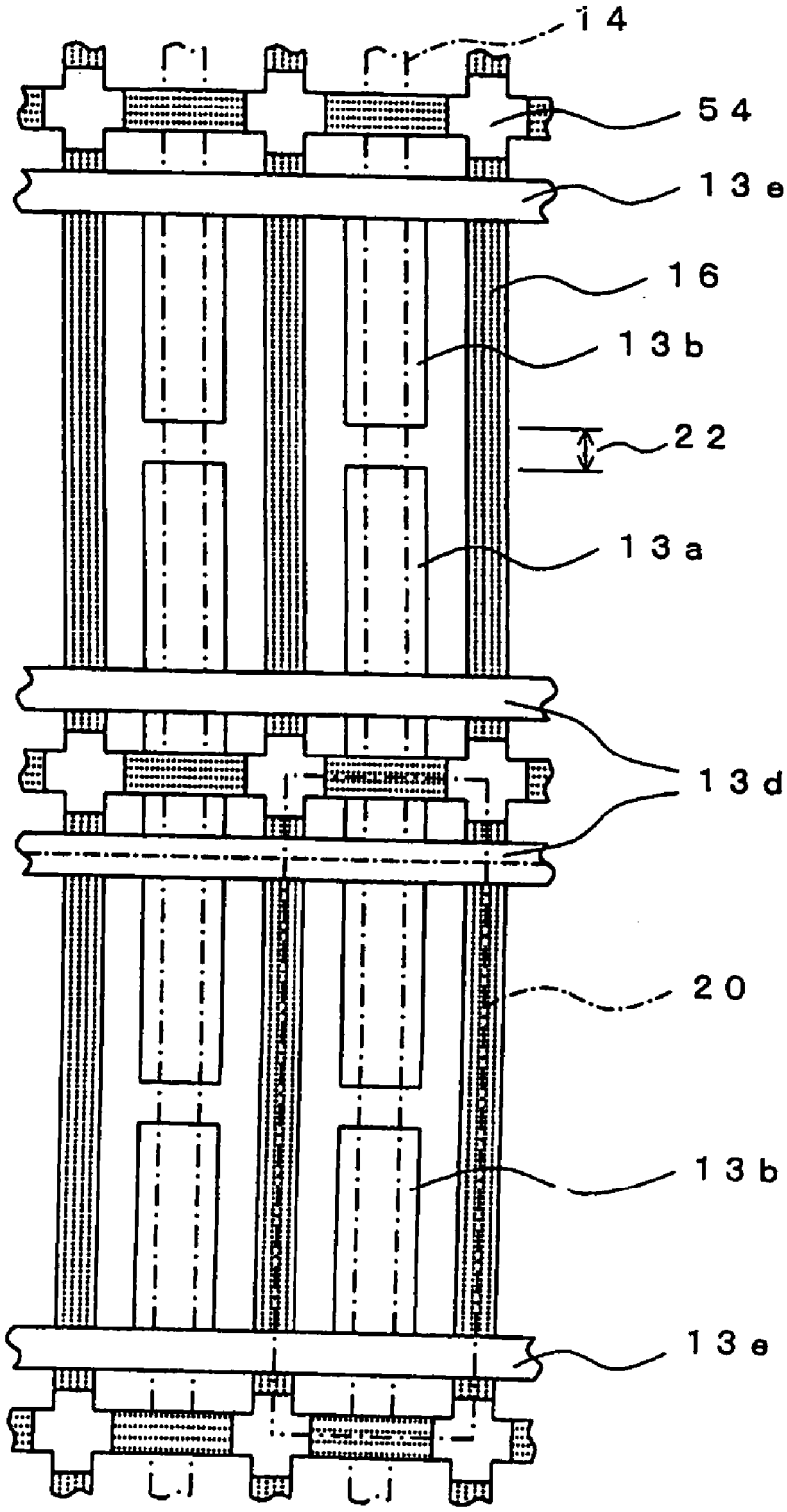
FIG. 19 is a plan view illustrating a plasma display panel according to a seventh embodiment of the present invention in which the scan electrode, the sustain electrode, and the bus electrode of a pixel cell are separated from those of a neighboring pixel cell by the rib portion excluding the recesses residing at the intersections of the lattice rib.

Now, a seventh embodiment according to the present invention is described below. FIG. 19 is a plan view illustrating a plasma display panel according to the seventh embodiment of the present invention. In this embodiment, like the sixth embodiment shown in FIG. 18, the lattice-shaped rib 16 is formed on top of the second insulating substrate 12, and rib recesses 54 are formed on the intersection of the ribs 16. Additionally, in this embodiment, as in the embodiment shown in FIG. 7, there are formed the sustain electrode 13*a*, the scan electrode 13*b*, the sustain-side bus electrode 13*d*, and the scan-side bus electrode 13*e*. This embodiment also has the rib recesses 54 on top of the intersections of the ribs 16 to provide flow paths for a gas to be exhausted to a vacuum, thereby making it possible to easily perform exhaustion by the same encapsulating and exhausting method as the prior-art method. Incidentally, it is possible to fabricate the plasma display panel according to this embodiment in the same manner as that of the third to the sixth embodiments.

Unlike the fifth embodiment, this embodiment allows the scan-side bus electrode 13*e*, the sustain-side bus electrode 13*d*, and the sustain electrode 13*a* to be separated between neighboring pixel cells by the rib portions other than the rib recesses 54 residing on the intersections of the lattice-shaped ribs.

This seventh embodiment provides an effect of facilitating vacuuming upon encapsulation. Furthermore, the central portion of each side of the ribs 16 for defining pixel cells separates the gap between pixel cells, also defining the scan electrode 13*b*, the sustain electrode 13*a*, and the bus electrode 13*c* between neighboring pixel cells. Thus, even with the rib recesses 54 residing on the intersections of the lattice-shaped ribs 16, it is possible to effectively prevent spurious light emission transmitting along the scan electrode 13*b*, the sustain electrode 13*a*, and the bus electrode 13*c* between the neighboring pixel cells.

Eighth Embodiment

Figure 20:
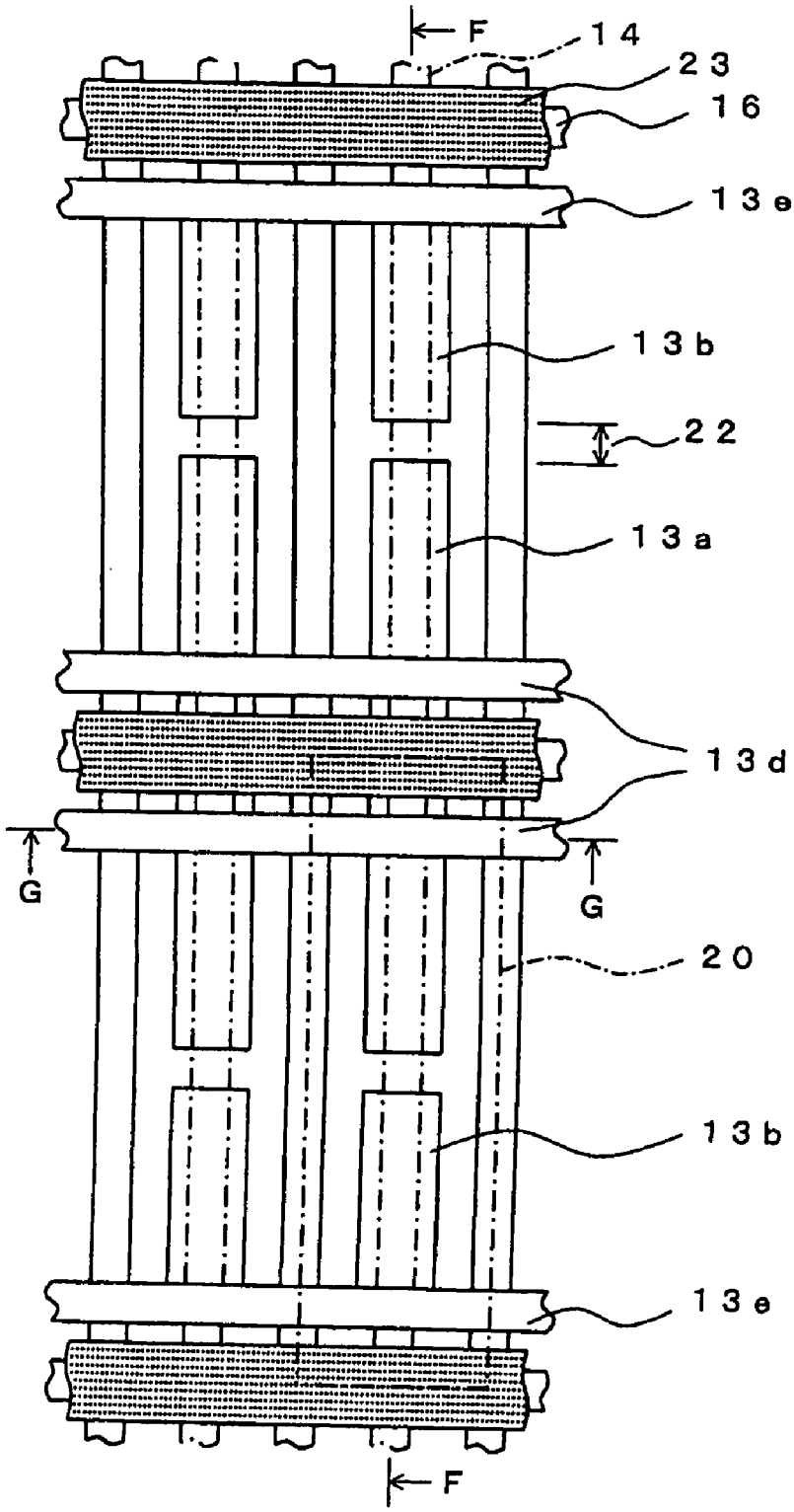
FIG. 20 is a plan view illustrating a plasma display panel, having horizontal barrier walls, according to an eighth embodiment of the present invention.
Figure 21:
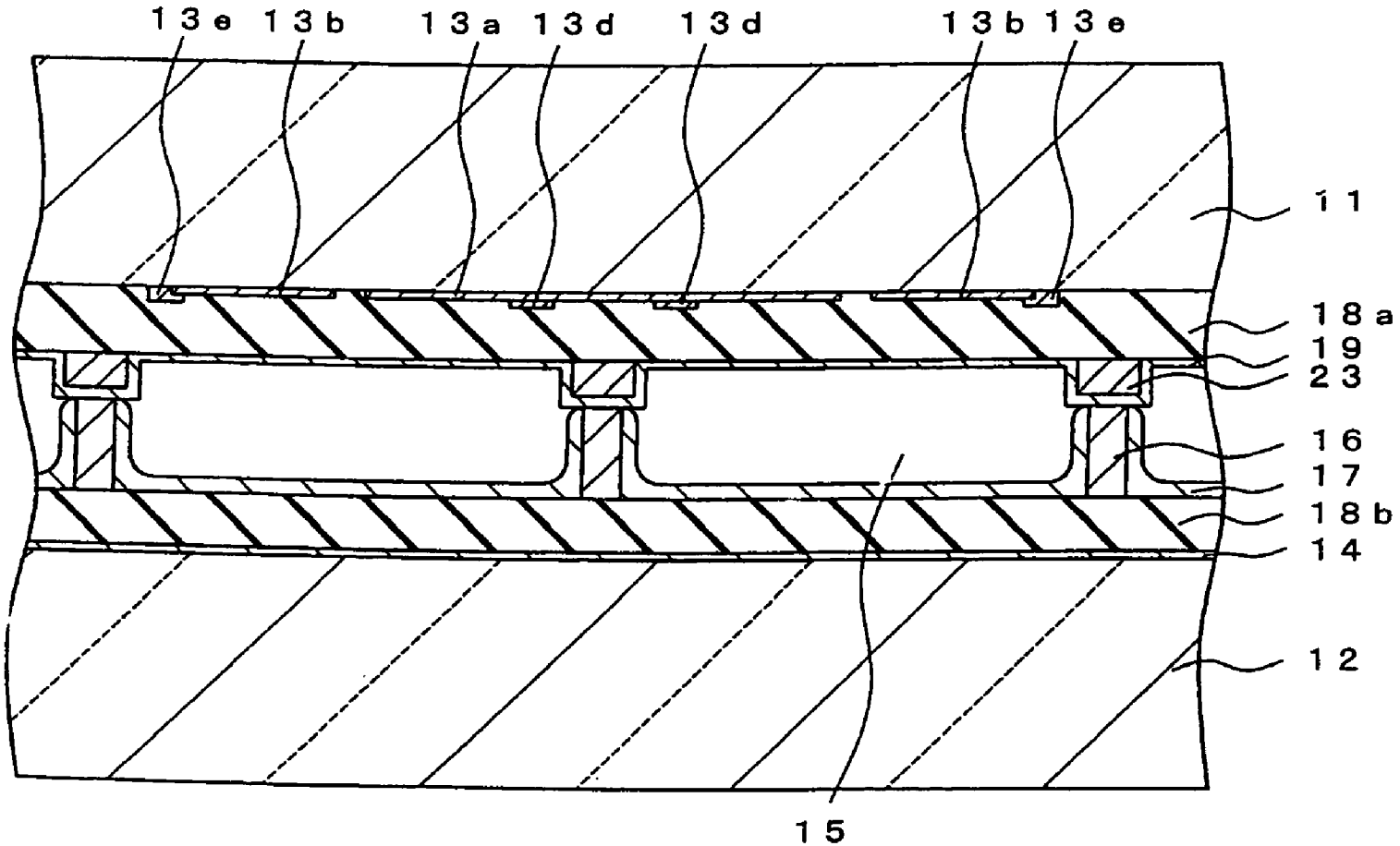
FIG. 21 is a cross-sectional view taken along line F-F of FIG. 20.
Figure 22:
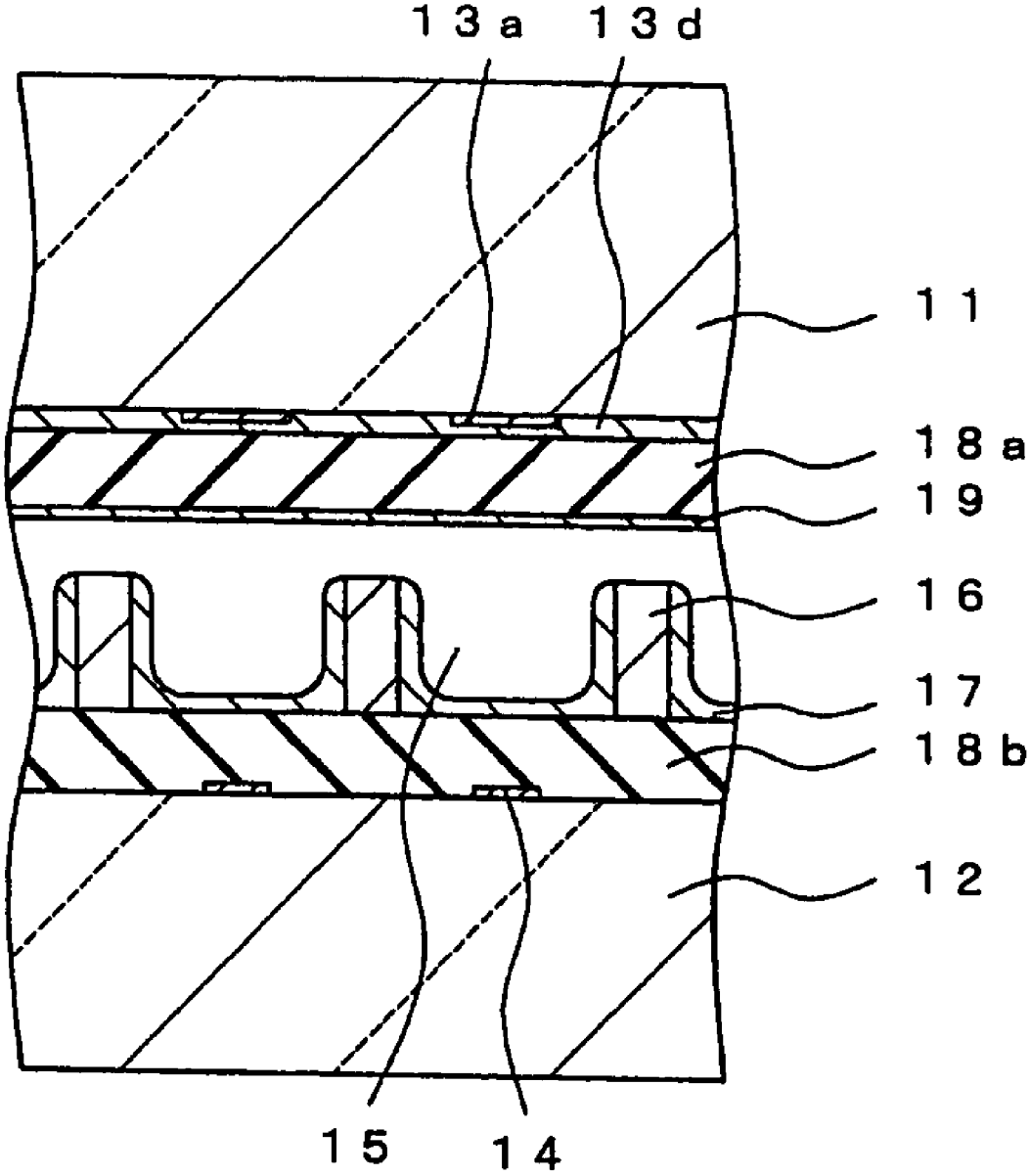
FIG. 22 is a cross-sectional view taken along line G-G of FIG. 20.

Now, an eighth embodiment according to the present invention is described below. FIG. 20 is a plan view illustrating a plasma display panel according to the eighth embodiment of the present invention. FIG. 21 is a cross-sectional view taken along line F-F of FIG. 20 and FIG. 22 is a cross-sectional view taken along line G-G of FIG. 20. The same components of FIGS. 20 to 22 as those of FIGS. 7 to 9 are provided with the same reference symbols and will not be repeatedly explained in detail.

This eighth embodiment is different from the first embodiment in having horizontal barrier walls 23. In this embodiment, the horizontal barrier wall 23 is formed on top of the insulating layer 18*a* of the first insulating substrate 11. The horizontal barrier wall 23 has a height of 2 to 50 μm and desirably 5 to 30 μm. In addition, the horizontal barrier wall 23 is located between the sustain-side bus electrodes 13*d* and between the scan-side bus electrodes 13*e*.

It is possible to form the horizontal barrier wall 23, using a patterned screen, by employing the thick-film printing method to perform pattern printing directly on the insulating layer 18*a* and then by baking the horizontal barrier wall 23. Alternatively, a photosensitive paste can be printed on a plane by contact printing and dried, which is in turn radiated with UV light through masks, exposed, developed, dried, and then baked to form a pattern.

The horizontal barrier wall 23 can be formed of a transparent glass material. Alternatively, to increase contrast, the material may be mixed with a black material (such as cobalt oxide, ruthenium oxide, or iron oxide). Alternatively, to provide efficient reflections of light emitted from pixel cells, titanium oxide, zirconium oxide, alumina, silicon oxide, or the like) may be mixed with the material to form a white material. Alternatively, the display side (on the side of the first insulating substrate 11) may be formed in black to provide increased contrast, whereas the pixel interior side may be formed in white to provide effective reflections of light generated inside pixel cells.

The horizontal barrier wall 23 provides an exhaustion path in the longitudinal direction of the scan-side bus electrode 13*e*. This makes it possible, without using the vacuum encapsulation described with reference to FIG. 14, to affix the first and second insulating substrates to each other, on each of which structures have been formed in an atmospheric environment in the same manner as that of the prior art, and then perform the evacuation of and introduction of a gas into the plasma display panel.

To eliminate unnecessary power consumption required for charging or discharging electrostatic capacitance by pulse voltages applied upon driving the plasma display panel, it is desirable that the electrostatic capacitance should be small between the scan-side bus electrodes 13*e* in neighboring pixel cells and between the sustain-side bus electrode 13*d*, the scan-side bus electrode 13*e*, and the column electrode 14. In this context, the material of the horizontal barrier wall 23 has desirably a low dielectric constant. It is possible to employ a zinc-oxide-based glass material (having a dielectric constant of about 8) instead of a lead-glass-based insulating material (having a dielectric constant of about 13) to reduce the dielectric constant, thereby reducing the power consumption of the plasma display panel.

The horizontal barrier wall 23 provides an exhaustion path in the longitudinal direction of the scan-side bus electrode 13*e*. This makes it possible, without using the vacuum encapsulation described with reference to FIG. 14, to affix the first and second insulating substrates to each other, on each of which structures have been formed in an atmospheric environment in the same manner as that of the prior art, and then perform the evacuation of and introduction of a gas into the plasma display panel.

Furthermore, the reduction in dielectric constant of the horizontal barrier wall 23 results in a reduction in electrostatic capacitance between electrodes, thereby making it possible to prevent an increase in ineffective power consumption.

Ninth Embodiment

Figure 23:
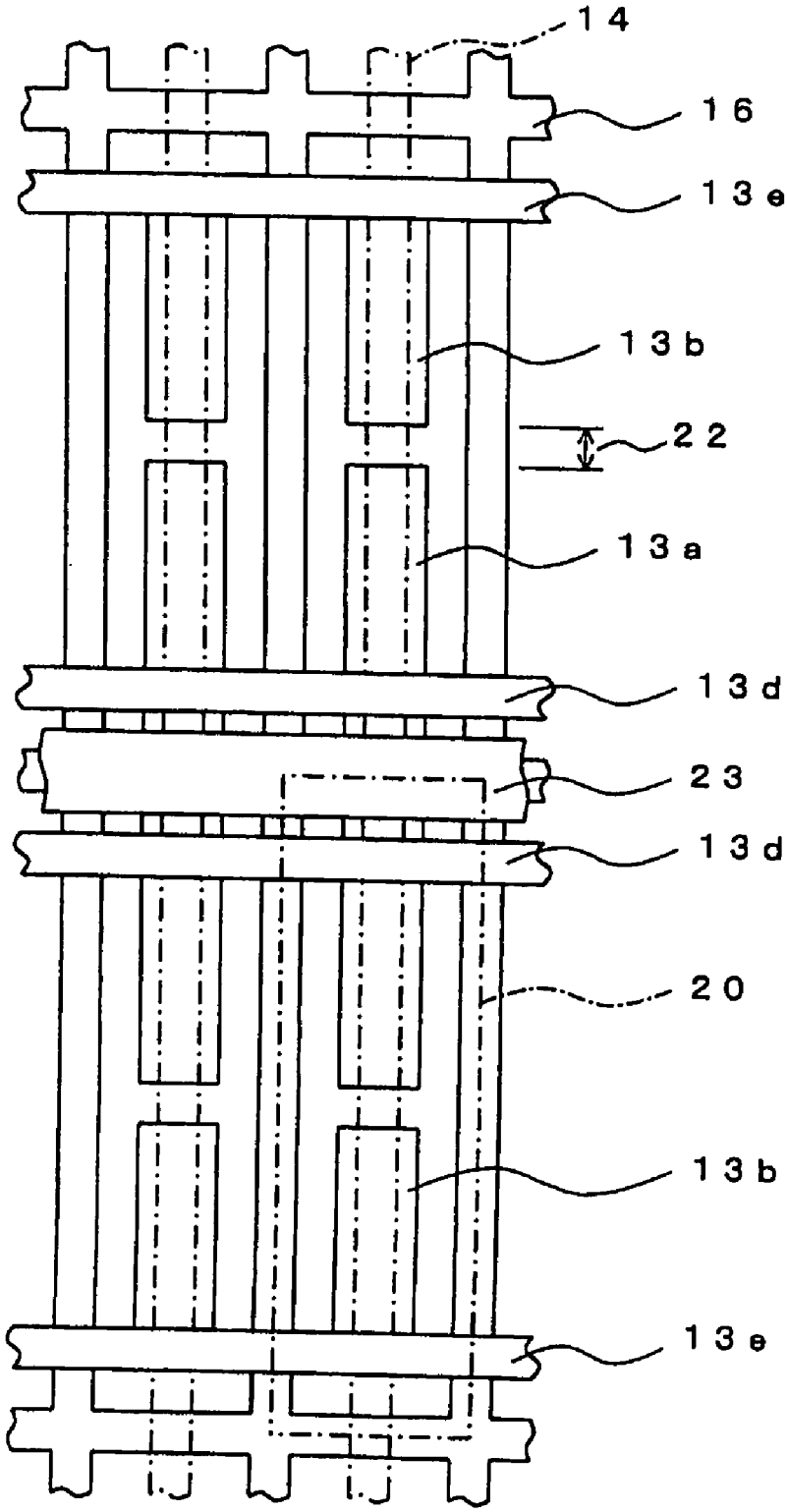
FIG. 23 is a plan view illustrating a plasma display panel according to a ninth embodiment of the present invention in which a horizontal barrier wall is disposed only in between neighboring sustain electrodes or neighboring scan electrodes.

Now, a ninth embodiment according to the present invention is described below. FIG. 23 is a plan view illustrating a plasma display panel according to the ninth embodiment of the present invention. As can be seen from FIG. 23, this embodiment provides the horizontal barrier wall 23 only between the sustain-side bus electrodes 13*d*. Spurious discharges often occur along the sustain electrode 13*a* connecting between vertical pixel cells 20. Thus, the horizontal barrier wall 23 provided between sustain-side bus electrodes 13*d* as in this embodiment obviates the need to always separate the scan-side bus electrodes 13*e* from each other by the horizontal barrier wall 23. The plasma display panel according to this embodiment can be fabricated by the same method as that of the eighth embodiment. The configuration according to this embodiment can increase the exhaustion path in size, thereby reducing the time required for exhaustion.

Tenth Embodiment

Figure 24:
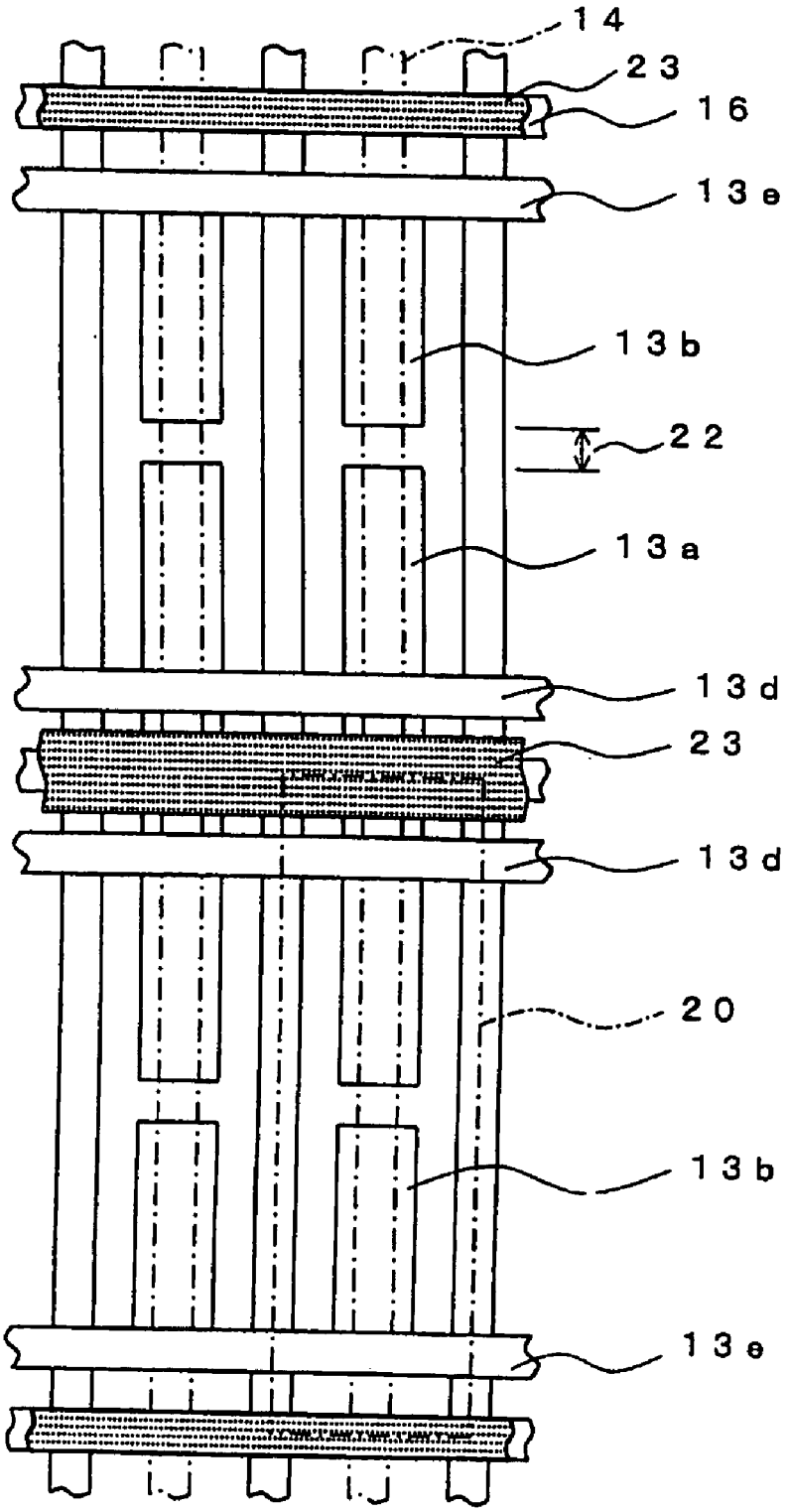
FIG. 24 is a plan view illustrating a plasma display panel according to a tenth embodiment of the present invention in which a horizontal barrier wall disposed in between sustain electrodes is different in width from one disposed in between scan electrodes.

Now, a tenth embodiment according to the present invention is explained below. FIG. 24 is a plan view illustrating a plasma display panel according to the tenth embodiment of the present invention. As can be seen from FIG. 24, in this embodiment, the horizontal barrier wall 23 between scan-side bus electrodes 13*e* has a width narrower than that of the horizontal barrier wall 23 between sustain-side bus electrodes 13*d*. This makes the exhaustion path larger than that of the eighth embodiment shown in FIG. 20, thereby reducing the time required for exhaustion. Incidentally, the same fabrication method as that of the eighth embodiment can be applied to this embodiment.

Eleventh Embodiment

Figure 25:
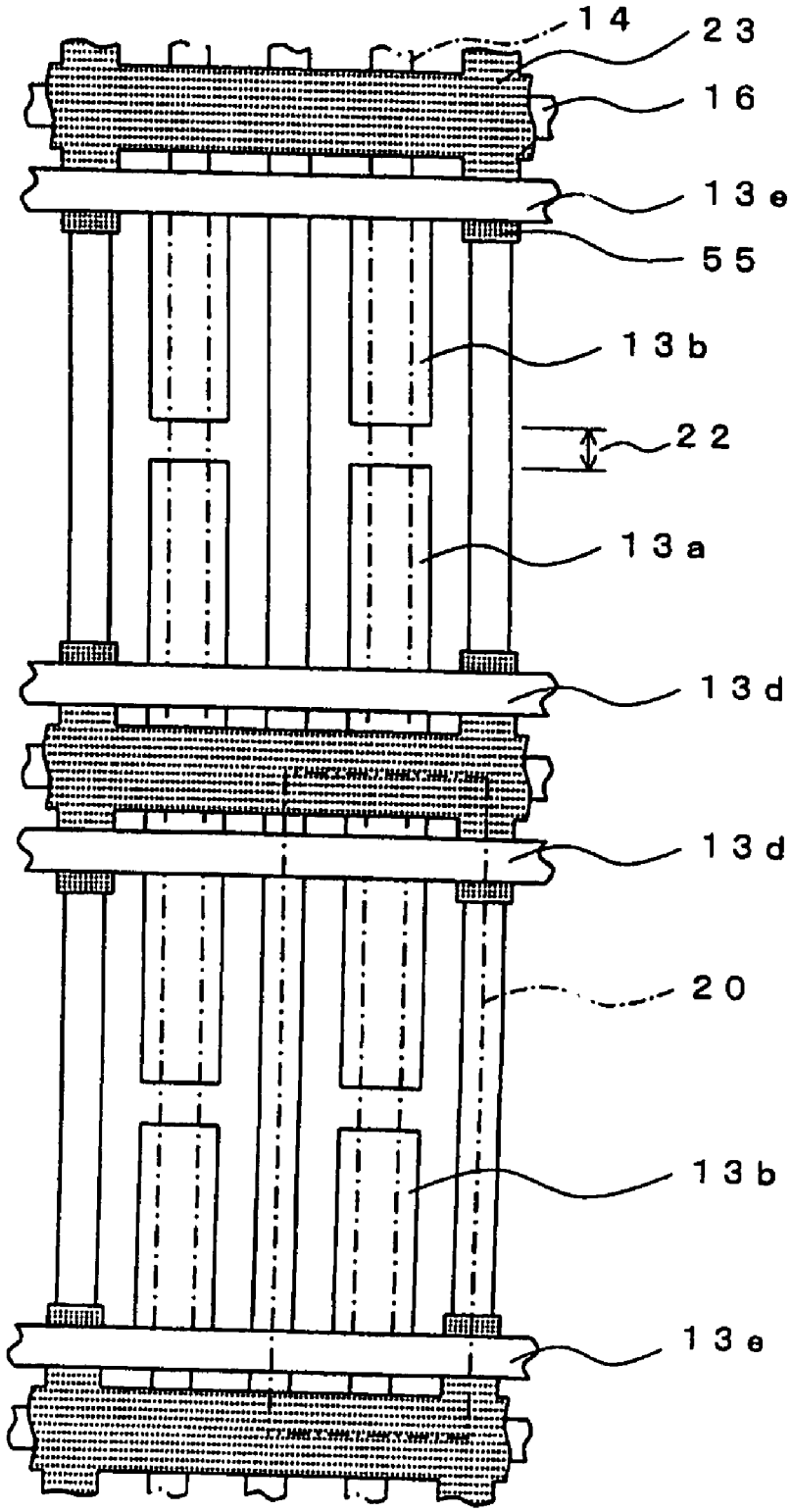
FIG. 25 is a plan view illustrating a plasma display panel according to an eleventh embodiment of the present invention.

Now, an eleventh embodiment according to the present invention is described below. FIG. 25 is a plan view illustrating a plasma display panel according to the eleventh embodiment of the present invention. As can be seen from FIG. 25, in this embodiment, the horizontal barrier wall 23 is provided with extensions 55 perpendicular to the longitudinal direction of the horizontal barrier wall 23, and disposed between pixel cells 20 across the sustain-side bus electrodes 13*d* and across the scan-side bus electrodes 13*e*. This allows the horizontal barrier wall 23 to provide an exhaustion path to reduce the time required for exhaustion. Moreover, this allows the extension 55 to effectively prevent spurious light emission transmitting along the sustain-side bus electrode 13*d* and the scan-side bus electrode 13*e* between neighboring pixel cells 20. Incidentally, the same fabrication method as that of the eighth embodiment can be applied to this embodiment.

Twelfth Embodiment

Figure 26:
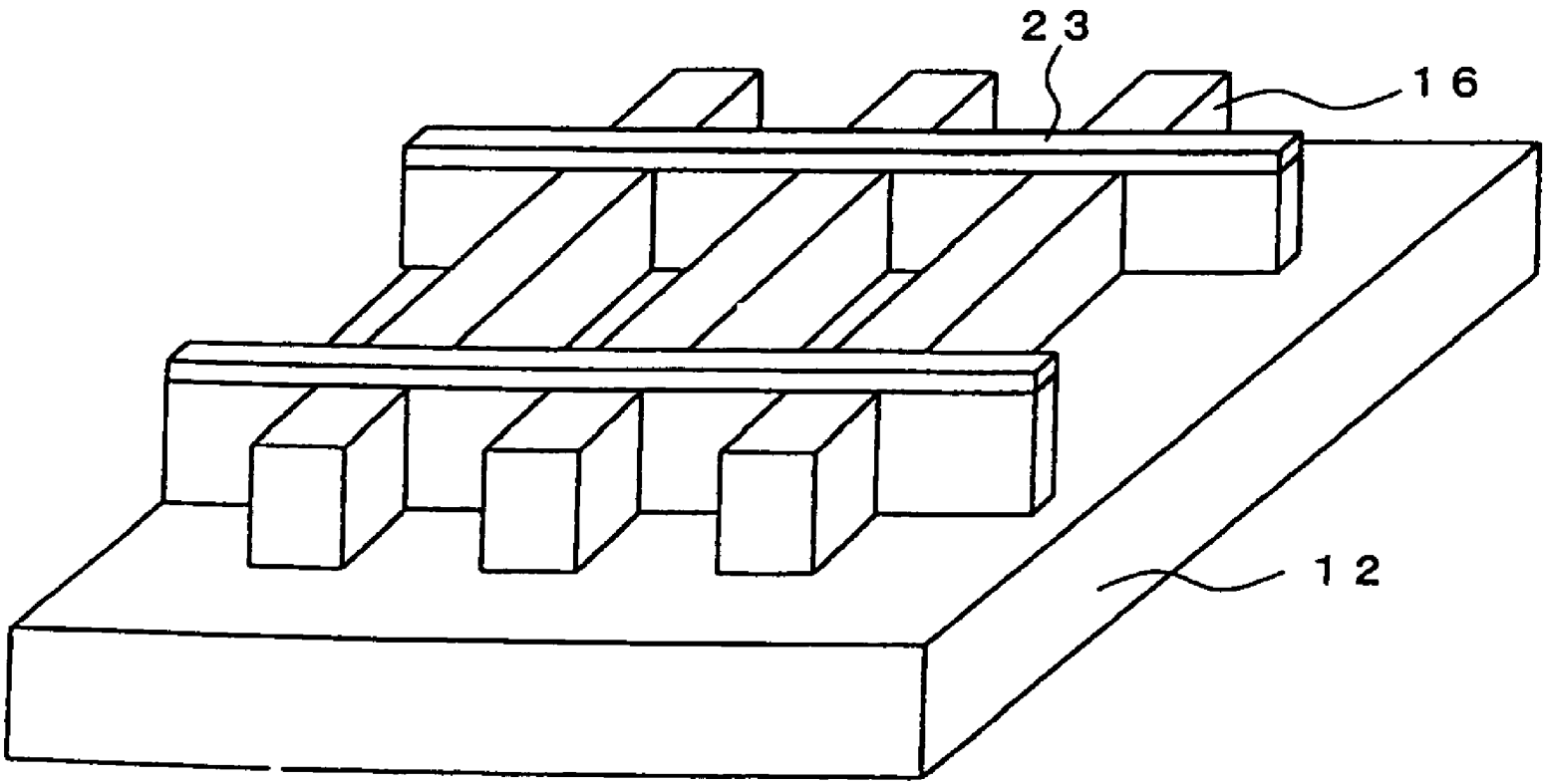
FIG. 26 is a perspective view illustrating a plasma display panel according to a twelfth embodiment of the present invention.

Now, a twelfth embodiment according to the present invention is described below. FIG. 26 is a perspective view illustrating a plasma display panel according to the twelfth embodiment of the present invention. Referring to FIG. 26, this embodiment is different from the first embodiment in having the horizontal barrier walls 23 on the ribs 16.

The horizontal barrier wall 23 has a height of 2 to 50 μm, desirably 5 to 30 μm. In addition, the horizontal barrier wall 23 is located between the pixel cells corresponding to the sustain-side bus electrodes 13*d* adjacent to each other or between the pixel cells corresponding to the scan-side bus electrodes 13*e*, on the second insulating substrate 12.

The horizontal barrier wall 23 can be formed integrally with the ribs 16. Alternatively, it is possible to form the horizontal barrier wall 23, using a patterned screen, by employing the thick-film printing method to directly perform pattern printing on the ribs 16 having a uniformly formed height and then by baking the horizontal barrier wall 23. Alternatively, the horizontal barrier wall 23 can also be formed using a photosensitive paste in the same manner as that of the fourth embodiment.

The horizontal barrier wall 23 can be formed of a transparent glass material. Alternatively, to increase contrast, the material may be mixed with a black material (such as cobalt oxide, ruthenium oxide, or iron oxide). Alternatively, to provide efficient reflections of light emitted from pixel cells, titanium oxide, zirconium oxide, alumina, silicon oxide, or the like) may be mixed with the material to form a white material.

Like the eighth embodiment, this embodiment allows the horizontal barrier wall 23 to provide an exhaustion path in the longitudinal direction of the scan-side bus electrode 13*e*. This makes it possible, without using the vacuum encapsulation described with reference to FIG. 14, to affix the first and second insulating substrates to each other, on each of which structures have been formed in an atmospheric environment in the same manner as that of the prior art, and then perform the evacuation of and introduction of a gas into the plasma display panel. Furthermore, this embodiment provides an advantage of simplifying the fabrication process since the ribs and the horizontal barrier walls are formed only on one insulating substrate.

Thirteenth Embodiment

Figure 27:
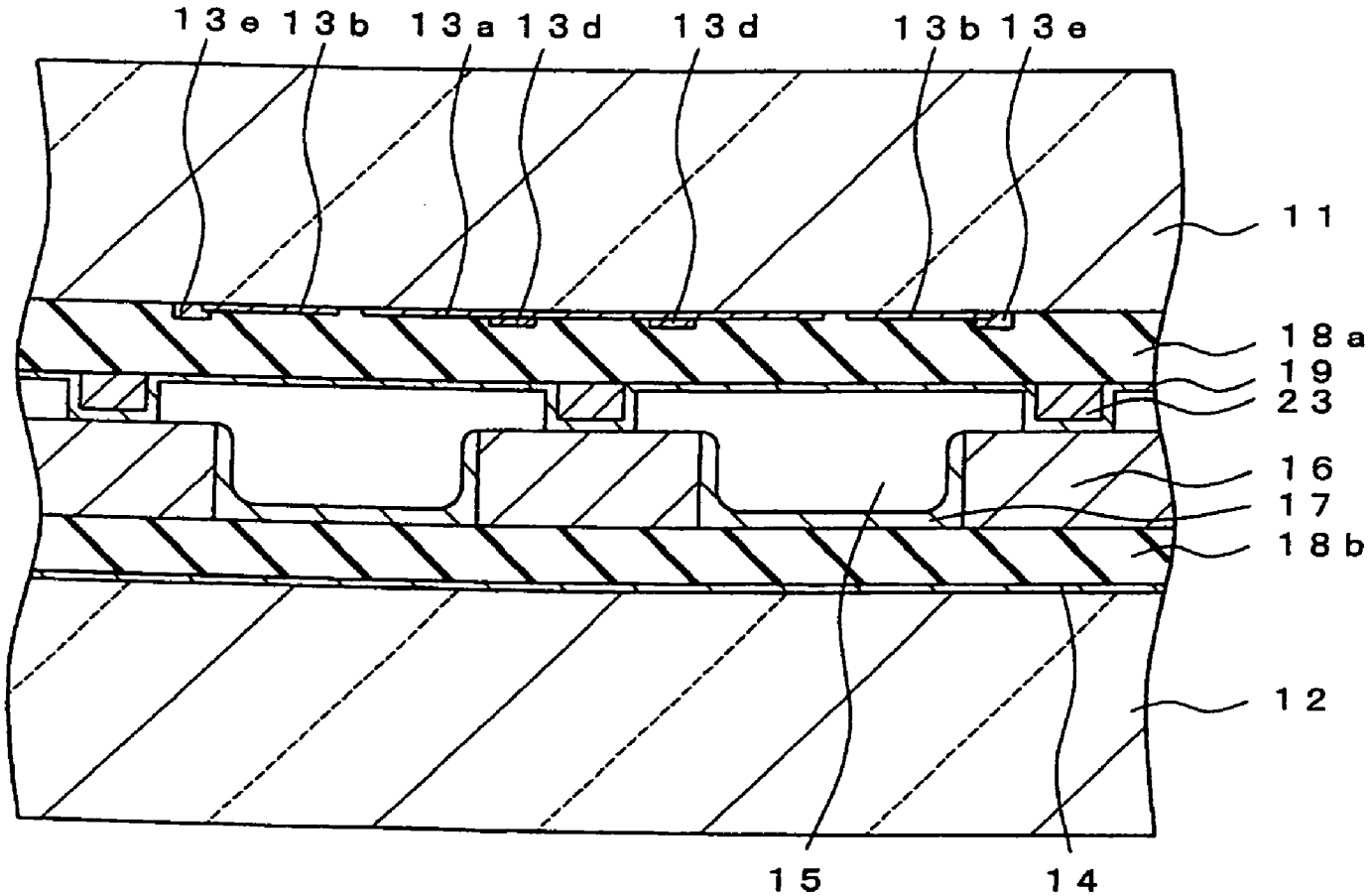
FIG. 27 is a cross-sectional view illustrating a plasma display panel according to a thirteenth embodiment of the present invention.

Now, a thirteenth embodiment according to the present invention is described below. FIG. 27 is a cross-sectional view illustrating a plasma display panel according to the thirteenth embodiment of the present invention. Like the plasma display panel according to the eighth embodiment shown in FIG. 21, this embodiment employs the horizontal barrier wall 23. The rib 16 opposite to the horizontal barrier wall 23 has a width greater than that opposite to a pair of sustain-side bus electrodes 13*d* or scan-side bus electrodes 13*e* as shown in FIG. 27. This makes it possible to prevent discharges, occurring on the bus electrodes 13*d*, 13*e* and providing low optical output efficiency, and increase the luminous efficiency of pixel cells. In this case, without increasing the electrostatic capacitance established via the horizontal barrier wall 23 between the sustain-side bus electrode 13*d* and the scan-side bus electrode 13*e*, it is possible to increase the luminous efficiency of pixel cells while preventing discharges, occurring on the bus electrodes and providing low optical output efficiency.

That is, the ribs 16 located to overlap the bus electrodes 13*d*, 13*e* can prevent the light emission on the bus electrodes 13*d*, 13*e*, thereby making it possible to increase the luminous efficiency. This in turn makes it possible to increase intensity for the same light emission power. In other words, with the intensity remaining unchanged, the light emission power can be reduced.

Fourteenth Embodiment

Figure 28:
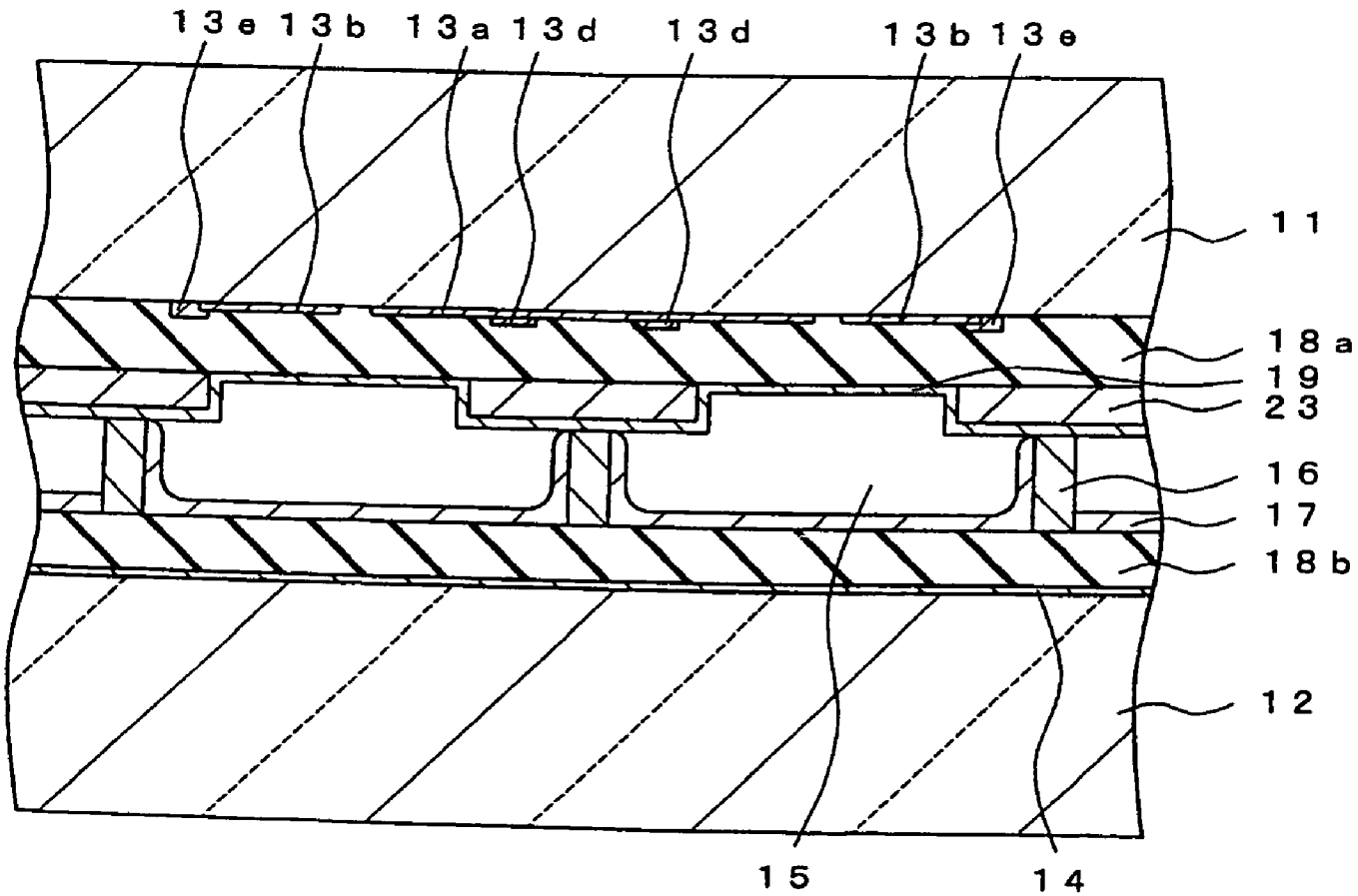
FIG. 28 is a cross-sectional view illustrating a plasma display panel according to a fourteenth embodiment of the present invention.

Now, a fourteenth embodiment according to the present invention is described below. FIG. 28 is a cross-sectional view illustrating a plasma display panel according to the fourteenth embodiment of the present invention. Like the eighth embodiment shown in FIG. 21, this embodiment also employs the horizontal barrier wall 23. As shown in FIG. 28, the horizontal barrier wall 23 has a width extended to cover the bus electrodes 13*d*, 13*e*. This makes it possible to prevent discharges, occurring on the bus electrodes 13*d*, 13*e* and providing low optical output efficiency, and further increase the luminous efficiency of pixel cells.

This in turn makes it possible to increase intensity for the same light emission power. In other words, with the intensity remaining unchanged, the light emission power can be reduced. Furthermore, since the bus electrodes 13*d*, 13*e* do not overlap the ribs 16, the electrostatic capacitance between the scan electrode 13*b* or the sustain electrode 13*a* and the column electrode 14 is reduced.

Fifteenth Embodiment

Figure 29:
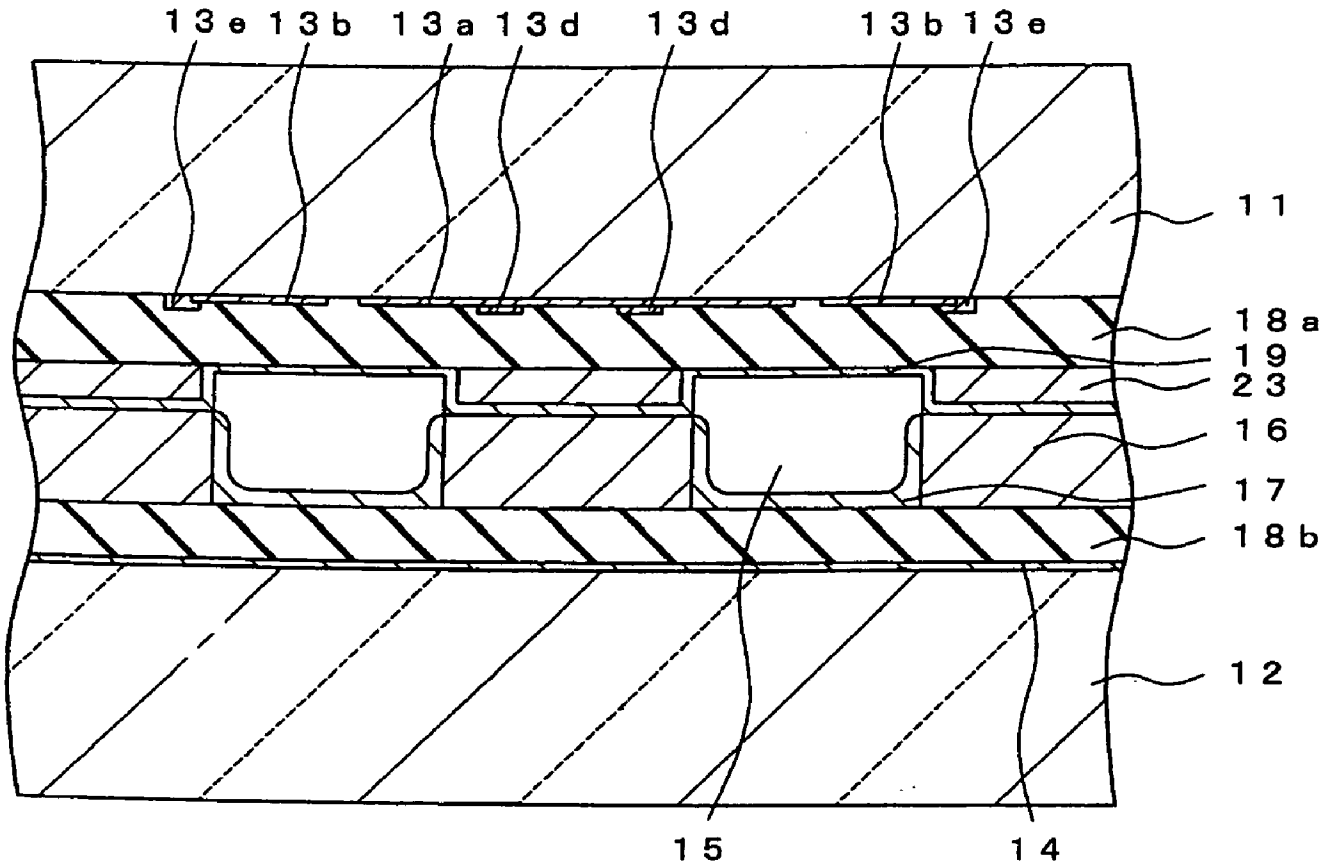
FIG. 29 is a cross-sectional view illustrating a plasma display panel according to a fifteenth embodiment of the present invention.

Now, a fifteenth embodiment according to the present invention is described below. FIG. 29 is a cross-sectional view illustrating a plasma display panel according to the fifteenth embodiment of the present invention. This embodiment employs the horizontal barrier wall 23 of the eighth embodiment shown in FIG. 21. In this embodiment, as shown in FIG. 29, the contact area between the rib 16 and the horizontal barrier wall 23 is increased to place the first priority on preventing damage to the rib when being subjected to vibration or shock. As shown in FIG. 29, the horizontal barrier wall 23 and the rib 16 opposite to the horizontal barrier wall 23 are extended in width to cover the bus electrodes 13*d*, 13*e*. In this case, it is possible to increase the luminous efficiency although the electrostatic capacitance between the sustain-side bus electrode 13*d* and the scan-side bus electrode 13*e* and between the sustain-side and scan-side bus electrodes 13*d*, 13*e* and the column electrode 14 are increased.

The horizontal barrier wall 23 and the rib 16 located to overlap the bus electrodes 13*d*, 13*e* can prevent the light emission on the bus electrodes 13*d*, 13*e*, thereby making it possible to increase the luminous efficiency. White ribs 16 would reflect visible light from ribs, thereby making it possible to further increase the luminous efficiency. This increase in light emission in turn makes it possible to increase intensity for the same light emission power. In other words, with the intensity remaining unchanged, the light emission power can be reduced.

Incidentally, in the thirteenth to fifteenth embodiments, the sustain-side bus electrodes 13*d* and the scan-side bus electrodes 13*e* have the same thickness as that of the prior art ones (about 3 to 8 μm). However, in these embodiments, since the discharges on the sustain-side bus electrodes 13*d* and the scan-side bus electrodes 13*e* are substantially prevented, these bus electrodes 13*d*, 13*e* may be made greater in width than those of prior art. More specifically, with the bus electrodes 13*d*, 13*e* being increased in width up to about 10 to 25 μm, the insulating layer 18*a* (normally having a thickness of 20 to 40 μm) having a decreased thickness would cause an extremely large discharge, preventing the insulating layer 18*a* and the protective layer 19 from being subjected to an electrical breakdown.

This makes it possible to reduce the electrode resistance of the sustain-side bus electrode 13*d* and the scan-side bus electrode 13*e* to about ½ to ⅕ of the conventional value. This also causes the voltage drop across the sustain-side bus electrode 13*d* and the scan-side bus electrode 13*e* to be made smaller than conventional value. This provides a reduced rate of reduction in the voltage applied to the sustain electrode 13*a* or the scan electrode 13*b* of each pixel cell. This provides a reduction in minimum voltage to be applied from outside during a light emission discharge and reduced spurious erases for discharging pixel cells, thereby providing more stabilized display operation. Incidentally, the maximum voltage remains unchanged which can be applied from outside without causing spurious discharges during a light emission discharge. This makes it possible to provide an increased operational voltage margin or the difference between the aforementioned maximum and minimum voltages.

Thus, it is made possible to set voltages with sufficient allowance with respect to a decrease in the aforementioned maximum voltage and an increase in the aforementioned minimum voltage caused by long-term operation. This allows the longevity of the plasma display panel to increase which is affected by spurious discharges or spurious erases, thereby making it possible to significantly improve the long-term reliability of the display device employing the plasma display panel.

Sixteenth Embodiment

Figure 30:
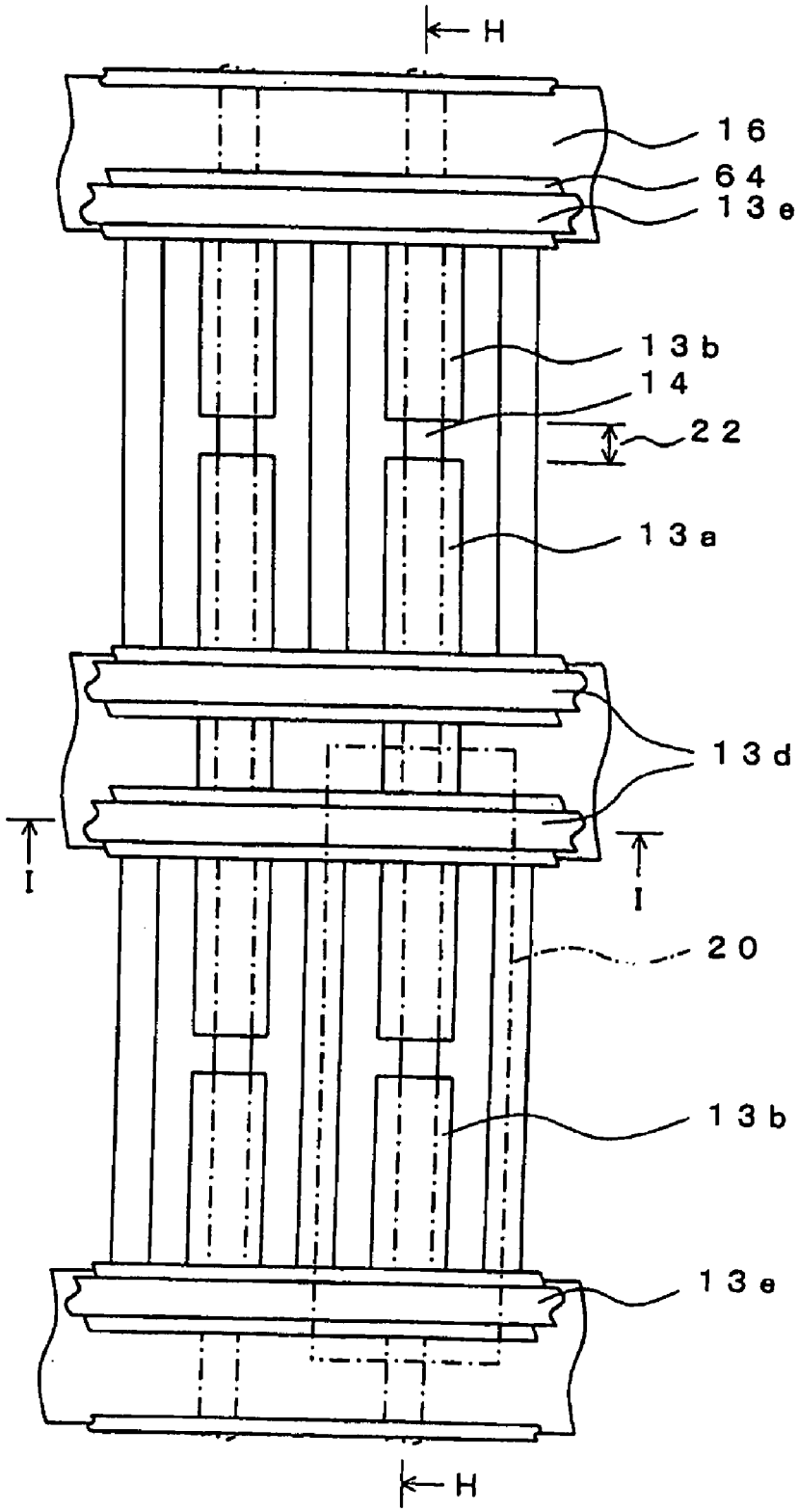
FIG. 30 is a plan view illustrating a plasma display panel according to a sixteenth embodiment of the present invention.
Figure 31:
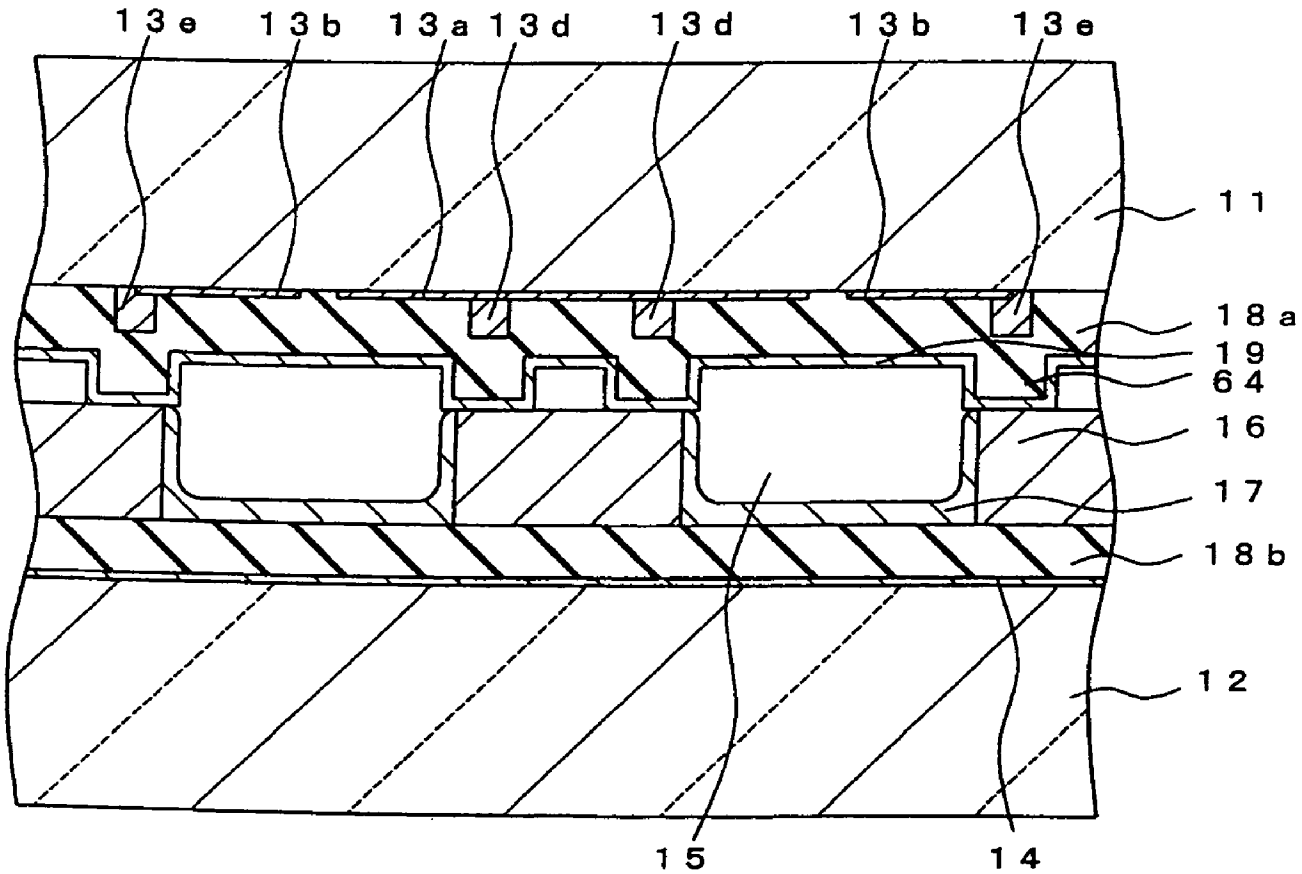
FIG. 31 is a cross-sectional view taken along line H-H of FIG. 30.
Figure 32:
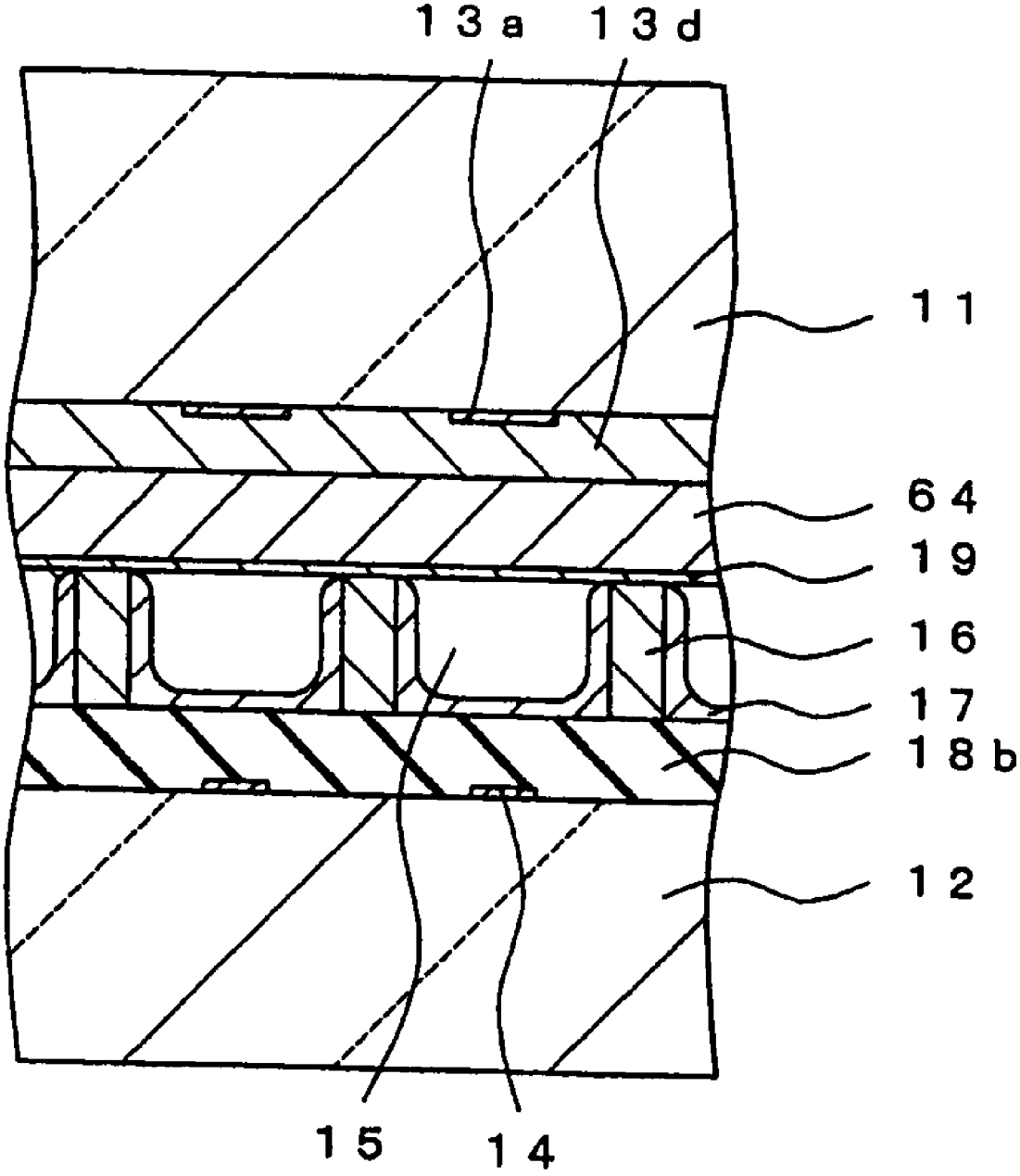
FIG. 32 is a cross-sectional view taken along line I-I of FIG. 30.

Now, a sixteenth embodiment according to the present invention is described below. FIG. 30 is a plan view illustrating a plasma display panel according to the sixteenth embodiment of the present invention. FIG. 31 is a cross-sectional view taken along line H-H of FIG. 30, and FIG. 32 is a cross-sectional view taken along line I-I of FIG. 30. As shown in FIGS. 30 to 32, in this embodiment, the thickness of the sustain-side bus electrode 13*d* and the scan-side bus electrode 13*e* causes the surface of the insulating layer 18*a* to project by that thickness, thus creating bumps 64 on the insulating layer 18*a*.

As described above, to raise the sustain-side bus electrode 13*d* and the scan-side bus electrode 13*e* to cause the insulating layer 18*a* to be also raised, control may be exercised over the leveling property of the insulating layer paste upon being dried and the reflow property thereof upon being baked, by the material and adjustment of baking temperatures upon printing, drying, and baking the thick insulating layer 18*a*. For example, the amount of the thinner component of print paste is reduced to be less than usual and the maximum temperature of baking is also reduced by about 5 to 50° C., thereby making it possible to form the bump 64. Furthermore, it is also effective to reduce the maximum temperature of baking and the length of time periods of the maximum temperature and temperatures before and after the maximum temperature.

This embodiment with the configuration described above can provide an effect equivalent to the horizontal barrier wall 23 without forming the horizontal barrier wall 23. This makes it possible to facilitate the fabrication process and provide a significant reduction in cost.

For example, the sustain-side bus electrode 13*d* and the scan-side bus electrode 13*e* have a thickness of 10 to 50 μm. Correspondingly, the bump 64 can have a height of 2 to 50 μm at the portions having no underlying bus electrodes 13*d*, 13*e*. The bus electrodes 13*d*, 13*e* conventionally have a thickness of 1 to 9 μm and about 5 μm on average. In contrast, this embodiment provides the bus electrodes 13*d*, 13*e* with a thickness of 10 to 50 μm. Thus, this embodiment provides a second effect that the resistance of the sustain-side bus electrode 13*d* and the scan-side bus electrode 13*e* can be reduced to ½ to 1/10 of the conventional average electrode resistance.

Furthermore, the sustain electrode 13*a* connects electrically two neighboring sustain-side bus electrodes 13*d* to each other. It is therefore possible to substantially reduce the overall electrode resistance of the two neighboring sustain-side bus electrodes 13*d* to ¼ to 1/20 of the conventional value. This reduces the voltage drop across the sustain-side bus electrode 13*d* to be significantly less than that provided by the first embodiment. This makes it possible to reduce the rate of reduction, caused by the voltage drop across the sustain-side bus electrode 13*d*, in the voltage applied to the sustain electrode 13*a* of each pixel cell. This provides a reduction in minimum voltage to be applied from outside during a light emission discharge and reduced spurious erases for discharging pixel cells, thereby providing more stabilized display operation. Incidentally, the maximum voltage remains unchanged which can be applied from outside without causing spurious discharges during a light emission discharge. This makes it possible to provide an increased operational voltage margin or the difference between the aforementioned maximum and minimum voltages.

Thus, it is made possible to set voltages with sufficient allowance with respect to a decrease in the aforementioned maximum voltage and an increase in the aforementioned minimum voltage caused by long-term operation. This allows the longevity of the plasma display panel to increase which is affected by spurious discharges or spurious erases, thereby making it possible to significantly improve the long-term reliability of the display device employing the plasma display panel.

Furthermore, two neighboring sustain-side bus electrodes 13*d* are electrically coupled to each other. Thus, even when one of the sustain-side bus electrodes 13*d* is on the verge of a break, the other neighboring sustain-side bus electrode 13*d* supplies current, thereby making it possible to provide increased yield of fabrication for a break in the electrodes. Incidentally, when thick bus electrodes 13*d*, 13*e* are employed as in this embodiment, it is possible to use a silver paste increased in volume by mixing the paste with a fine particle filler formed such as of alumina or silica to avoid an increase in cost caused by the expensive silver paste.

Seventeenth Embodiment

Figure 33:
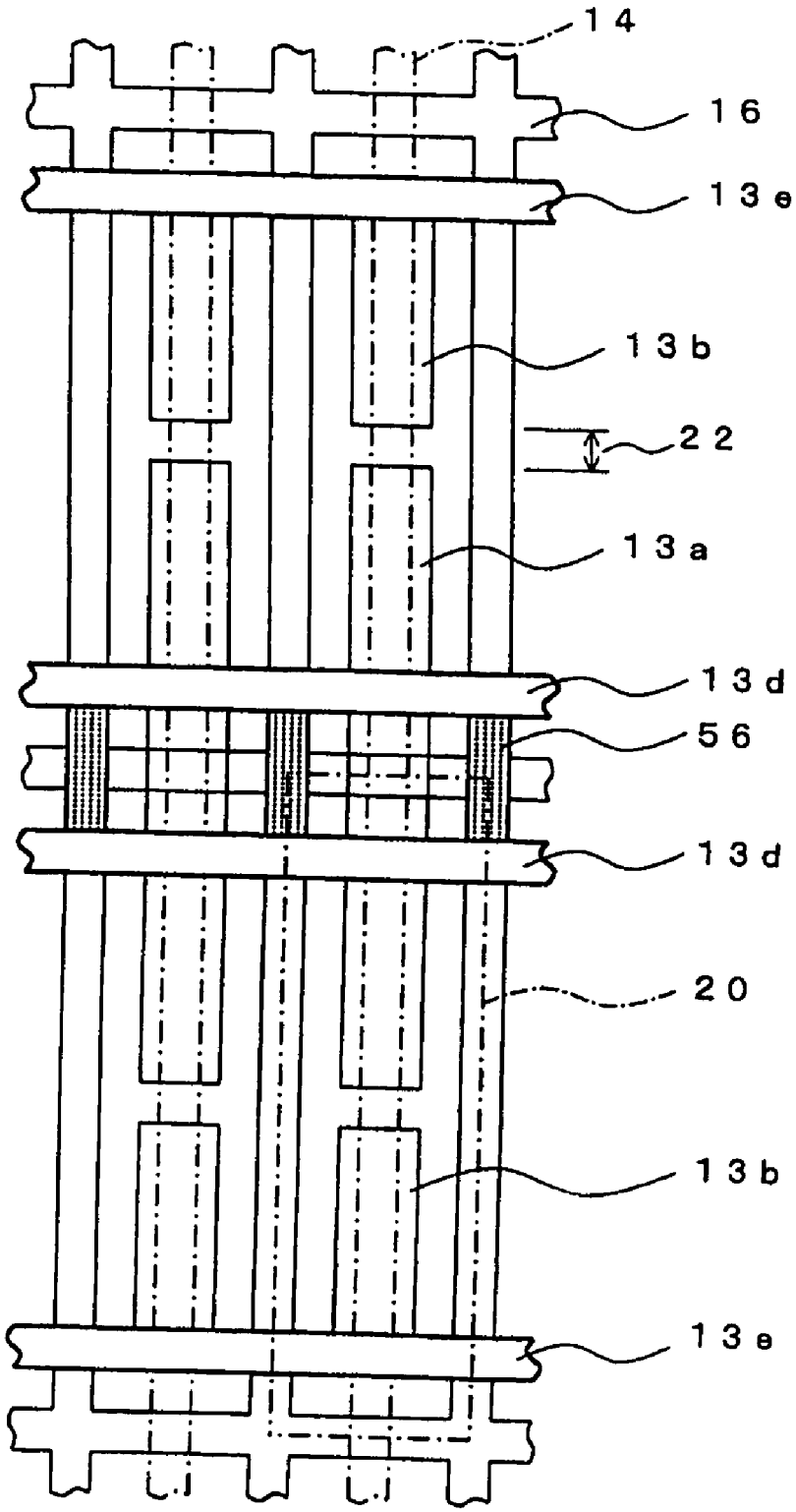
FIG. 33 is a plan view illustrating a plasma display panel according to a seventeenth embodiment of the present invention.

Now, a seventeenth embodiment according to the present invention is described below. FIG. 33 is a plan view illustrating a plasma display panel according to the seventeenth embodiment of the present invention. Referring to FIG. 33, connecting portions 56, formed of the same material as that of the sustain-side bus electrode 13*d*, connect the sustain-side bus electrodes 13*d* of neighboring pixel cells to each other.

This allows the connecting portion 56 to electrically connect two neighboring sustain-side bus electrodes 13*d* to each other, thereby making it possible to substantially reduce the overall electrode resistance of the two neighboring sustain-side bus electrodes 13*d* by one-half. This provides a reduction in voltage drop across the sustain-side bus electrode 13*d* and a reduced rate of reduction in the voltage applied to the sustain electrode 13*a* of each pixel cell. This provides a reduction in minimum voltage to be applied from outside during a light emission discharge and reduced spurious erases for discharging pixel cells, thereby providing further stabilized display operation. Incidentally, the maximum voltage remains unchanged which can be applied from outside without causing spurious discharges during a light emission discharge. This makes it possible to provide an increased operational voltage margin or the difference between the aforementioned maximum and minimum voltages.

Thus, it is made possible to set voltages with sufficient allowance with respect to a decrease in the aforementioned maximum voltage and an increase in the aforementioned minimum voltage caused by long-term operation. This allows the longevity of the plasma display panel to increase which is affected by spurious discharges or spurious erases, thereby making it possible to significantly improve the long-term reliability of the display device employing the plasma display panel.

Furthermore, two neighboring sustain-side bus electrodes 13*d* are electrically coupled to each other. Thus, even when one of the sustain-side bus electrodes 13*d* is on the verge of a break, the other neighboring sustain-side bus electrode 13*d* supplies current, thereby making it possible to provide increased yield of fabrication for a break in the electrodes. This effect is greater than that provided by the first embodiment in which transparent electrodes, greater in resistance than the bus electrode by several orders of magnitude, between the bus electrodes.

Incidentally, referring to FIG. 33, the neighboring sustain-side bus electrodes 13*d* are connected to each by the connecting portion 56 and shared by the vertically neighboring pixel cells. However, apart from this, the sustain electrode 13*a* can also be made independent for each pixel cell, like the scan electrode 13*b*. Furthermore, since the sustain-side bus electrodes 13*d* are electrically connected to each other by the connecting portion 56, the sustain electrode 13*a* can be made independent at each pixel cell.

Eighteenth Embodiment

Figure 34:
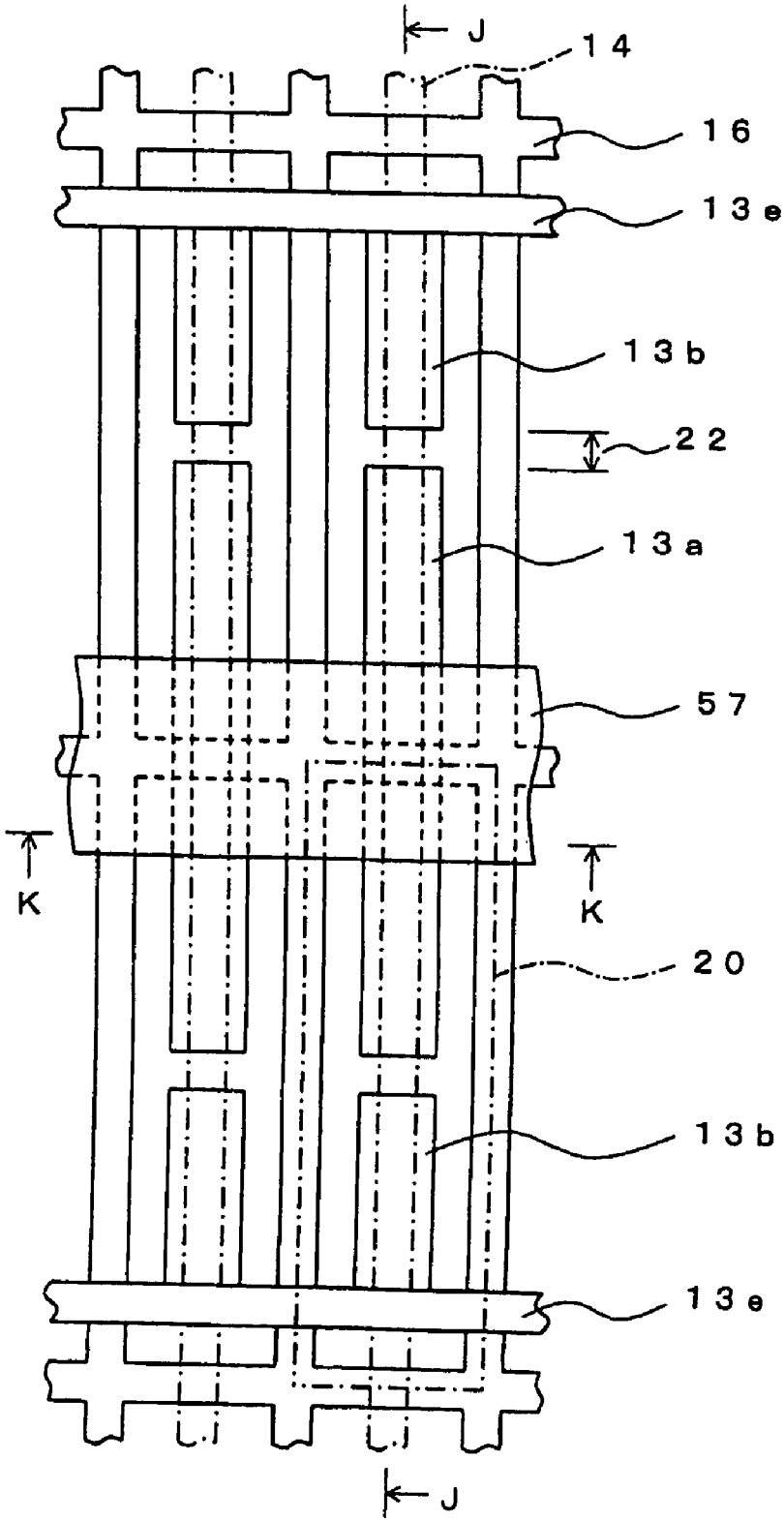
FIG. 34 is a plan view illustrating a plasma display panel according to an eighteenth embodiment of the present invention.
Figure 35:
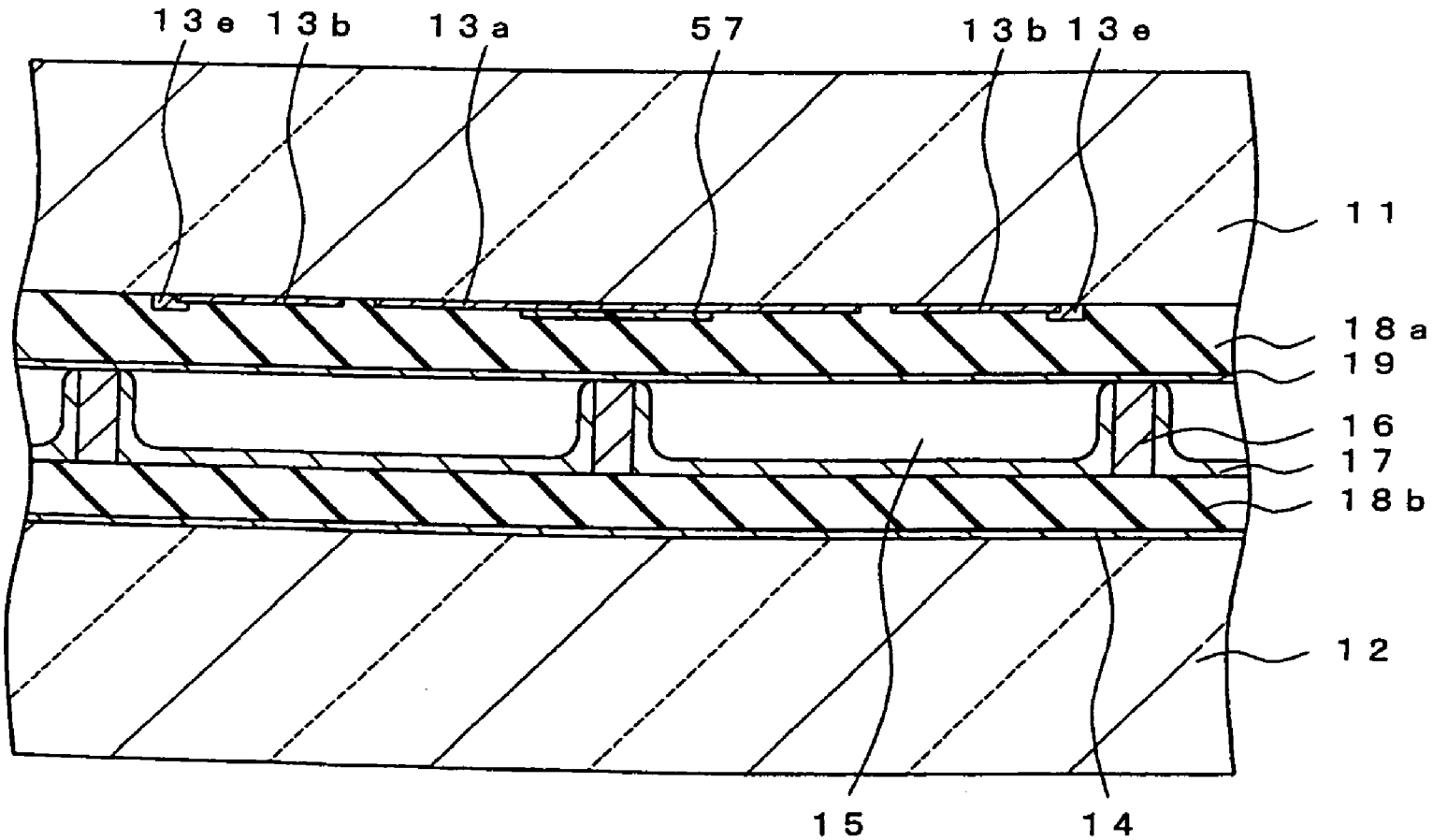
FIG. 35 is a cross-sectional view taken along line J-J of FIG. 34.
Figure 36:
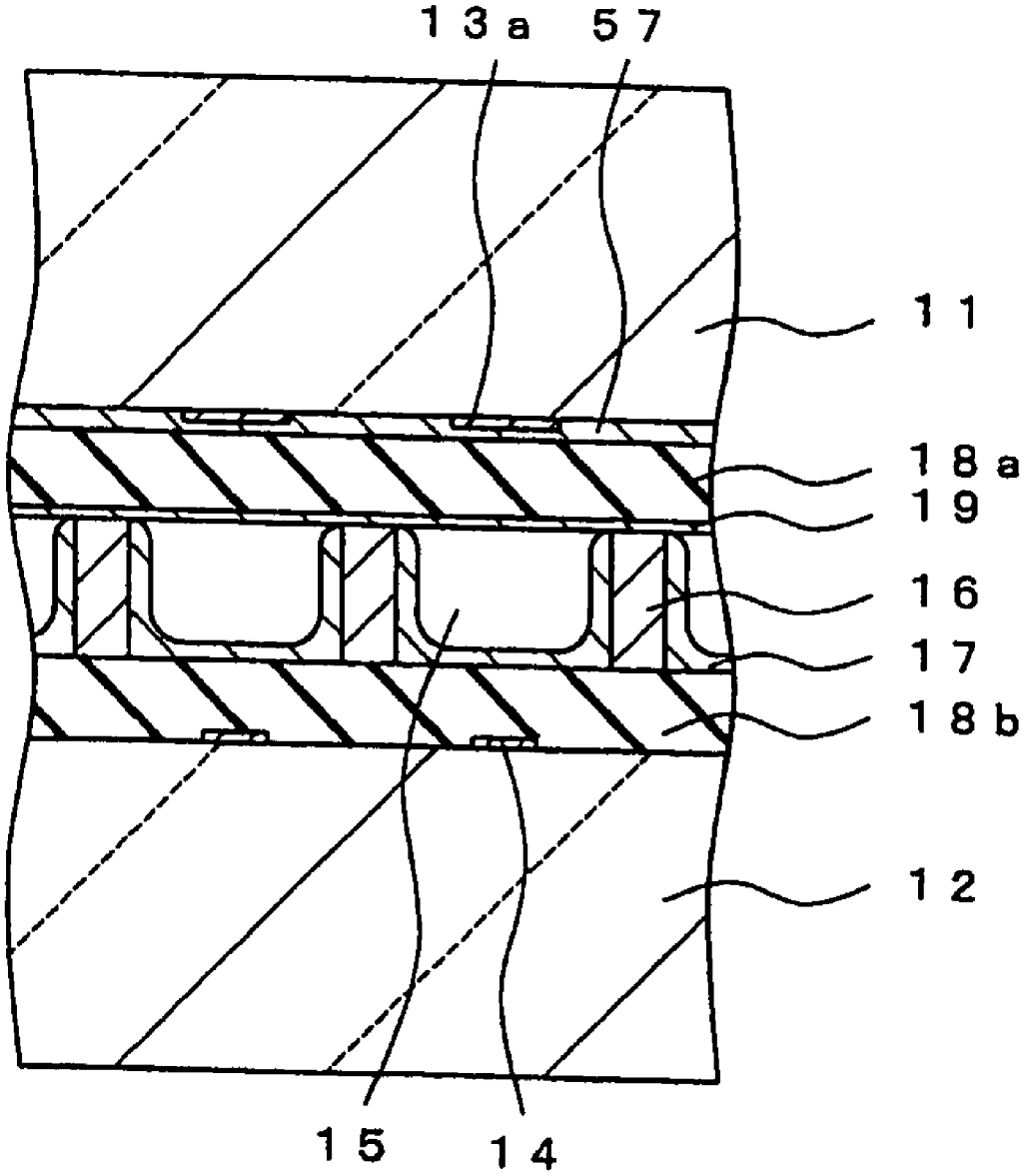
FIG. 36 is a cross-sectional view taken along line K-K of FIG. 34.

Now, an eighteenth embodiment according to the present invention is described below. FIG. 34 is a plan view illustrating a plasma display panel according to the eighteenth embodiment of the present invention. FIG. 35 is a cross-sectional view taken along line J-J of FIG. 34, and FIG. 36 is a cross-sectional view taken along line K-K of FIG. 34. This embodiment allows the sustain-side bus electrodes 13*d* of neighboring pixel cells to be perfectly shared and employed as a common bus electrode 57.

This allows the two neighboring sustain-side bus electrodes 13*d* to be electrically connected to each other to perfection. As described in the first embodiment, the non-shared sustain-side bus electrode 13*d* or scan-side bus electrode 13*e* has a width of 70 μm, while the sustain-side bus electrodes 13*d* or the scan-side bus electrodes 13*e* between vertically neighboring pixel cells are arranged at 70 μm intervals. Accordingly, the common bus electrode 57 can have a width of 210 μm.

This makes it possible to reduce the electrode resistance of the common bus electrode 57 to approximately ⅓ of that of the scan-side bus electrode 13*e*. In addition, the common bus electrode 57 may be increased in thickness from 1 through 9 μm, 5 μm on average as mentioned in the first embodiment, to 20 μm, thereby making it possible to reduce the resistance of the common bus electrode 57 to 1/12 of that of the scan-side bus electrode 13*e*.

This allows the voltage drop across the sustain-side bus electrode (the common bus electrode 57) to be further reduced from that of the sixteenth embodiment. This provides a reduced rate of reduction in the voltage applied to the sustain electrode 13*a* of each pixel cell. This provides a reduction in minimum voltage to be applied from outside during a light emission discharge and reduced spurious erases for discharging pixel cells, thereby providing more stabilized display operation. Incidentally, the maximum voltage remains unchanged which can be applied from outside without causing spurious discharges during a light emission discharge. This makes it possible to provide an increased operational voltage margin or the difference between the aforementioned maximum and minimum voltages.

Thus, it is made possible to set voltages with sufficient allowance with respect to a decrease in the aforementioned maximum voltage and an increase in the aforementioned minimum voltage caused by long-term operation. This allows the longevity of the plasma display panel to increase which is affected by spurious discharges or spurious erases, thereby making it possible to significantly improve the long-term reliability of the display device employing the plasma display panel.

In addition, the two neighboring sustain-side bus electrodes 13*d* are completely integrated with each other. This allows the common bus electrode 57 to have a width three to six times greater than that of the conventional sustain-side bus electrode 13*d*. This makes it possible to increase the fabrication yield twice or more for a break in the electrodes. This effect is greater than that provided by the seventeenth embodiment in which the connecting portion 56 connects between the sustain-side bus electrodes 13*d*.

Incidentally, the display side of the bus electrode portion is formed in black. In this regard, with the scan-side bus electrode 13*e* being greatly different in shape from the common bus electrode 57 as in the eighteenth embodiment shown in FIGS. 34 to 36, the configuration having intervals twice as large as the pitch of pixel cells would provide bad impression to the viewer. However, blackening between the neighboring scan-side bus electrodes 13*e* by means of the black horizontal barrier wall 23 would make it possible to eliminate the feeling of being apparently interfered.

Nineteenth Embodiment

Figure 37:
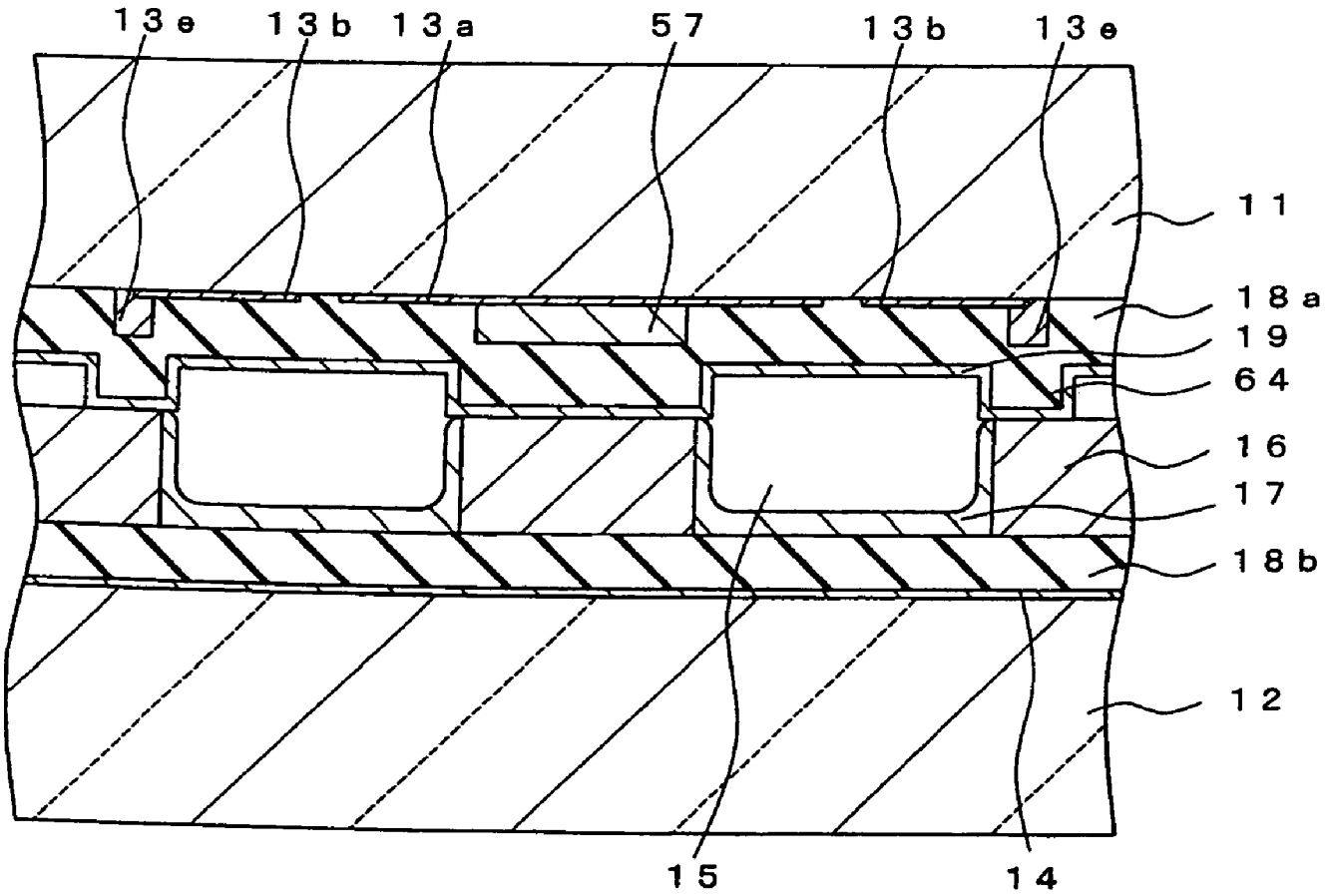
FIG. 37 is a cross-sectional view illustrating a plasma display panel according to a nineteenth embodiment of the present invention.

Now, a nineteenth embodiment according to the present invention is described below. FIG. 37 is a cross-sectional view illustrating a plasma display panel according to the nineteenth embodiment of the present invention. In the embodiment shown in FIG. 37, the thickness of the common bus electrode 57 and the scan-side bus electrode 13*e*, disposed across pixel cells adjacent to each other in the column direction, causes the surface of the insulating layer 18*a* to project by that thickness, thus creating the bumps 64 on the insulating layer 18*a*.

As described above, to raise the common bus electrode 57 and the scan-side bus electrode 13*e* to raise also the insulating layer 18*a* to form the bump 64 thereon, control may be exercised over the leveling property of the insulating layer paste upon being dried and the reflow property thereof upon being baked, by the material and adjustment of baking temperatures upon printing, drying, and baking the thick insulating layer 18*a*. For example, the amount of the thinner component of print paste is reduced to be less than usual and the maximum temperature of baking is also reduced by about 5 to 50° C., thereby making it possible to form such a bump 64. Furthermore, it is also effective to reduce the maximum temperature of baking and the length of time periods of the maximum temperature and temperatures before and after the maximum temperature.

This embodiment with the configuration described above can provide an effect equivalent to the horizontal barrier wall 23 without forming the horizontal barrier wall 23. This makes it possible to facilitate the fabrication process and provide a significant reduction in cost.

The common bus electrode 57 and the scan-side bus electrode 13*e* can have a thickness of 10 to 50 μm. Correspondingly, the bump 64 can have a height of 2 to 50 μm at the portions having no underlying bus electrodes 13*d*, 57. The bus electrodes 13*d*, 57 conventionally have a thickness of 1 to 9 μm and about 5 μm on average. In contrast, this embodiment provides the bus electrodes 13*d*, 57 with a thickness of 10 to 50 μm. Thus, this embodiment provides a second effect that the resistance of the scan-side bus electrode 13*e* can be reduced to ½ to 1/10 of the conventional average electrode resistance.

Furthermore, the two neighboring sustain-side bus electrodes 13*d* are completely connected to each other to form the common bus electrode 57. It is therefore possible to reduce the electrode resistance of the common bus electrode to 1/6 to 1/30 of that of the two neighboring sustain-side bus electrodes 13*d*. This reduces the voltage drop across the sustain-side bus electrode 13*d* to be much less than that provided by the seventeenth embodiment. This provides a reduced rate of reduction in the voltage applied to the sustain electrode 13*a* of each pixel cell. This provides a reduction in minimum voltage to be applied from outside during a light emission discharge and reduced spurious erases for discharging pixel cells, thereby providing more stabilized display operation. Incidentally, the maximum voltage remains unchanged which can be applied from outside without causing spurious discharges during a light emission discharge. This makes it possible to provide an increased operational voltage margin or the difference between the aforementioned maximum and minimum voltages.

Thus, it is made possible to set voltages with sufficient allowance with respect to a decrease in the maximum voltage and an increase in the minimum voltage caused by long-term operation. This allows the longevity of the plasma display panel to increase which is affected by spurious discharges or spurious erases, thereby making it possible to significantly improve the long-term reliability of the display device employing the plasma display panel.

Furthermore, the present invention allows the two sustain-side bus electrodes 13*d*, which are adjacent to each other in the prior-art configuration, to be completely integrated with each other, thereby making it possible to provide increased yield of fabrication for a break in the electrodes. This effect is greater than that provided by the seventeenth embodiment in which the connecting portion 56 connects between the sustain-side bus electrodes 13*d*.

Twentieth Embodiment

Figure 38:
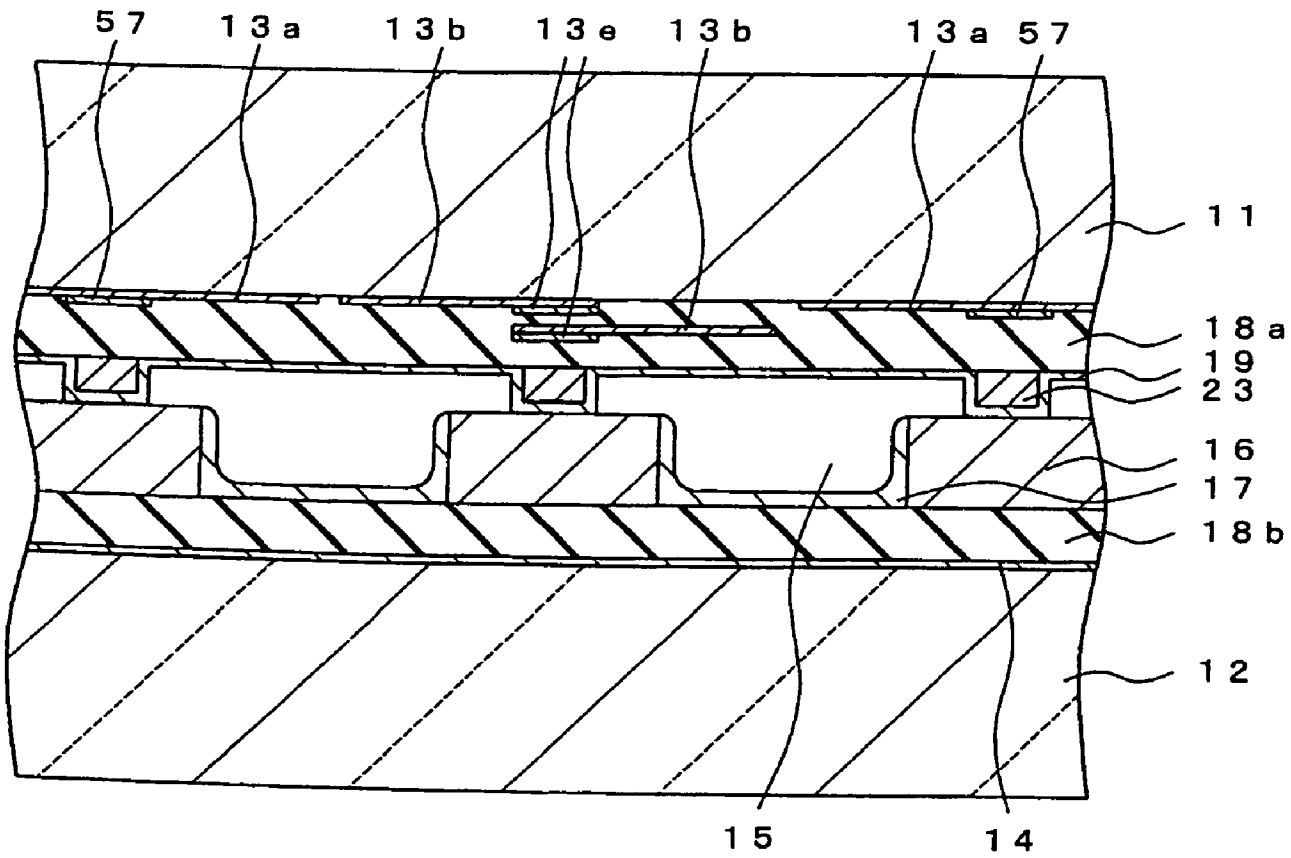
FIG. 38 is a cross-sectional view illustrating a plasma display panel according to a twentieth embodiment of the present invention.

Now, a twentieth embodiment according to the present invention is described below. FIG. 38 is a cross-sectional view illustrating a plasma display panel according to the twentieth embodiment of the present invention. This embodiment employs the common bus electrode 57 as the sustain-side bus electrode and is provided with two neighboring pairs of the scan electrode 13*b* and the scan-side bus electrode 13*e*, disposed overlapping with each other. As can be seen from FIG. 38, this allows the opening of pixel cells to be increased. This makes it possible to significantly increase the optical output efficiency and thereby dramatically reduce the power consumption of the plasma display panel. More specifically, for example, the luminous efficiency can be increased 1.3 times as high as that of the prior art. Using all this increase to reduce the power consumption makes it possible to reduce the light emission power by 30%.

Twenty-first Embodiment

Figure 39:
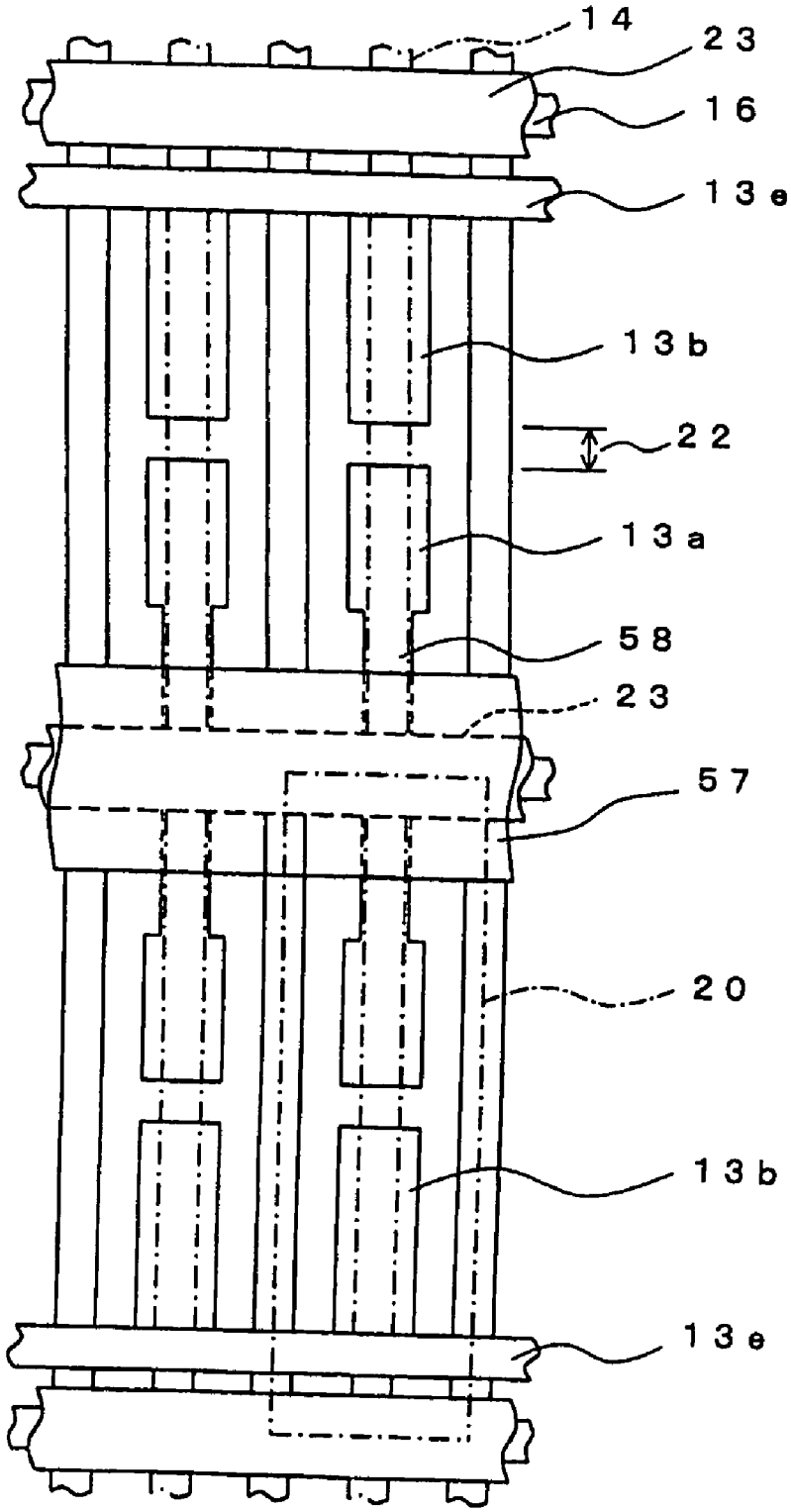
FIG. 39 is a plan view illustrating a plasma display panel according to a twenty-first embodiment of the present invention.

Now, a twenty-first embodiment according to the present invention is described below. FIG. 39 is a plan view illustrating a plasma display panel according to the twenty-first embodiment of the present invention. This embodiment allows the sustain electrode 13*a* to be narrowed at the root thereof for connecting to the sustain-side bus electrode 13*d*, thus providing the sustain electrode 13*a* with a narrowed portion 58. The common bus electrode 57, which commonly uses the electrodes disposed across two vertical pixel cells, may cause a spurious discharge to occur along the common bus electrode 57. However, this embodiment is provided with the narrowed portion 58, thereby making it possible to more positively prevent the spurious discharge transmitting along the common bus electrode 57, which commonly uses the electrodes disposed across two vertical pixel cells.

Twenty-second Embodiment

Figure 40:
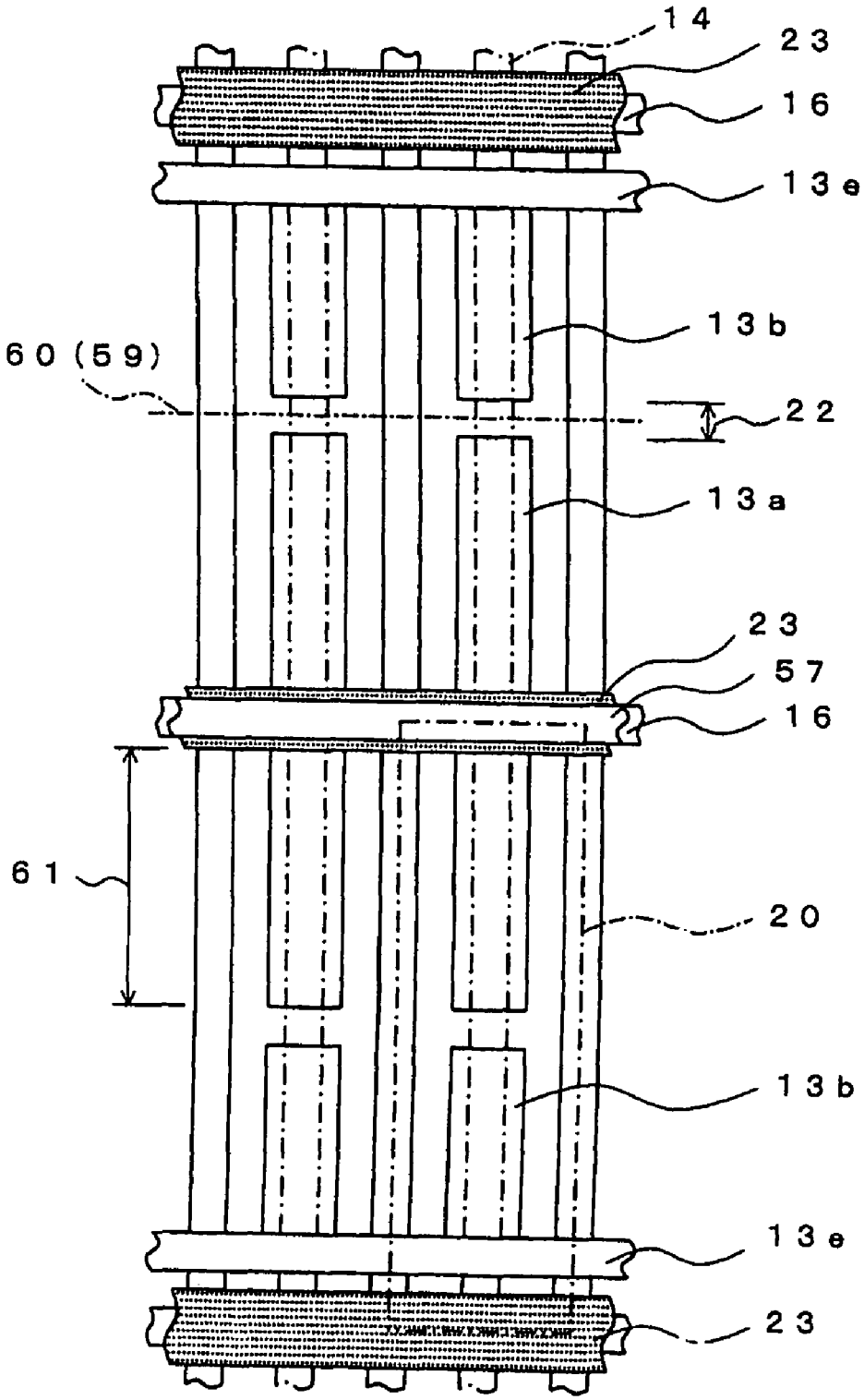
FIG. 40 is a plan view illustrating a plasma display panel according to a twenty-second embodiment of the present invention.
Figure 41:
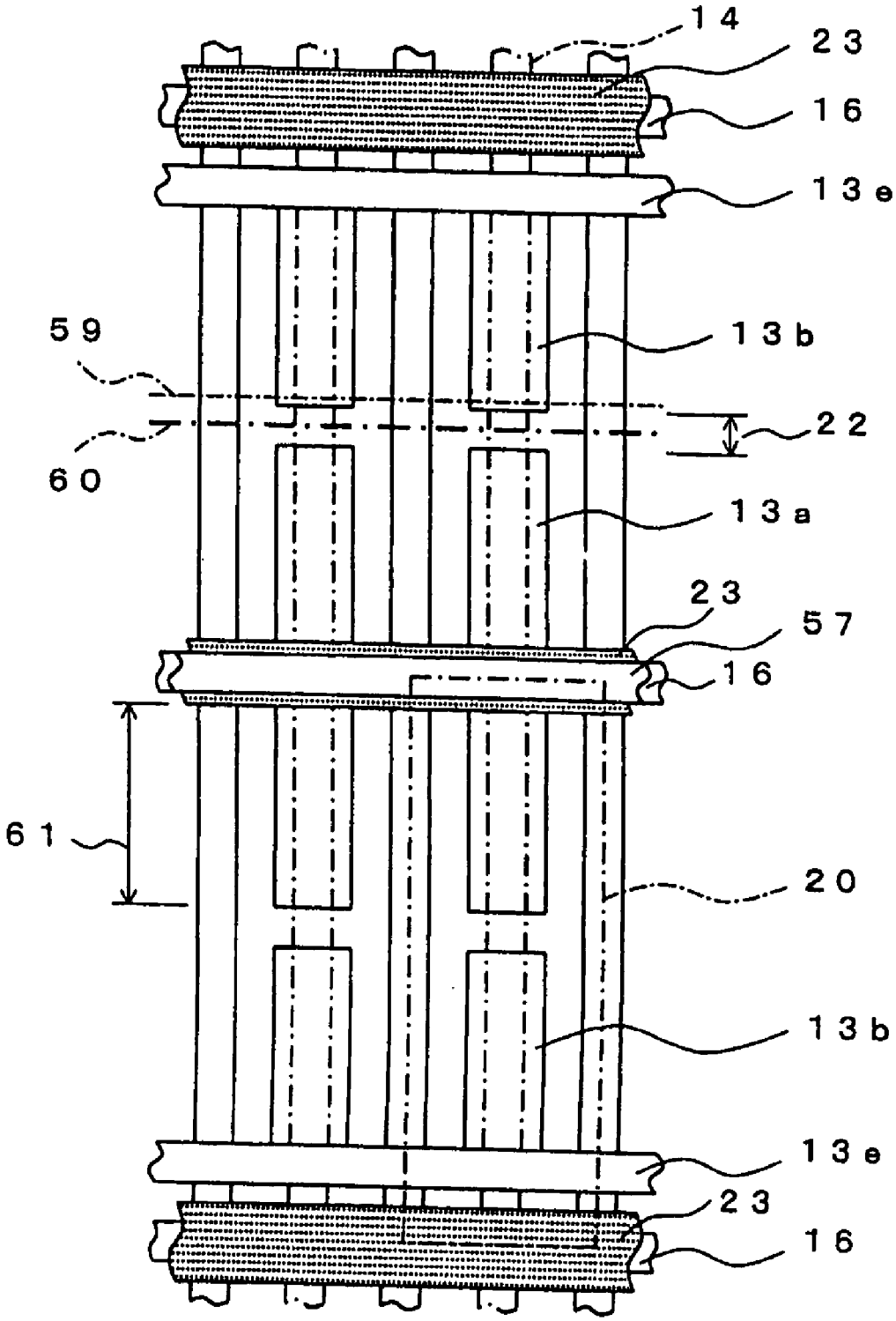
FIG. 41 is a plan view illustrating the arrangement of pixel cells according to the eighth embodiment of the present invention.

Now, a twenty-second embodiment according to the present invention is described below. FIG. 40 is a plan view illustrating a plasma display panel according to the twenty-second embodiment of the present invention. In addition, to make the feature of this embodiment clear, shown in FIG. 41 is a plan view illustrating the configuration of pixel cells according to the eighth embodiment (see FIGS. 20 to 22), from which this embodiment is originated. Referring to FIGS. 41 and 40, a pixel cell centerline 59 is shown for comparison purposes. When FIG. 41 is compared with FIG. 40, FIG. 41 shows that the pixel cell centerline 59 does not coincide with a centerline 60 of the discharge gap 22. This is because the scan electrode 13*b* and the sustain electrode 13*a* are provided with the same length of a long side 61 of the electrodes, the length being that of a substantial light-emitting portion, in accordance with the prior-art design technique by which the scan electrode 13*b* and the sustain electrode 13*a* are provided with the same area for discharging in pixel cells.

Experiments carried out by the present inventor show that this configuration provided by the prior-art design technique causes the discharge gap centerline 60, or the center of light emission, to be displaced from the pixel cell centerline 59 for defining the center of pixel cells to vary the centers of light emission at every two pixel cells in the vertical direction, thereby visualizing stripes having intensities that vary at pitch intervals twice as large as the vertical pixel cell pitch.

As shown in FIG. 40, to overcome this drawback, this embodiment provides the scan electrode 13*b* and the sustain electrode 13*a* with a change in length of the long side 61 of the electrodes, thereby allowing the pixel cell centerline 59 to coincide with the centerline 60 of the discharge gap 22.

In addition, by narrowing the root of the sustain electrode 13*a* as shown in FIG. 39, it is also possible to realize pixel cells arranged at the same intervals in the column direction and having generally the same distribution of light emission at the pixel cells.

With such an electrode arrangement, it is possible to effectively prevent the horizontal stripes from being viewed which have a repetitive pattern at twice pitch intervals.

Twenty-third Embodiment

Figure 42:
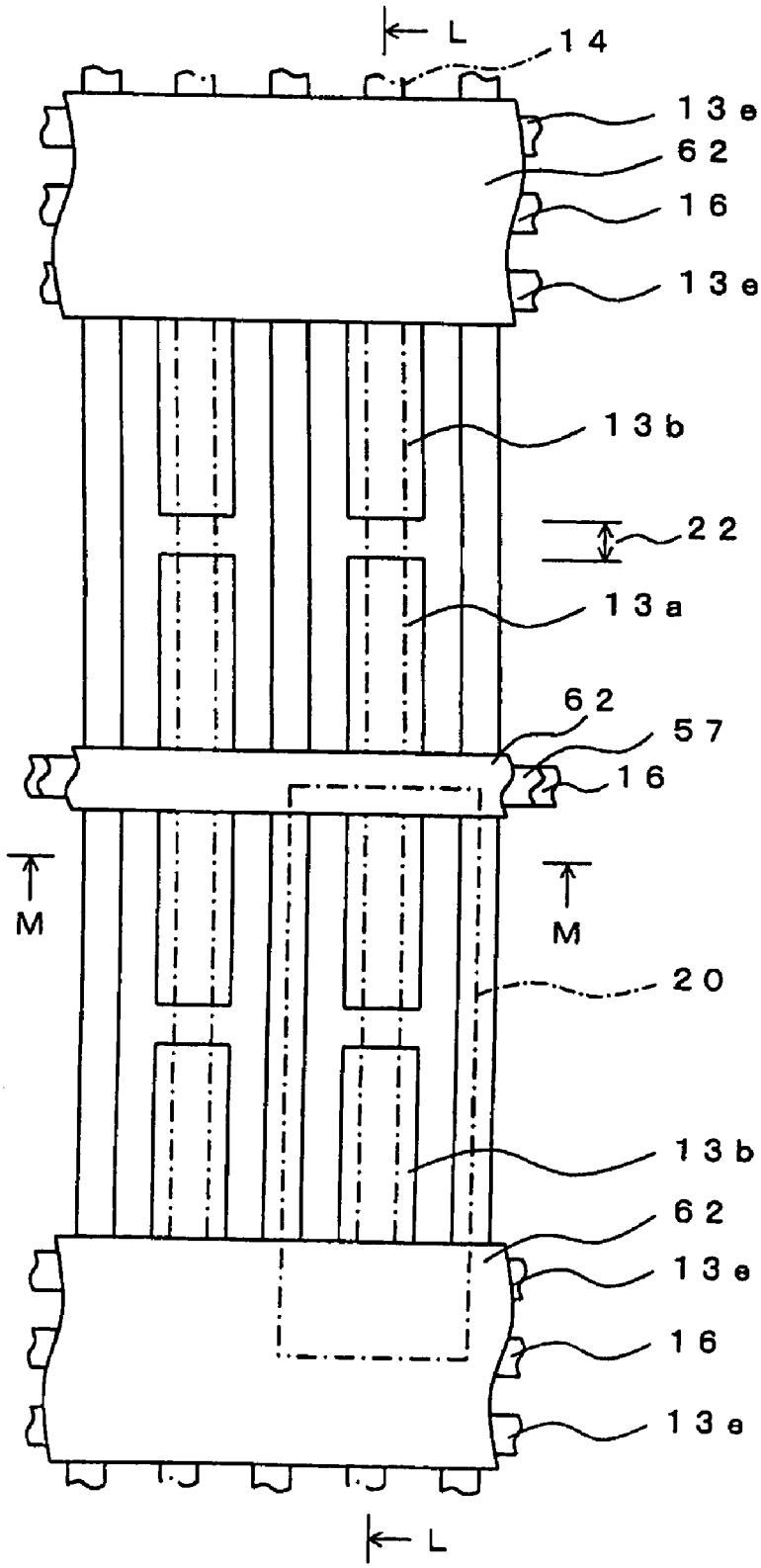
FIG. 42 is a plan view illustrating a plasma display panel according to a twenty-third embodiment of the present invention.
Figure 43:
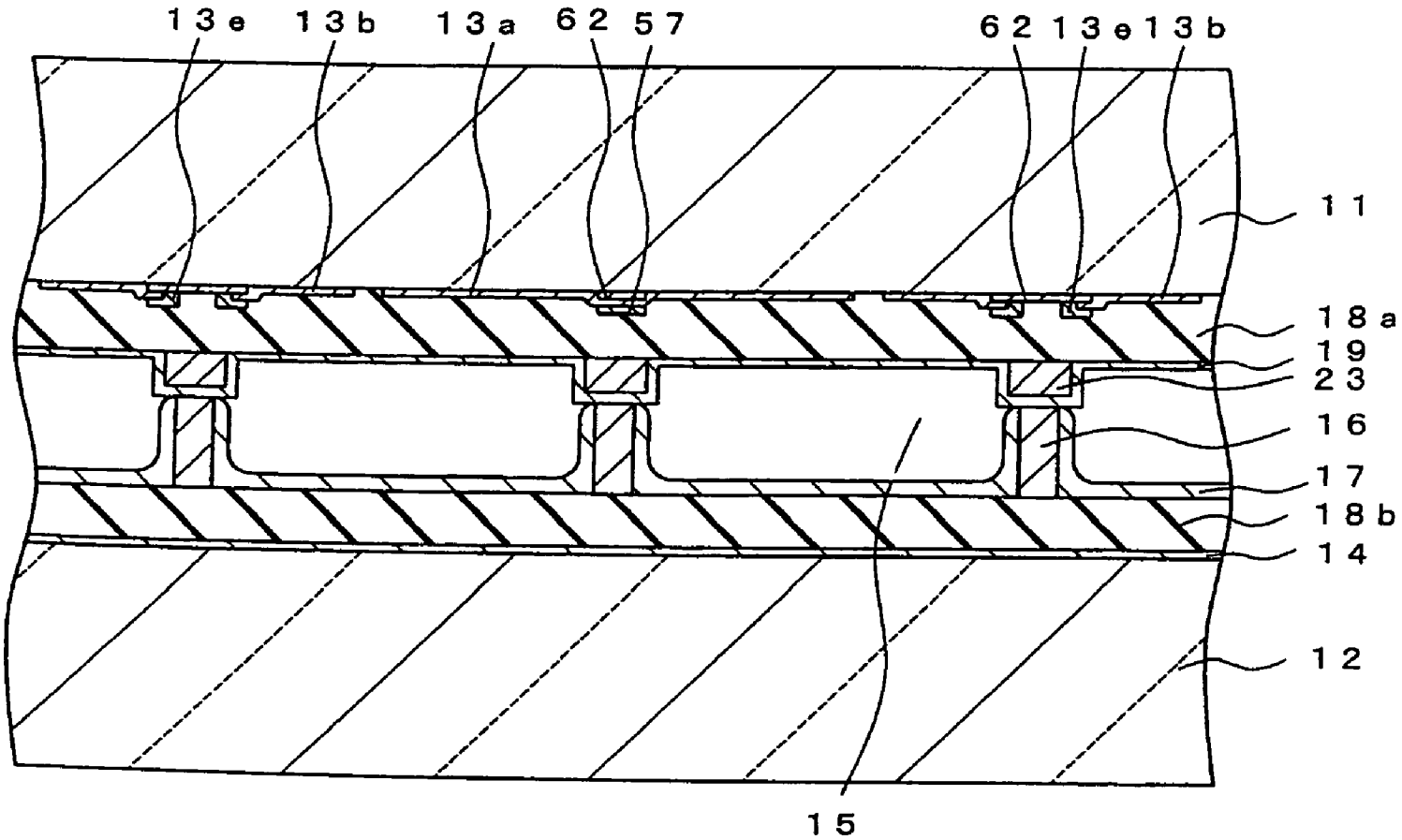
FIG. 43 is a cross-sectional view taken along line L-L of FIG. 42.
Figure 44:
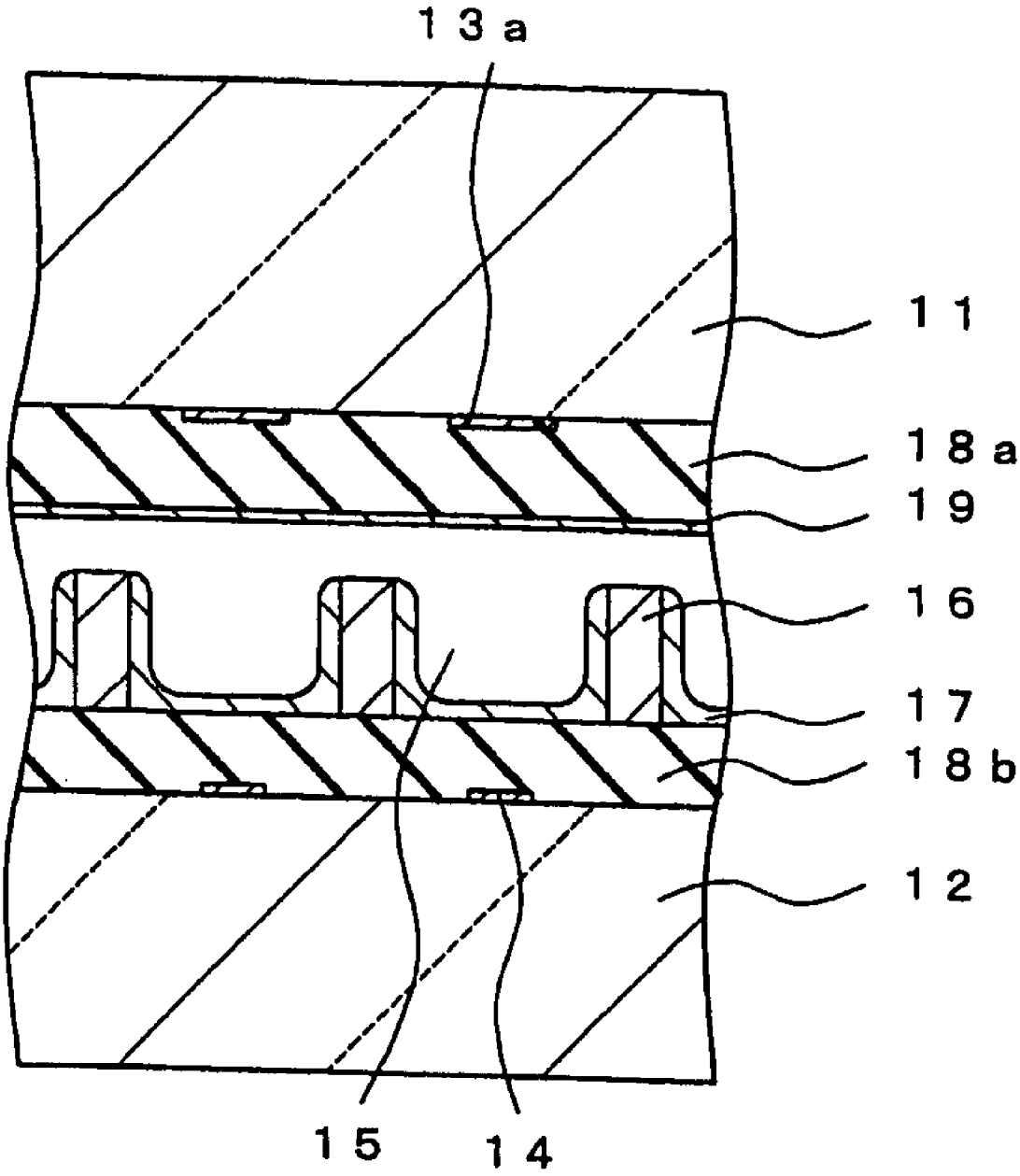
FIG. 44 is a cross-sectional view taken along line M-M of FIG. 42.

Now, a twenty-third embodiment according to the present invention is described below. FIG. 42 is a plan view illustrating a plasma display panel according to the twenty-third embodiment of the present invention. FIG. 43 is a cross-sectional view taken along line L-L of FIG. 42, and FIG. 44 is a cross-sectional view taken along line M-M of FIG. 42. In this embodiment, a black stripe pattern 62 (hereinafter referred to as the horizontal BS) is inserted in the row direction of FIG. 42. The horizontal BS 62 is provided on the first insulating substrate 11. The horizontal BS 62 is formed of an ordinary thick glass paste mixed with a black material (such as iron oxide or ruthenium oxide). The horizontal BS 62 being black acts to reduce the reflectivity of the display side and the surface reflectivity of the plasma display panel, thereby providing an effect of improving contrast.

In addition, suppose that white silver or the like having a high electrical conductivity is employed as the scan-side bus electrode 13*e* or the common bus electrode 57. Even in this case, the horizontal BS 62 is disposed so as to cover the bus electrodes 13*e*, 57, thereby providing a reduced surface reflectivity. For this reason, it is possible to use white silver electrodes of low resistance as the scan-side bus electrode 13*e* and the common bus electrode 57.

In the prior art, to reduce the reflectivity of bus electrodes formed of white silver, electrodes of black silver or the like were formed on the display side of the scan-side bus electrode 13*e* and the common bus electrode 57. However, the black silver is as expensive as the white silver and thus its drawback is the high cost of making electrodes. However, it is possible to reduce the cost by employing the comparatively inexpensive black BS 62 as in this embodiment.

Twenty-fourth Embodiment

Figure 45:
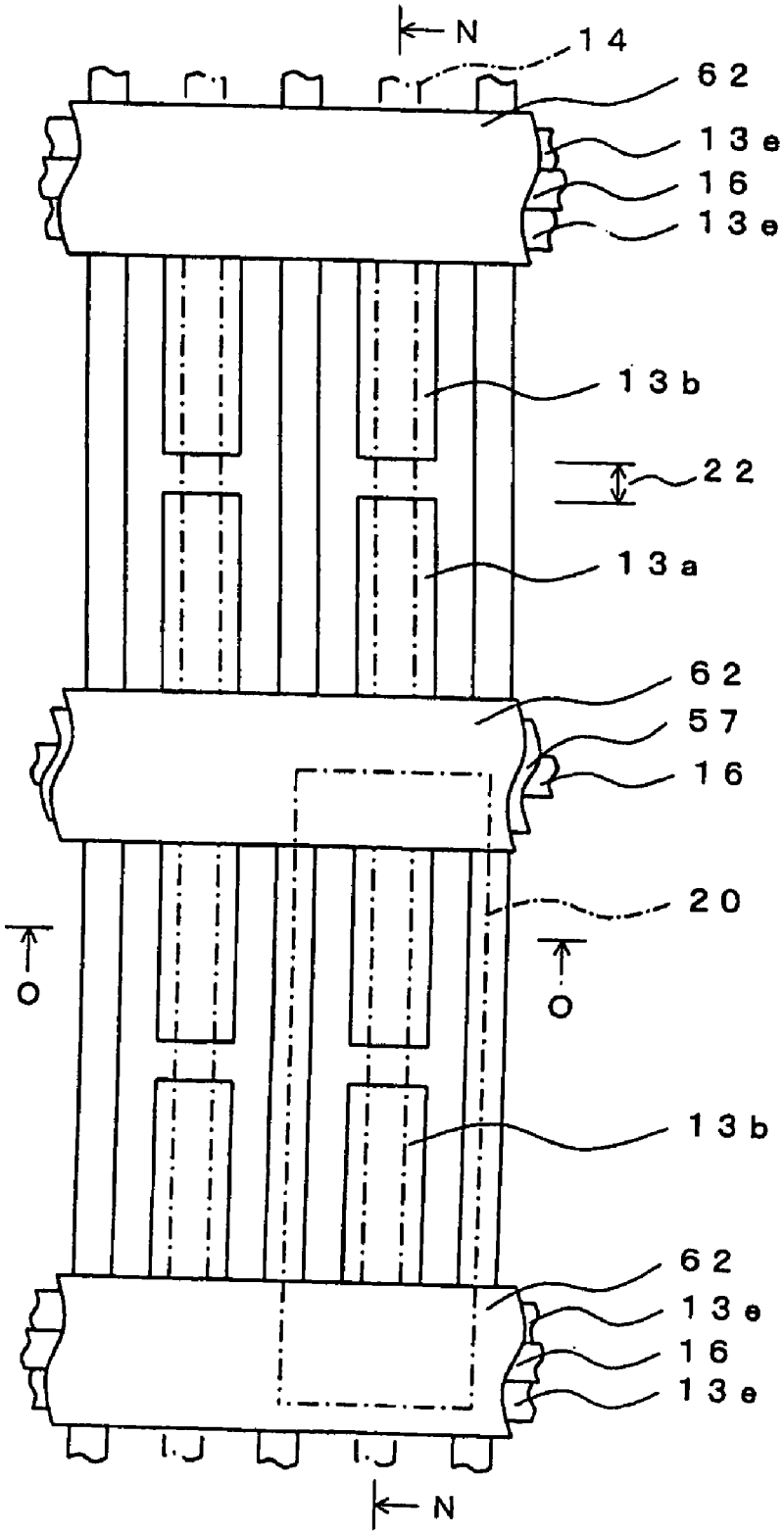
FIG. 45 is a plan view illustrating a plasma display panel according to a twenty-fourth embodiment of the present invention.
Figure 46:
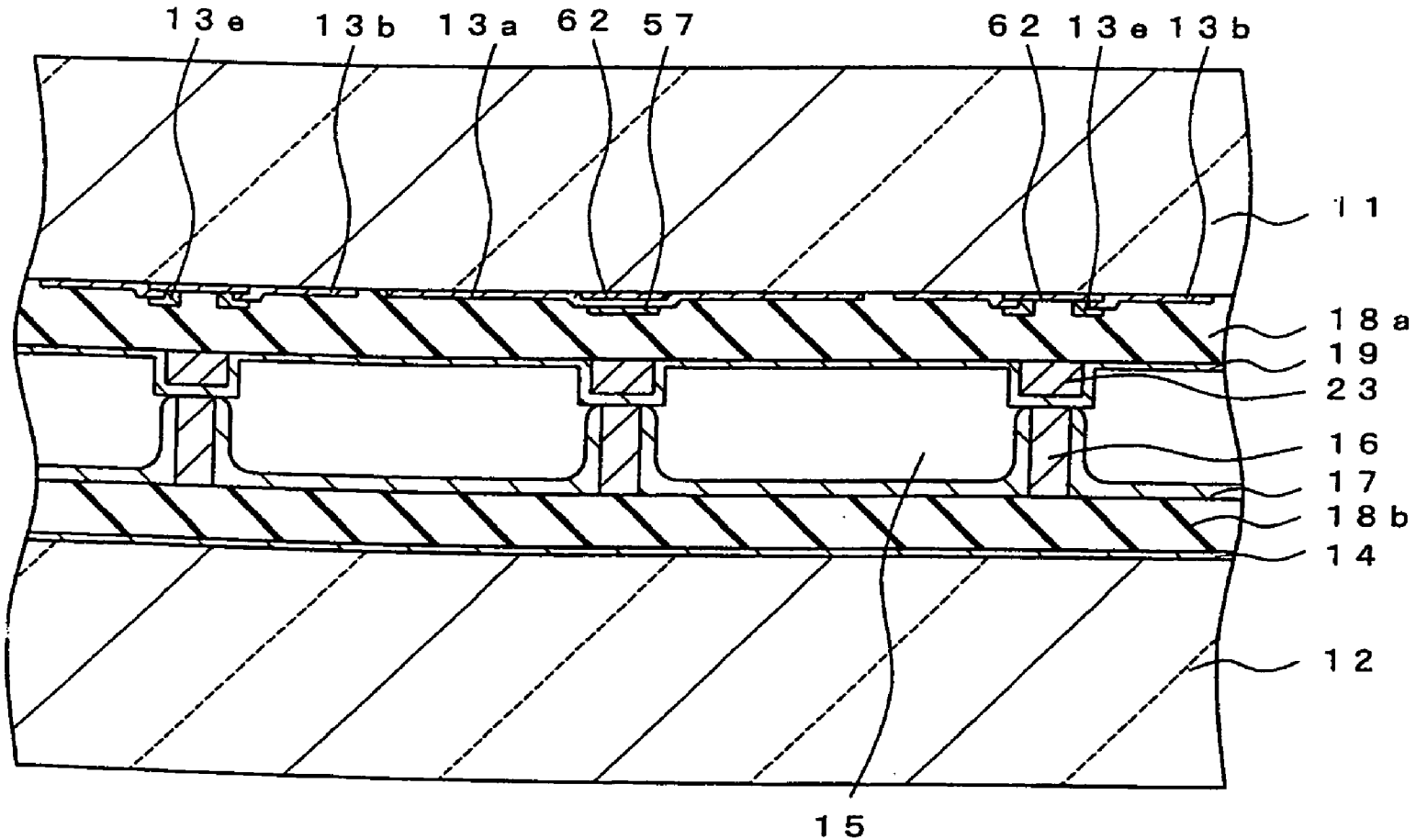
FIG. 46 is a cross-sectional view taken along line N-N of FIG. 45.
Figure 47:
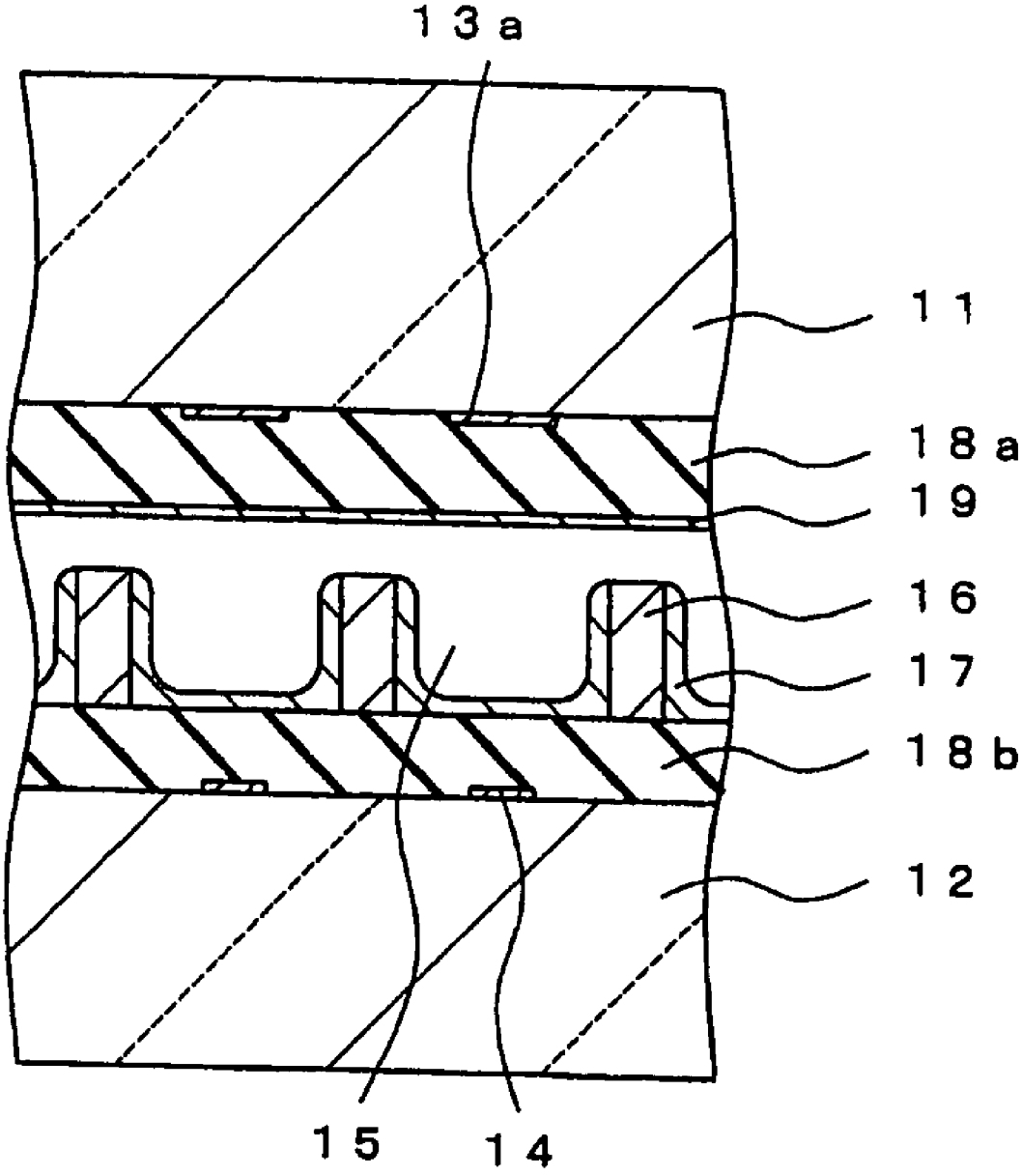
FIG. 47 is a cross-sectional view taken along line O-O of FIG. 46.

Now, a twenty-fourth embodiment according to the present invention is described below. FIG. 45 is a plan view illustrating a plasma display panel according to the twenty-fourth embodiment of the present invention. FIG. 46 is a cross-sectional view taken along line N-N of FIG. 45, and FIG. 47 is a cross-sectional view taken along line O-O of FIG. 46. This embodiment is the same as the twenty-third embodiment in having the black stripe pattern 62 formed in the horizontal direction but is different from the twenty-third embodiment in that horizontal BS's 62, each having the same width, are disposed at the same intervals to be vertically symmetric at each pixel cell. With the highly reflective scan-side bus electrodes 13*e* and common bus electrodes 57 being effectively covered, this makes it also possible to prevent horizontal fringes occurring in the column direction (the vertical direction) of FIG. 45 at pitch intervals twice as great as the pixel cell pitch.

Twenty-fifth Embodiment

Figure 48:
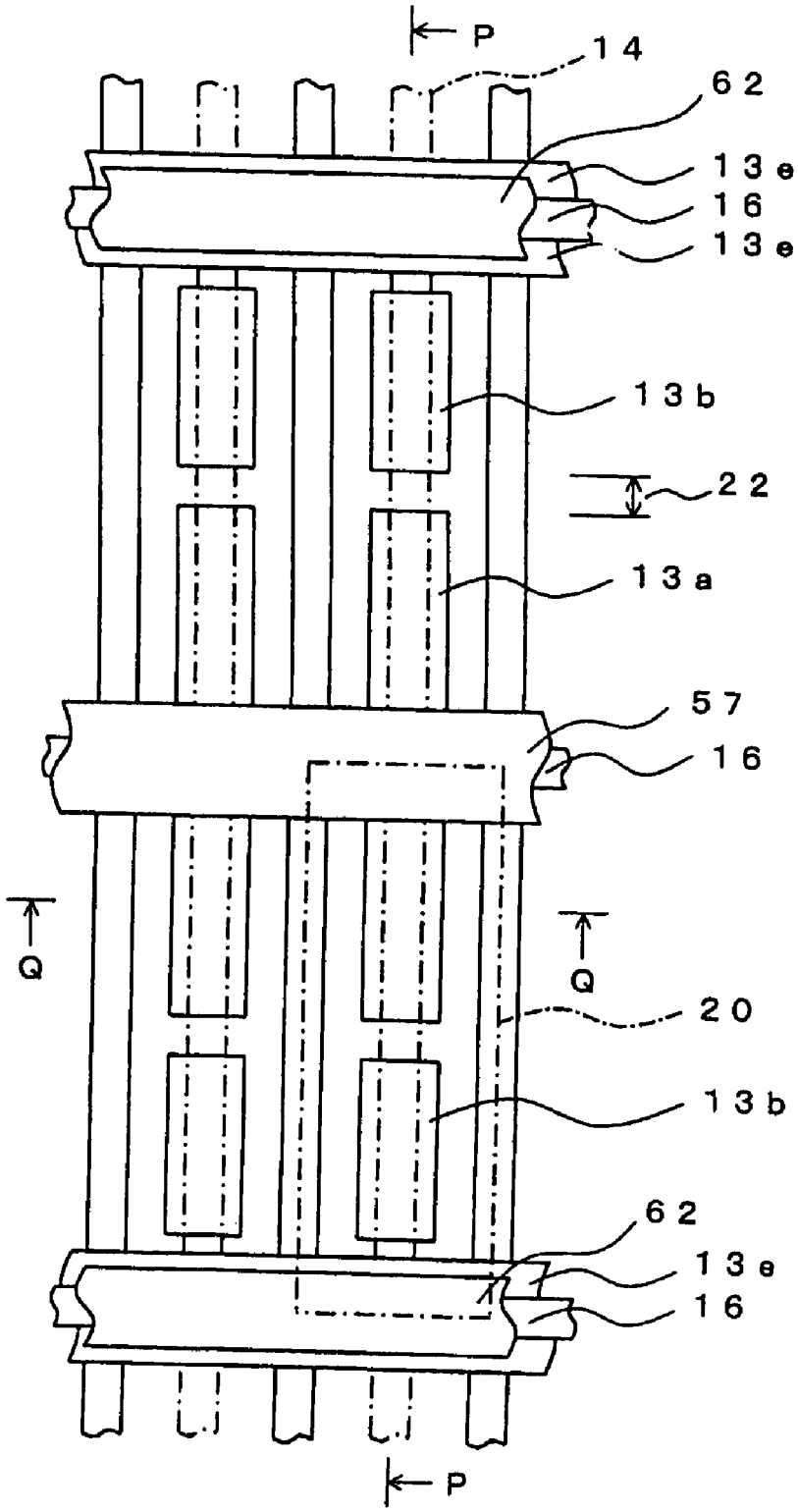
FIG. 48 is a plan view illustrating a plasma display panel according to a twenty-fifth embodiment of the present invention.
Figure 49:
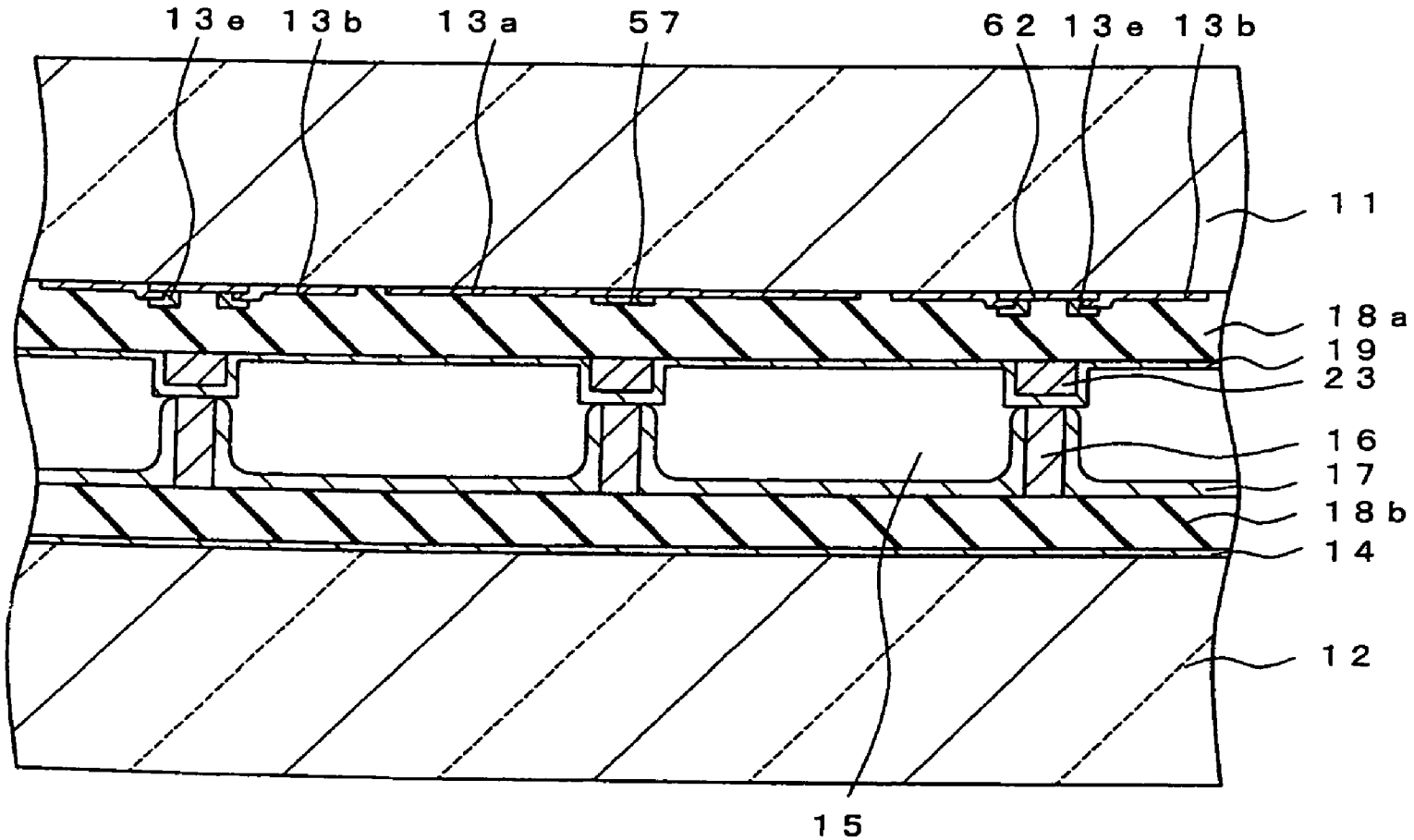
FIG. 49 is a cross-sectional view taken along line P-P of FIG. 48.
Figure 50:
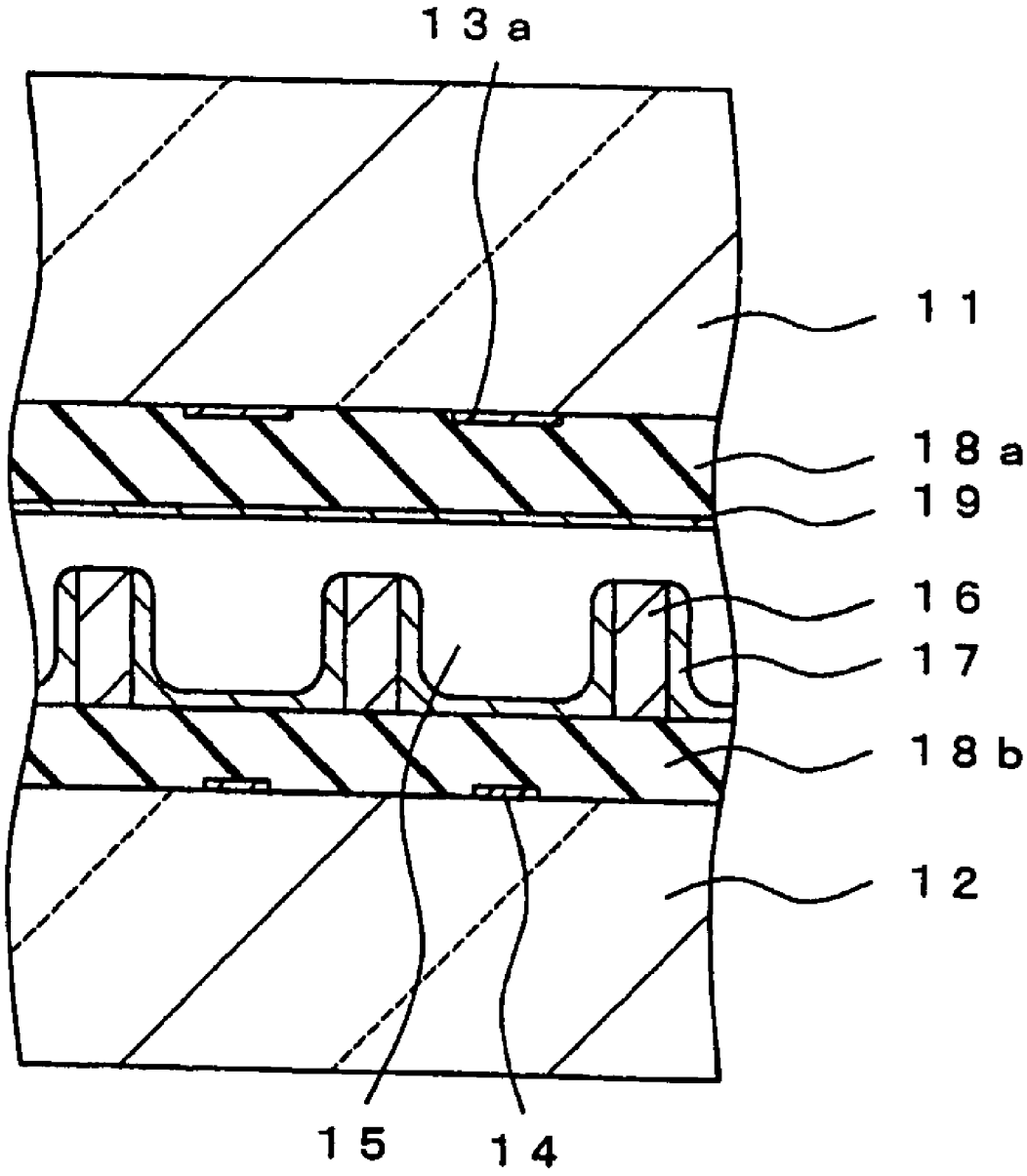
FIG. 50 is a cross-sectional view taken along line Q-Q of FIG. 48.

Now, a twenty-fifth embodiment according to the present invention is described below. FIG. 48 is a plan view illustrating a plasma display panel according to the twenty-fifth embodiment of the present invention. FIG. 49 is a cross-sectional view taken along line P-P of FIG. 48, and FIG. 50 is a cross-sectional view taken along line Q-Q of FIG. 48. This embodiment is the same as the twenty-third embodiment in having the black stripe pattern 62 formed in the horizontal direction but is different from the twenty-third embodiment in that the horizontal BS 62 of this embodiment is disposed between the scan-side bus electrodes 13*e* to overlap therewith.

The horizontal BS 62, a horizontal stripe formed of two neighboring black or gray scan-side bus electrodes 13*e*, and a horizontal stripe formed of a black or gray sustain-side bus electrode 13*d* are adapted to have the same width and all the horizontal stripes are disposed at the same intervals. This makes it possible to prevent horizontal fringes occurring in the vertical direction at pitch intervals twice as great as the pixel cell pitch. With the entire display side being formed in black, the scan-side bus electrode 13*e* and the common bus electrode 57 provide an effect of further enhancing contrast.

Twenty-sixth Embodiment

Figure 51:
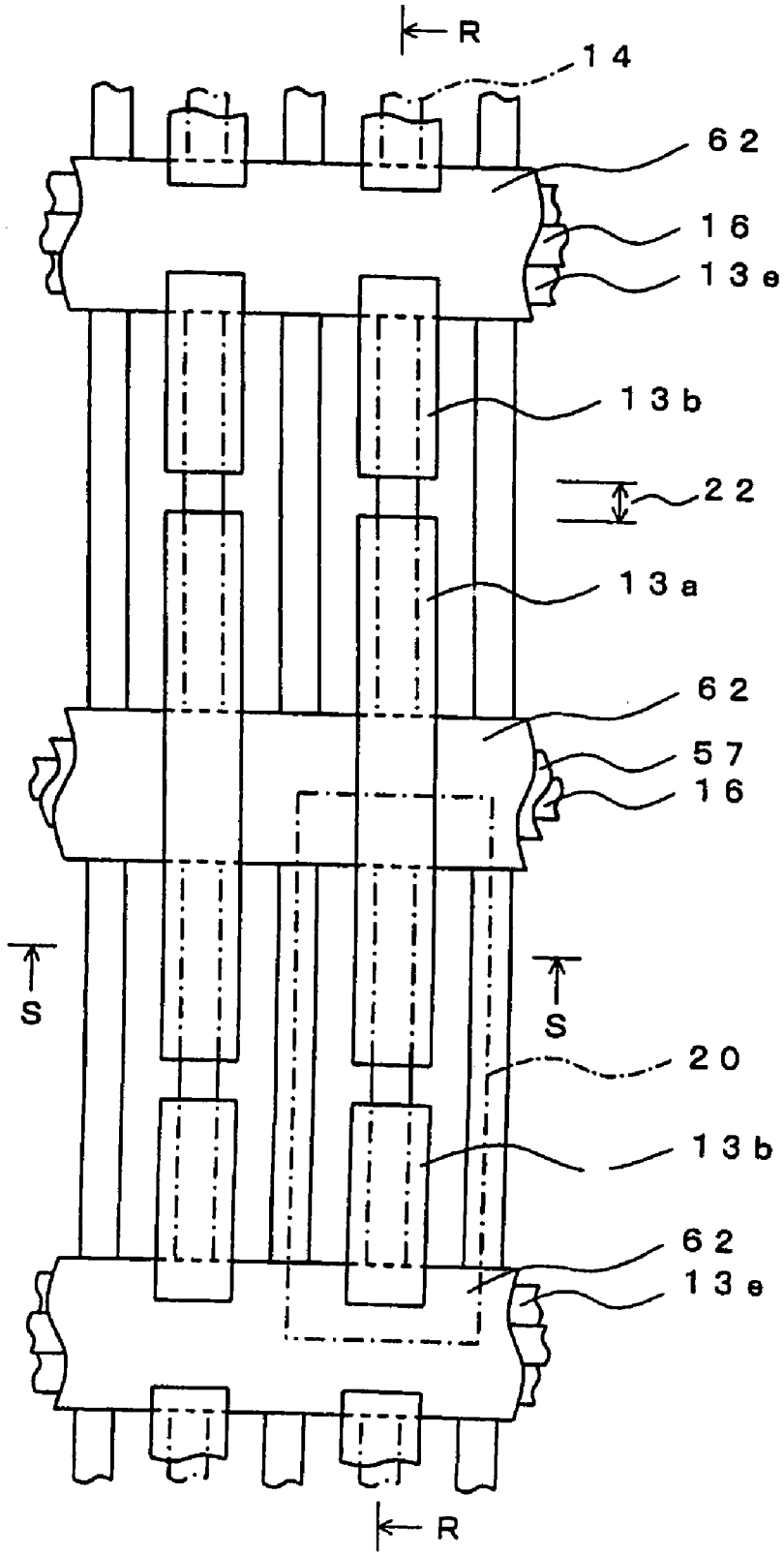
FIG. 51 is a plan view illustrating a plasma display panel according to a twenty-sixth embodiment of the present invention.
Figure 52:
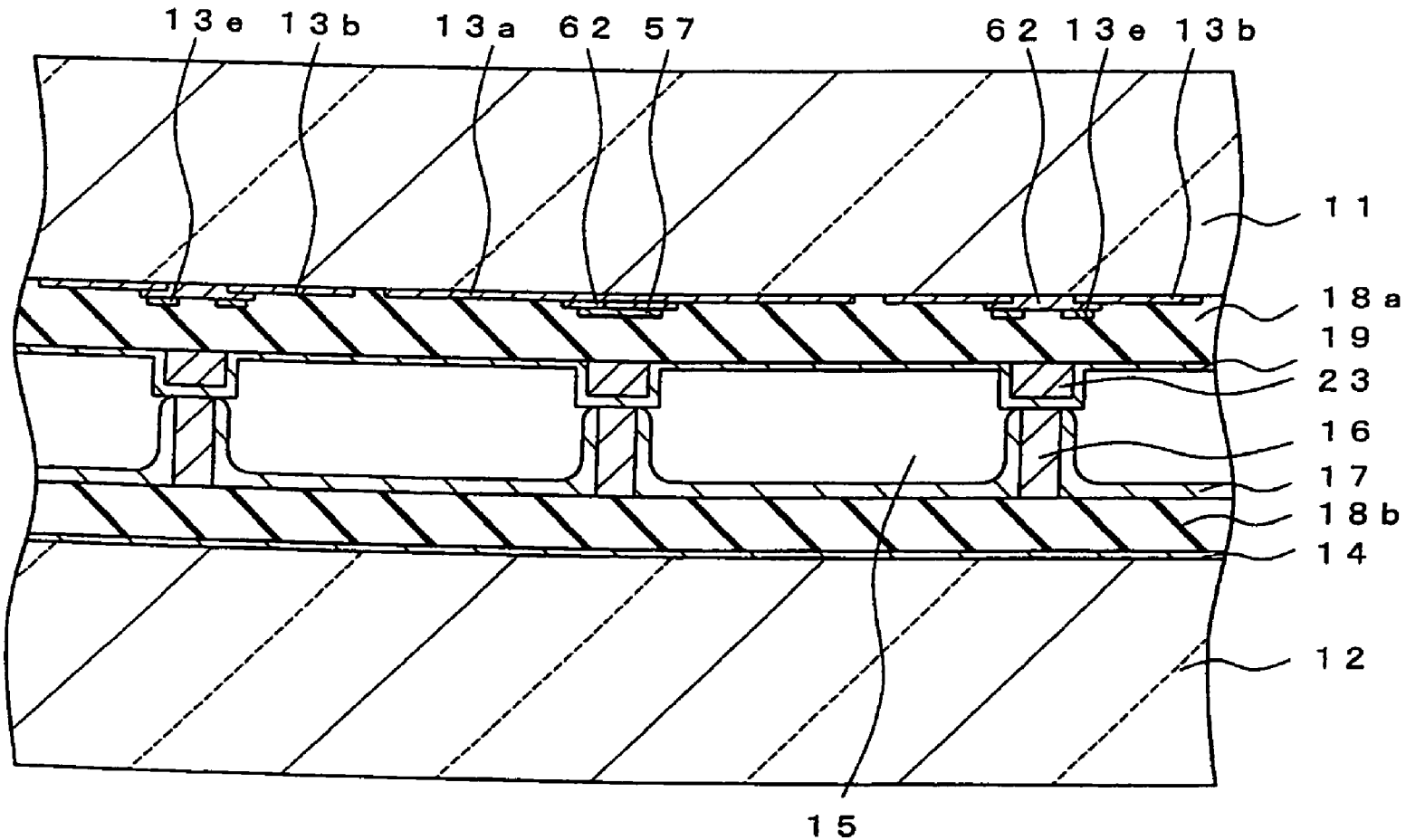
FIG. 52 is a cross-sectional view taken along line R-R of FIG. 51.
Figure 53:
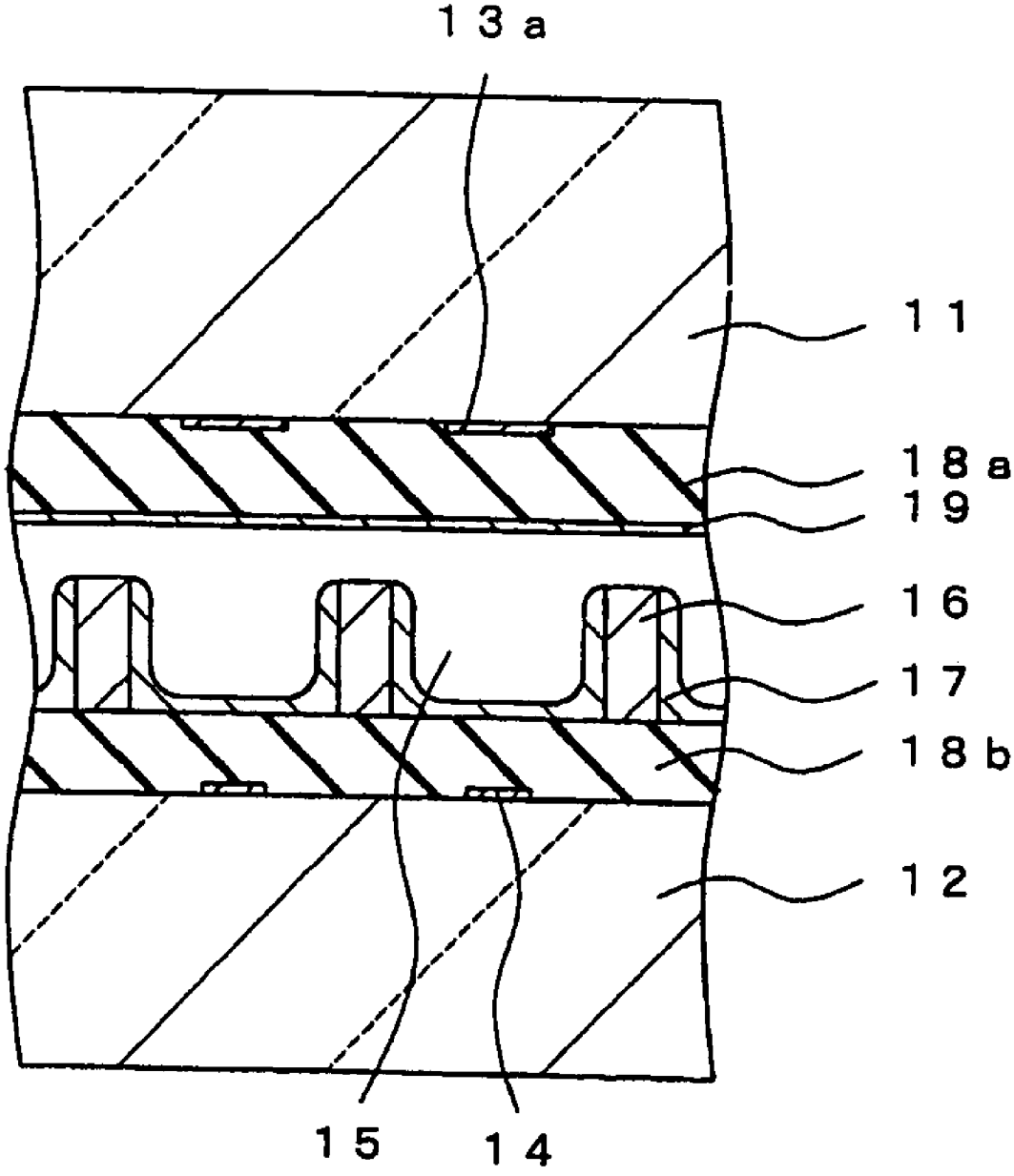
FIG. 53 is a cross-sectional view taken along line S-S of FIG. 51.

Now, a twenty-sixth embodiment according to the present invention is described below. FIG. 51 is a plan view illustrating a plasma display panel according to the twenty-sixth embodiment of the present invention. FIG. 52 is a cross-sectional view taken along line R-R of FIG. 51, and FIG. 53 is a cross-sectional view taken along line S-S of FIG. 51. The basic configuration of FIGS. 51 to 53 is the same as those of the twenty-third and the twenty-fourth embodiments but is different therefrom in that the horizontal BS 62 is disposed on top of the transparent scan electrode 13*b* and the sustain electrode 13*a*. With this arrangement, the horizontal BS 62 having a thickness of 1 to 5 μm is to be formed on top of the transparent scan electrode 13*b* and sustain electrode 13*a*, which are normally formed to have a thickness of about 0.2 μm.

Forming the scan electrode 13*b* and the sustain electrode 13*a*, which are thinner by ⅕ or more than the horizontal BS 62, on the horizontal BS 62 would cause a break in the scan electrode 13*b* and the sustain electrode 13*a* to be apt to occur due to the stepped portion at the edge of the horizontal BS 62. However, with the arrangement described above, this break can be effectively prevented. In this case, it is necessary to ensure the electrical connection between the scan electrode 13*b* and the scan-side bus electrode 13*e* or between the sustain electrode 13*a* and the common bus electrode 57. To this end, it is effective to increase the diameter of particles of the material for use with the horizontal BS 62 to make the structure of the horizontal BS 62 porous, thereby ensuring the electrical connection between the scan electrode 13*b* and the scan-side bus electrode 13*e* or between the sustain electrode 13*a* and the common bus electrode 57.

Figure 54:
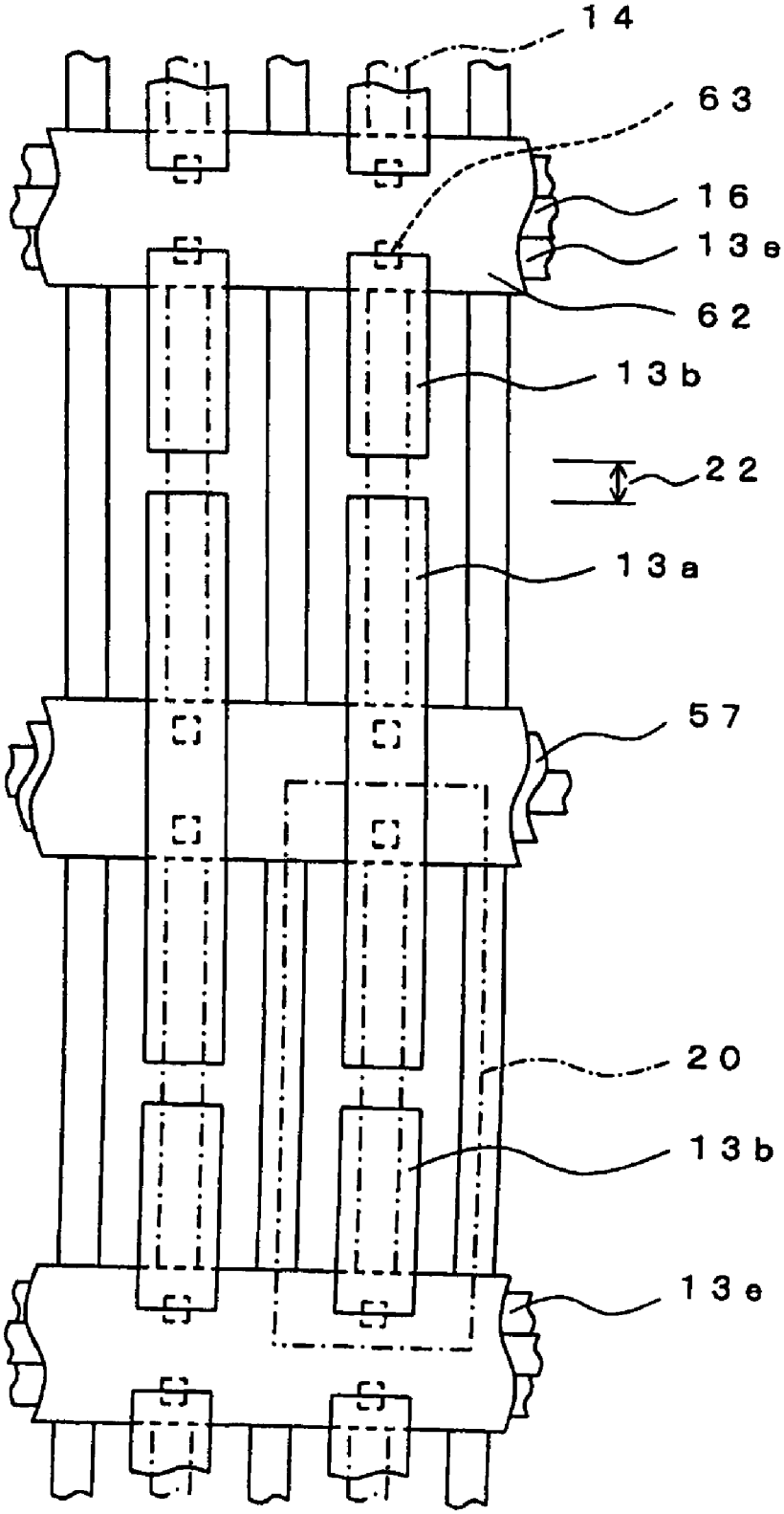
FIG. 54 is a plan view illustrating a modified example of the twenty-sixth embodiment.

Alternatively, as shown in a modified example of this embodiment of FIG. 54, it is effective to ensure the connection between the scan electrode 13*b* and the scan-side bus electrode 13*e* or between the sustain electrode 13*a* and the common bus electrode 57. Incidentally, FIG. 54 shows a window portion 63, however, this portion may be notched. In all the embodiments described above, the configuration of bus electrodes has not been mentioned. However, as in the prior art, the bus electrode, when illuminated, makes it possible to reduce reflectivity with the display side being formed of black metal electrodes and the inside of pixel cells being formed of metal electrodes, having a low resistance, of a given color.

The aforementioned embodiments are adapted to be driven by the same method as that of the prior art, allowing each pixel cell to have an independent scan electrode and pixel cells adjacent to each other in the column direction (the vertical direction) to share a common electrode. However, the present invention is intended to specify the structure of pixel cells of a plasma display panel but not intended to specify how to use each electrode. Thus, as a matter of course, the scan electrode described above with reference to the foregoing embodiments may be used as the sustain electrode and the sustain electrode may also be used as the scan electrode. An example of a driving method for this case is explained briefly below.

Figure 55:
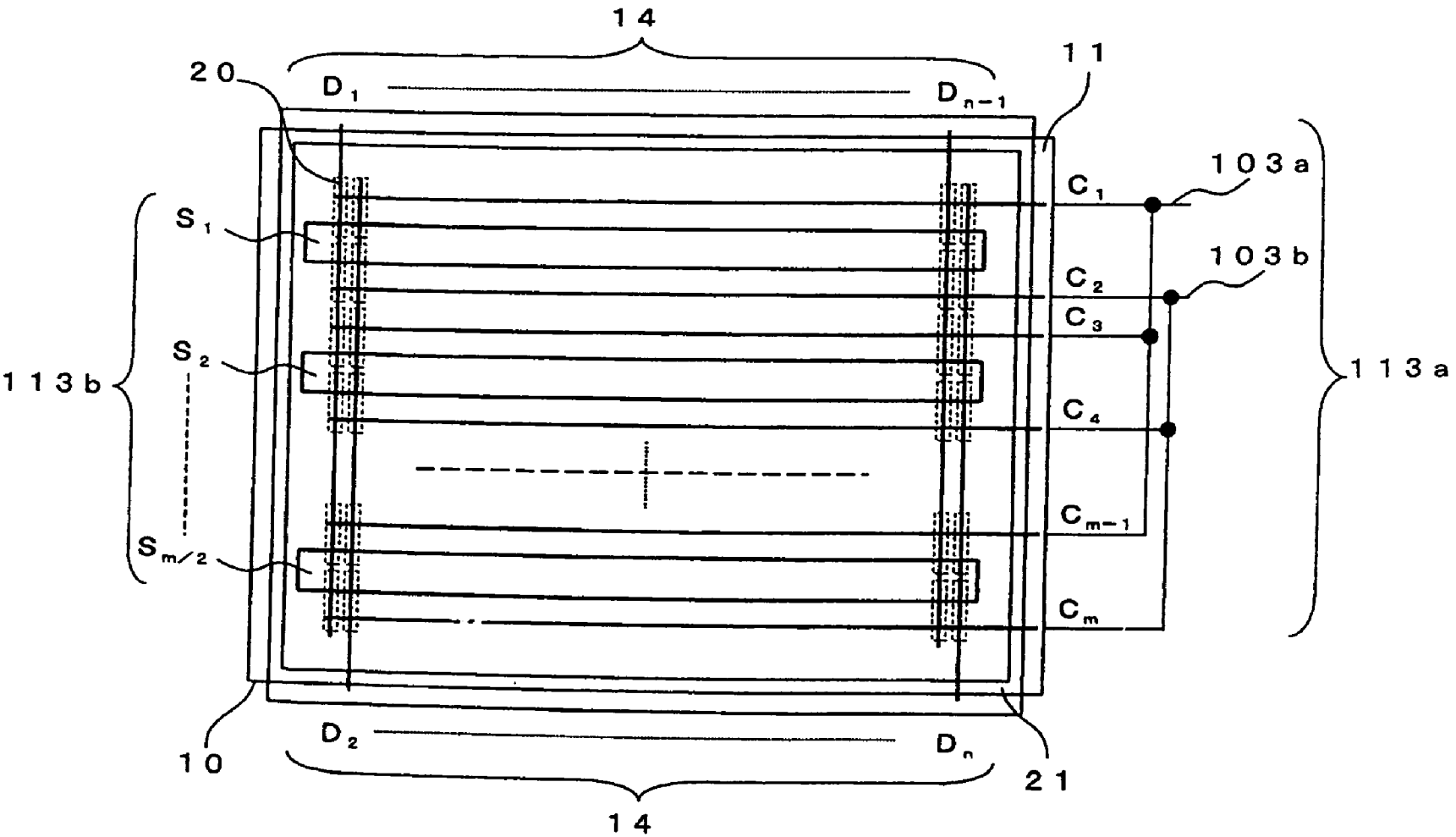
FIG. 55 is a schematic view of the arrangement of electrodes of an AC memory-type plane discharge plasma display panel, illustrating the connections of the scan electrodes and the sustain electrodes, which are interchanged to be driven using the panel configured according to the present invention.

FIG. 55 is a schematic view of the arrangement of electrodes of a plasma display panel, illustrated to explain how to apply a driving method different from those of the prior art to the plasma display panel having the structure of pixel cells according to the present invention described above. Referring to FIG. 55, reference symbol 113*b* denotes scan electrodes, 113*a* denotes sustain electrodes, and 14 denotes column electrodes. The scan electrode 13*b* described with reference to the first to twenty-fifth embodiments is used as the sustain electrode 113*a*, and the sustain electrode 13*a* is used as the scan electrode 113*b*.

Pixel cells 20 are defined at the intersections of a pair of scan electrodes 113*b* and a sustain electrode 113*a*, parallel to one another, and the column electrodes 14 orthogonal thereto. Vertically neighboring pixel cells 20 share the scan electrodes 113*b*, which are in turn coupled to the output pin of a scan driver IC (not shown). With this arrangement, the number of outputs of the scan driver IC is one-half of that of the display lines. The sustain electrodes 113*a* are divided into a first sustain electrode group 103*a* located above the scan electrodes 113*b* and a second sustain electrode group 103*b* located below the scan electrodes 113*b*. Electrical connection (not shown) is provided for each of the groups outside the panel or outside the display area within the panel.

Figure 56:
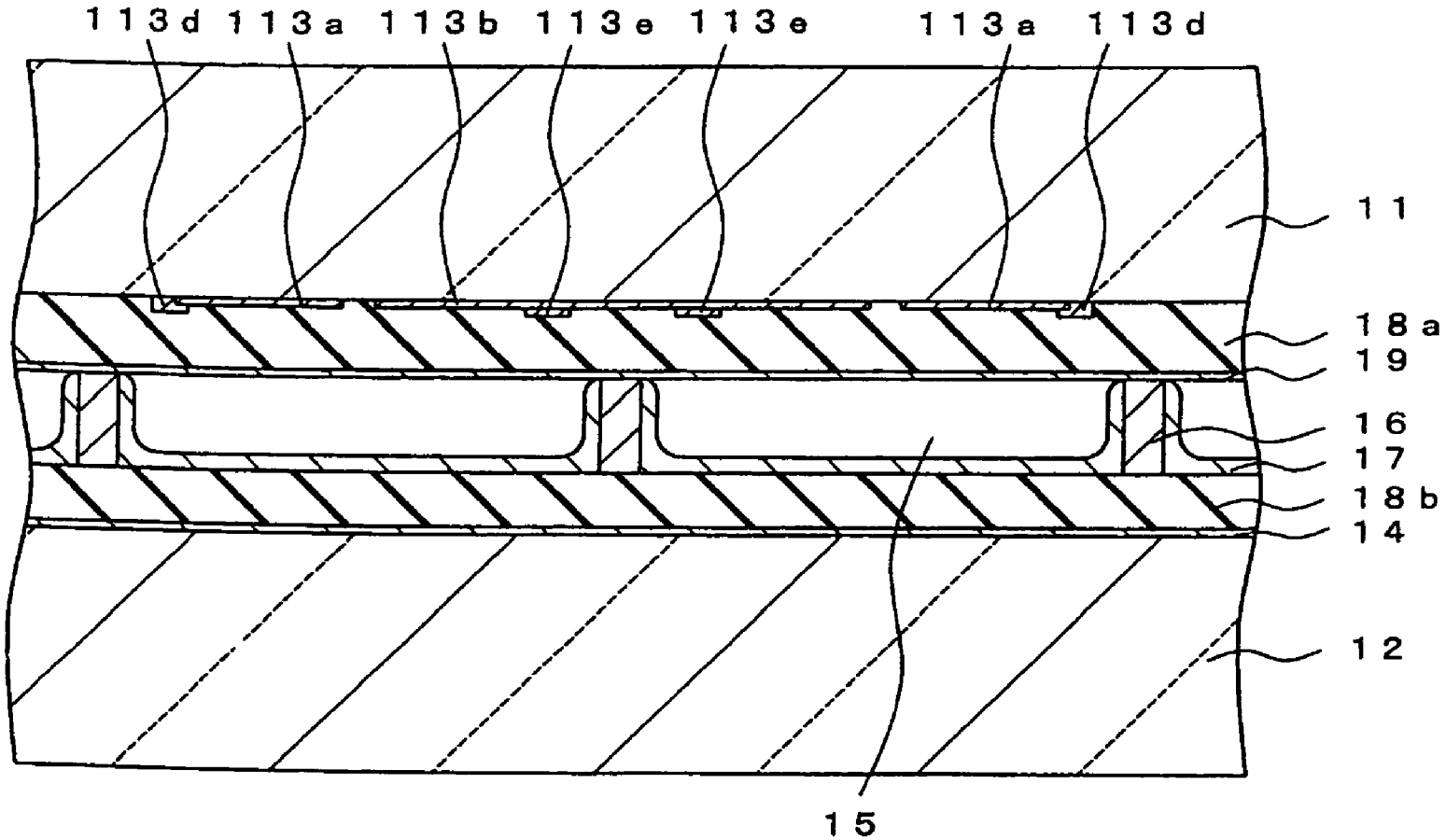
FIG. 56 is a cross-sectional view taken along a column electrode of FIG. 55.

FIG. 56 is a cross-sectional view taken along the column electrode 14 of FIG. 55. FIG. 56 is a cross-sectional view illustrating the main portion of the plasma display panel corresponding to FIG. 55, also corresponding to FIG. 8 of the first embodiment. FIG. 56 is different from FIG. 8 in that the scan electrode 13*b* and the sustain electrode 113*a* are interchanged, and the scan-side bus electrode 13*e* and sustain-side bus electrode 113*d* are interchanged.

Figure 57:
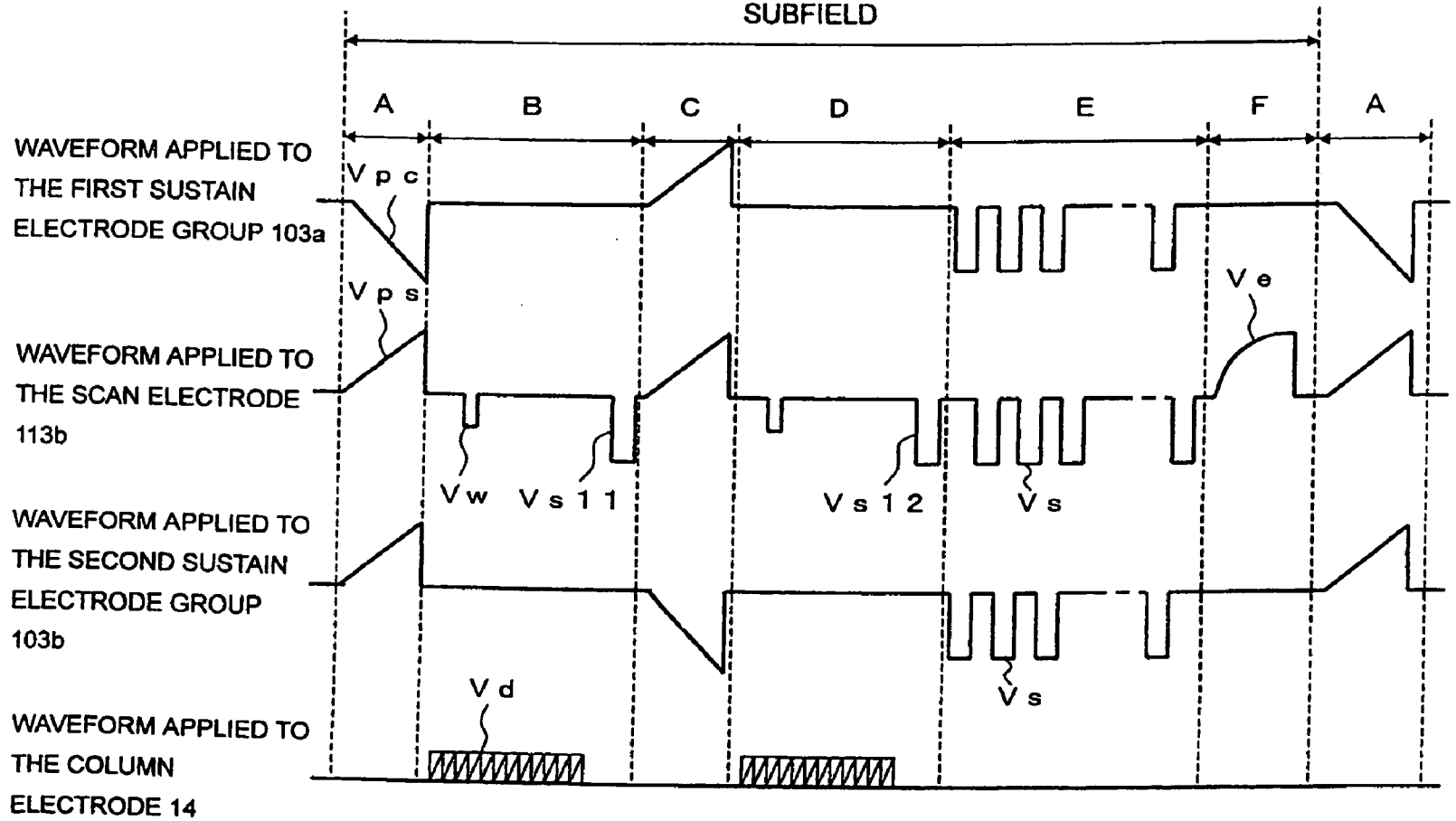
FIG. 57 is a timing chart illustrating a drive method in accordance with the sub-field method.

FIG. 57 is a timing chart illustrating this drive method. In addition, FIGS. 58A to 58D are schematic views of the state of wall charges inside the pixel cells of the panel shown in cross section in FIG. 56, each illustrating the state of wall charges at the end of each cycle of sub-fields A to D in FIG. 57.

The operation by the driving method is explained below with reference to FIG. 57 and FIGS. 58A to 58D. First, during the first preliminary discharge cycle A, a negative sawtooth preliminary discharge pulse Vpc is applied to the sustain electrode group 103*a*. In phase therewith, a preliminary discharge pulse Vps having the reversed polarity is applied to the scan electrode 113*b*. The voltage difference attained by a preliminary discharge pulse Vp between the scan electrode 113*b* and the sustain electrode 113*a* is set to be higher than a discharge initiating voltage between the sustain electrode 113*a* and the scan electrode 113*b*. In addition, the same waveform voltage as that for the scan electrode 113*b* is applied to the sustain electrode group 103*b*. In the pixel cell 20*a* including the sustain electrode group 103*a*, a discharge occurs at the time at which the discharge initiating voltage has been exceeded during the application of the preliminary discharge pulse Vp, with the scan electrode 113*b* being positive. This causes negative wall charges to build up on the scan electrode 113*b* and positive wall charges to build up on the sustain electrode 113*a*. At this time, in the pixel cell 20*b* including the sustain electrode group 103*b*, no voltage difference is established and therefore no discharge occurs.

Then, during the first select operation cycle B, a scan pulse Vw is applied to the scan electrode 113*b* and a data pulse Vd is applied to the column electrode 14 in response to display data. This causes the wall charges to vanish only in the pixel cell 20 to which the data pulse Vd has been applied. Furthermore, a first sustain discharge pulse Vs11 is applied to the scan electrode 113*b* to cause a discharge to occur only at the pixel cell 20*a* having wall charges built up or in the "ON" state. At the same time, wall charges of reversed polarities are built up on the scan electrode 113*b* and the sustain electrode 113*a*, respectively. FIG. 58 illustrates the case where the pixel cell 20*a* is in the "ON" state.

Figures 58A, 58B, 58C, 58D:
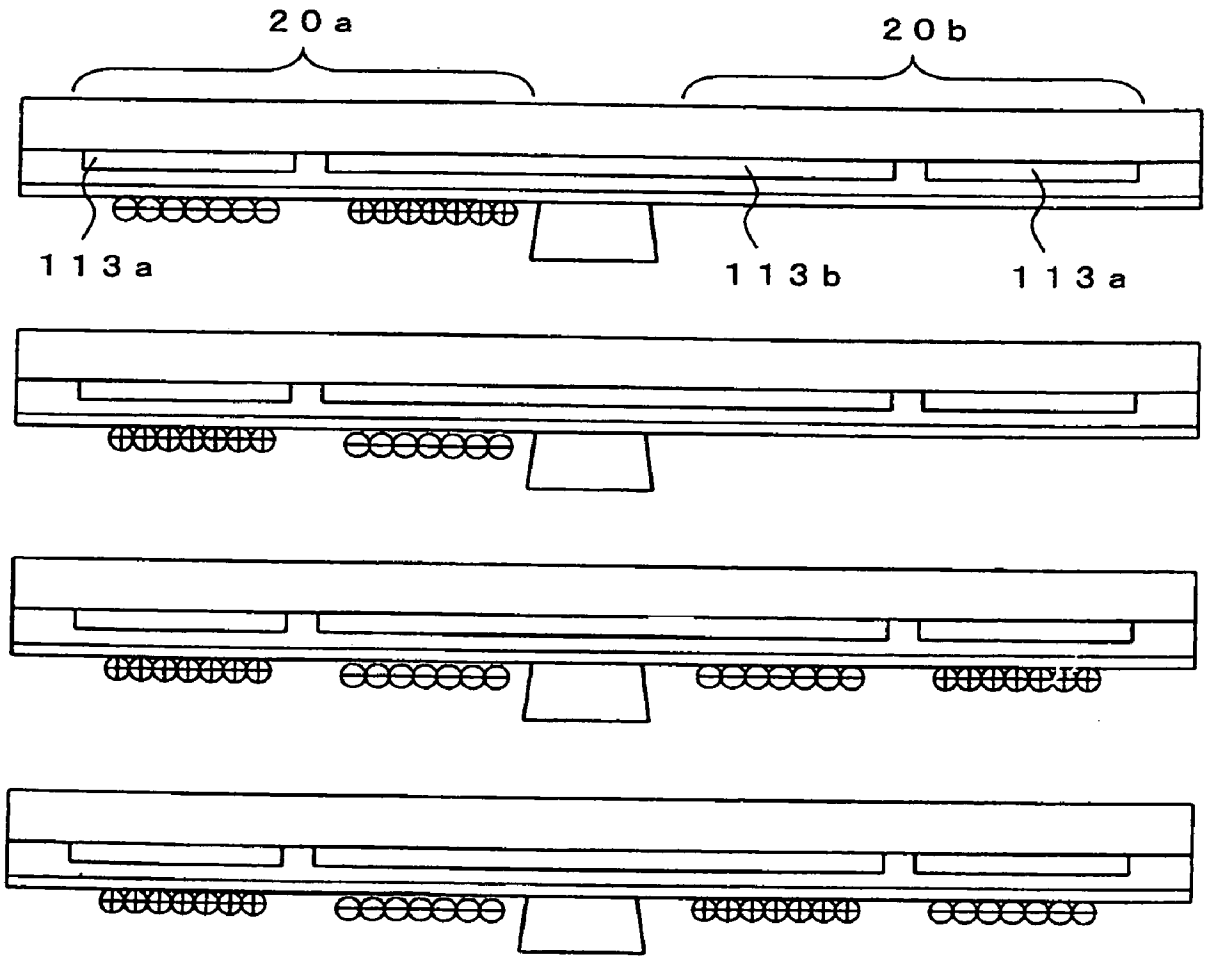
FIGS. 58A to 58D are schematic views illustrating the state of wall charges inside the pixel cells of the panel shown in cross section in FIG. 56.

Likewise, during the subsequent second preliminary discharge cycle C and second select operation cycle D, a selective operation is carried out only in the pixel cell 20*b* including the sustain electrode group 103*b* to cause wall charges to build up only in the pixel cell 20*b* that is in the "ON" state. FIG. 58D illustrates the case where the pixel cell 20*b* is in the "ON" state. Even in this case, no change occurs in the pixel cell 20*a* including the sustain electrode group 103*a*.

Then, during the sustain cycle E, a discharge sustain pulse Vs having a reversed polarity is applied to all the scan electrodes 113*b* and sustain electrodes 113*a*, thereby causing a discharge only in the pixel cells 20, where the wall charges have not been erased, to obtain light emission for display purposes during the select operation cycles B and D. Furthermore, during the sustain erase cycle F, a blunt-waveform sustain erase pulse Ve is applied to erase wall charges to thereby terminate the discharge, and then operation proceeds to the subsequent sub-field. By the foregoing operations, it is possible to perform the "ON" and "OFF" control on all the pixel cells 20 within one sub-field.

As described above, it is also possible to perform the light-emitting and non-light-emitting control on each pixel cell by allowing pixel cells adjacent to each other in the vertical direction to share a scan electrode and using an independent sustain electrode for each pixel cell.

Furthermore, in each of the aforementioned embodiments, the scan electrode and the sustain electrode are completely cut apart in the row direction and each pixel cell is provided with a separate scan electrode 13*b* and sustain electrode 13*a*. However, the effects of the present invention can be obtained even by the scan electrode 13*b* and the sustain electrode 13*a* which are provided with a notched portion between pixel cells 20 adjacent to each other in the row direction and thus not completely separated from each other.

What is claimed is:

1. An AC plane discharge plasma display panel comprising:

a front substrate;

a rear substrate;

a sealing portion for encapsulating said front substrate and said rear substrate at a peripheral edge portion thereof to seal a discharge gas therein;

column ribs extending in a column direction and row ribs extending in a row direction, perpendicular to the column ribs, to thereby define pixel cells in a matrix;

a plurality of sustain electrodes and a plurality of scan electrodes such that said sustain electrode faces said scan electrode over a discharge gap in the column direction within each said pixel cell, wherein each said sustain electrode has a first display electrode portion and a first bus electrode portion and each said scan electrode has a second display electrode portion and a second bus electrode portion such that said first display electrode portion faces said second display electrode portion over said discharge gap in each said pixel cell, wherein said first bus electrode portions of said sustain electrodes and said second bus electrode portions of said scan electrodes extend in parallel to the row ribs and are spaced from the row ribs in the column direction, wherein said column ribs and said row ribs form lattice-shaped ribs on said rear substrate, wherein a gap for allowing the discharge gas to pass therethrough is provided between a top of the lattice-shaped rib and said front substrate, wherein the AC plane discharge plasma display panel further comprises projecting portions formed on said front substrate at positions corresponding to intersections of the row and column ribs of the lattice-shaped ribs or formed on the intersections of the row and column ribs of the lattice-shaped ribs, and wherein the projecting portions are configured to prevent spurious light emission.

2. The AC plane discharge plasma display panel according to claim 1, wherein a distance between two neighboring said bus electrode portions is 20 to 200 micrometers.

3. The AC plane discharge plasma display panel according to claim 1, wherein a distance between two neighboring said bus electrode portions is 50 to 150 micrometers.

4. The AC plane discharge plasma display panel according to claim 1, further comprising at least one notched or cutaway end portion in said first or second display electrode portion between two adjacent pixel cells disposed in the row direction.

5. The AC plane discharge plasma display panel according to claim 1, wherein said first display electrode portions and said second display electrode portions extend in parallel to the column ribs and spaced from the column ribs in the row direction.

6. The AC plane discharge plasma display panel according to claim 5, wherein a distance between each said first display electrode portion and the neighboring column rib is 20 to 70 micrometers and a distance between each said second display electrode portion and the neighboring column rib is 20 to 70 micrometers.

7. The AC plane discharge plasma display panel according to claim 5, wherein a distance between each said first display electrode portion and the neighboring column rib is 30 to 50 micrometers and a distance between each said second display electrode portion and the neighboring column rib is 30 to 50 micrometers.

8. The AC plane discharge plasma display panel according to claim 1, further comprising horizontal black stripes disposed in the row direction.

9. The AC plane discharge plasma display panel according to claim 8, wherein said horizontal black stripes are disposed at equal intervals in the column direction to be vertically symmetric with each other in each said pixel cell.

10. The AC plane discharge plasma display panel according to claim 8, wherein said scan electrodes and sustain electrodes are formed on said front substrate, and said horizontal black stripes are formed on the scan electrodes and the sustain electrodes.

11. The AC plane discharge plasma display panel according to claim 10, further comprising a plurality of holes or notches formed on the horizontal black stripes to ensure electrical connection between the first bus electrode portion and first display electrode portion of each said sustain electrode and between the second bus electrode portion and second display electrode portion of each said scan electrode.

12. The AC plane discharge plasma display panel according to claim 1, further comprising recessed portions formed on said front substrate at positions corresponding to intersections of the row and column ribs of the lattice-shaped ribs or formed on the intersections of the row and column ribs of the lattice-shaped ribs.

13. The AC plane discharge plasma display panel according to claim 12, wherein the lattice-shaped ribs other than said recessed portions separate one said sustain electrode from another said sustain electrode neighboring in the row direction and also separate one said scan electrode from another said scan electrode neighboring in the row direction.

14. The AC plane discharge plasma display panel according to claim 1, further comprising horizontal barrier walls having a thickness of 2 to 50 micrometers between each two adjacent said pixel cells, said horizontal barrier walls being formed in parallel to the first and second bus electrode portions.

15. The AC plane discharge plasma display panel according to claim 14, wherein said horizontal barrier walls are formed of a material having a dielectric constant lower than that of an insulating layer provided on said front substrate.

16. The AC plane discharge plasma display panel according to claim 14, wherein the horizontal barrier walls are provided with extensions extending in a direction orthogonal to a longitudinal direction of the horizontal barrier walls, said extensions being disposed between said pixel cells adjacent to each other in the row direction.

17. The AC plane discharge plasma display panel according to claim 1, wherein said column ribs and row ribs form lattice-shaped ribs on the rear substrate, and said row ribs that separate one said pixel cell from another said pixel cell neighboring in the column direction is higher than said column ribs that separate one said pixel cell from another said pixel cell neighboring in the row direction.

18. The AC plane discharge plasma display panel according to claim 1, wherein each said first bus electrode portion has a thickness of 10 to 50 micrometers and each said second bus electrode portion has a thickness of 10 to 50 micrometers, and the thickness of the first bus electrode portion creates a first raised portion of 2 to 50 micrometers on a surface of an insulating layer provided on said front substrate and the thickness of the second bus electrode portion creates a second raised portion of thickness 2 to 50 micrometers on the surface of said insulating layer.

19. The AC plane discharge plasma display panel according to claim 1, wherein said projecting portions separate the first bus electrode portion in one said pixel cell from the first bus electrode portion in another said pixel cell neighboring in the row direction and also separate the second bus electrode portion in one said pixel cell from the second bus electrode portion in another said pixel cell neighboring in the row direction, or separate one said sustain electrode from another said sustain electrode neighboring in the row direction and also separate one said scan electrode from another said scan electrode neighboring in the row direction.

* * * * *